US012660980B2

(12) United States Patent
Todd et al.

(10) Patent No.: US 12,660,980 B2
(45) Date of Patent: Jun. 23, 2026

(54) DEVICE AND APPARATUS

(71) Applicant: Lava Wash Ltd, London (GB)

(72) Inventors: Theodore James Leece Todd, London (GB); Rory Clifford Tippetts Taylor, Swindon (GB)

(73) Assignee: Lava Wash Ltd, London (GB)

( * ) Notice: Subject to any disclaimer, the term of this patent is extended or adjusted under 35 U.S.C. 154(b) by 0 days.

(21) Appl. No.: 18/739,803

(22) Filed: Jun. 11, 2024

(65) Prior Publication Data

US 2024/0407625 A1 Dec. 12, 2024

(30) Foreign Application Priority Data

May 10, 2023 (GB) ..... 2306872
Aug. 8, 2023 (GB) ..... 2312107

(51) Int. Cl.
*A47L 15/00* (2006.01)
*A47L 15/42* (2006.01)

(52) U.S. Cl.
CPC ..... *A47L 15/0065* (2013.01); *A47L 15/4234* (2013.01); *A47L 15/4278* (2013.01)

(58) Field of Classification Search
None
See application file for complete search history.

(56) References Cited

U.S. PATENT DOCUMENTS 3,469,586 A 9/1969 Berson et al.
3,926,668 A 12/1975 Ross
4,608,780 A 9/1986 Van Noy
10,588,478 B2 3/2020 Alali et al.
2014/0159555 A1 6/2014 Lundberg et al.
2016/0324392 A1 11/2016 Xu et al.
2022/0079413 A1 3/2022 Longo et al.

FOREIGN PATENT DOCUMENTS

CN 106466161 A 3/2017
CN 108294652 A 7/2018
CN 109419477 A 3/2019
CN 208709804 U 4/2019
EP 2462856 A1 6/2012
GB 1566073 4/1980
GB 2607696 A 12/2022
(Continued)

OTHER PUBLICATIONS

Google Patents translation of JP2653256B2 (Year: 2025).*

*Primary Examiner* — Eric W Golightly
(74) *Attorney, Agent, or Firm* — Grimes & Yvon LLP

(57) ABSTRACT

The present invention relates to a device. The device is for cleaning a receptacle that is at least partly open-ended at one end and having an interior space defined by an interior wall. The device is capable of cleaning at least a part of the interior wall of the receptacle. The device has a receiving component for receiving and holding the receptacle to allow for the cleaning of at least the part of the interior wall of the receptacle. The device also has a cleaning component that is capable of cleaning at least part of the interior wall of the receptacle interior wherein the cleaning component comprises a cleaning element that is locatable within the interior space of the receptacle when the receptacle is held by the receiving component.

27 Claims, 29 Drawing Sheets

(56) References Cited

FOREIGN PATENT DOCUMENTS

| | | | |
|---|---|---|---|
| GB | 2615417 | A | 8/2023 |
| JP | H04371126 | A | 12/1992 |
| JP | H0513356 | U | 2/1993 |
| JP | 2653256 | B2 * | 9/1997 |
| JP | 2004024907 | A | 1/2004 |
| JP | 2006255252 | A | 9/2006 |
| JP | 2007282749 | | 11/2007 |
| WO | WO 00/01292 | | 1/2000 |

* cited by examiner

DEVICE AND APPARATUS

FIELD OF THE INVENTION

Background of the Invention

The present invention relates to a device (apparatus), in particular a device for cleaning receptacles and a method in which the device is operated. The device can also be referred to as an appliance. Example receptacles for cleaning include drinking receptacles, such as cups, beakers, mugs, glasses including but not limited to pint glasses and wine glasses, bottles, vessels and the like.

Throughout the day, people who enjoy several beverages, including but not limited to coffee, can be concerned by the residue left by the drink in the receptacle after consumption. When a new beverage is poured into the same receptacle, it is likely a person will want to wash the receptacle before use.

Current methods to remove residues in receptacles include handwashing the vessel with water, which may include the use of a utensil and/or detergent; and placing the vessel in a conventional dishwashing appliance where it will be cleaned once its cycle is initiated.

BRIEF SUMMARY OF THE INVENTION

The present invention provides a novel method to clean the dirtied beverage vessel and a device for use in said method.

In a broad aspect, the present invention provides a device for cleaning a receptacle wherein the device comprises a receiving component for receiving and holding the receptacle and a cleaning component that is extendable into at least a part of the interior of the receptacle when the receptacle is placed on the receiving component.

In another broad aspect, the present invention provides a device for cleaning a receptacle wherein the device comprises a receiving component for receiving and holding the receptacle and a cleaning component that is extendable into at least a part of the interior of the receptacle when the receptacle is placed on the receiving component; wherein the receiving component is capable of rotating the receptacle.

In another broad aspect, the present invention provides a device for cleaning a receptacle wherein the device comprises a receiving component for receiving and holding the receptacle and a cleaning component that is extendable into at least a part of the interior of the receptacle when the receptacle is placed on the receiving component; wherein the receiving component is capable of rotating the receptacle and wherein the cleaning component is in a fixed position; further wherein the receiving component and cleaning component are configured to cause at least all of the interior base of the receptacle to be engageable by the cleaning component, on rotation of the receptacle by the receiving component.

In one aspect, the present invention provides a device for cleaning a receptacle, wherein the device comprises: a receiving component for receiving and holding the receptacle; a nozzle arranged to be directed at an interior of the receptacle when the receptacle is held by the receiving component; a lid for enclosing the receptacle in the receiving component; and a gutter arranged to channel fluid from the lid into the receiving component.

Optionally, the nozzle (80) is capable of delivering a cleaning medium to an interior wall of the receptacle (80) to clean at least a part of the interior wall of the receptacle (80), optionally wherein the cleaning medium comprises steam.

Optionally, the fluid comprises condensation occurring on the lid through use of the device.

Optionally the device comprises a hinge connecting the lid to one or more other components of the device, the hinge enabling the lid to open to provide access to the receiving component; and the gutter comprises a channel formed in the hinge.

Optionally, the lid comprises a lip arranged to direct fluid from the lid into the gutter.

Optionally, the device comprises a drain formed in the receiving component; and the gutter is arranged to channel the fluid towards drain.

In one aspect, the present invention provides a device for cleaning a receptacle, wherein the device comprises: a receiving component for receiving and holding the receptacle; a nozzle arranged to be directed at an interior of the receptacle when the receptacle is held by the receiving component; a lid for enclosing the receptacle in the receiving component; and a control unit that is responsive to user input to operate the device; wherein the control unit is responsive to a first form of user input when the lid is in a closed position to allow the lid to open; and wherein the control unit is responsive a second form of user input to initiate a receptacle washing cycle.

Optionally, the device comprises at least one button and wherein at least one of the first form of user input and second form of user input comprises a button press.

Optionally, the control unit is responsive to the second form of user input when the lid is in an open position to prevent initiation of the receptacle washing cycle; or the device comprises a lid closing mechanism and the control unit is responsive to the second form of user input when the lid in in an open position to close the lid and to initiate the receptacle washing cycle.

Optionally, the device enables a user to access the receiving component and initiate a receptacle washing cycle with two instances of user input.

In one aspect, the present invention provides a device for cleaning a receptacle, wherein the device comprises: a receiving component for receiving and holding the receptacle; a nozzle arranged to be directed at an interior of the receptacle when the receptacle is held by the receiving component; and a lid for enclosing the receptacle in the receiving component; wherein at least a portion of the device is arranged to be mounted on or in a mounting surface such that a surface of the device is substantially flush with the mounting surface on or in which the device is mounted.

Optionally, a top surface of the lid is arranged to be substantially flush with the mounting surface on or in which the device is mounted when the lid is in a closed position.

Optionally, the device provides a fluid path for fluid to flow from the surface and/or the mounting surface into the receiving component optionally wherein the device provides the fluid path for fluid to flow from the surface and/or the mounting surface into the receiving component when the lid is in a closed position.

Optionally, the surface is substantially flush with a surface on or in which the device is mounted.

In one aspect, the present invention provides a device for cleaning a receptacle, wherein the device comprises: a receiving component for receiving and holding the receptacle; a nozzle arranged to be directed at an interior of the receptacle when the receptacle is held by the receiving component; and a lid for enclosing the receptacle in the receiving component; wherein the lid is removable and/or replaceable.

Optionally, the device comprises a mounting assembly comprising one or more lid mounting points for removably securing the lid.

Optionally, a top surface of the device is removable and/or replaceable, optionally wherein the top surface and the lid are independently removable and/or replaceable, the device optionally comprising a mounting assembly comprising one or more top surface mounting points for removably securing the top surface.

In one aspect, the present invention provides a device for cleaning a receptacle, wherein the device comprises: a receiving component for receiving and holding the receptacle; a nozzle arranged to be directed at an interior of the receptacle when the receptacle is held by the receiving component; and a cleaning medium provision apparatus to supply a cleaning medium to the nozzle; wherein the device is arranged as a split system comprising: a head unit that comprises at least the receiving component and the nozzle; and an auxiliary unit comprising at least the cleaning medium provision apparatus.

Optionally, the head unit and the auxiliary unit are connected by one or more conduits, optionally wherein the one or more conduits are arranged to communicate at least one of the cleaning medium, power, control signals, and waste water between the head unit and the auxiliary unit.

Optionally, the head unit is arranged to be mounted on or in a mounting surface.

Optionally, the device comprises a separate housing for at least one of the head unit and the auxiliary unit.

Optionally, the receiving component comprises a first rotating element that is capable of rotating the receptacle; the device comprises a rotation driving component comprising a second rotating element, wherein the rotation driving component is arranged to drive rotation of the second rotating element; and the second rotating element is magnetically coupled to the first rotating element such that rotation of the second rotating element by the rotation driving component drives rotation of the first rotating element.

In one aspect, the present invention provides a device for cleaning a receptacle, wherein the device comprises: a receiving component for receiving and holding the receptacle, wherein the receiving component comprises a first rotating element that is capable of rotating the receptacle; a nozzle arranged to be directed at an interior of the receptacle when the receptacle is held by the receiving component; and a rotation driving component comprising a second rotating element, wherein the rotation driving component is arranged to drive rotation of the second rotating element; wherein the second rotating element is magnetically coupled to the first rotating element such that rotation of the second rotating element by the rotation driving component drives rotation of the first rotating element.

In one aspect, the present invention provides a device for cleaning a receptacle that is at least partly open-ended at one end and having an interior space defined by an interior wall;

wherein the device is capable of cleaning at least a part of the interior wall of the receptacle;

wherein the device comprises:

(a) a receiving component for receiving and holding the receptacle to allow for the cleaning of at least the part of the interior wall of the receptacle, wherein the receiving component comprises a first rotating element that is capable of rotating the receptacle;

(b) a cleaning component that is capable of cleaning at least part of the interior wall of the receptacle interior wherein the cleaning component comprises a cleaning element that is locatable within the interior space of the receptacle when the receptacle is held by the receiving component; and (c) a rotation driving component that is capable of driving rotation of the first rotating element, wherein the rotation driving component comprises a second rotating element;

wherein the cleaning element is capable of delivering a cleaning medium to the interior wall of the receptacle to clean at least a part of the interior wall of the receptacle;

further wherein the first rotating element is coupled to the second rotating element, wherein the second rotating element is configured to cause rotation of the first rotating element on rotation of the second rotating element; and wherein the device has one or more of the following features:

(a) the device comprises a gutter for removal of condensation that may occur through use of the device; and/or (b) the device comprises a control unit that is responsive to user input to operate the device; and/or (c) the device comprises a surface that is substantially flush with a surface on or in which the device is mounted and/or wherein the device comprises a fluid path for removal of fluid during use of after use of the device; and/or (d) the device comprises a lid wherein at least a part of the lid is removable and/or replaceable; and/or (e) at least all or part of the device is contained within at least one housing.

The first rotating element is coupled to the second rotating element. Preferably, this is achieved through attractive physical forces. In a preferred aspect, the coupling is a magnetic coupling.

In one aspect, the first rotating element is coupled to the second rotating element, wherein the second rotating element is configured to cause rotation of the first rotating element on rotation of the second rotating element. In other words, the first rotating element is coupled to the second rotating element such that rotation of the second rotating element is capable of driving rotation of the first rotating element.

In one aspect, the present invention provides a device for cleaning a receptacle that is at least partly open-ended at one end and having an interior space defined by an interior wall;

wherein the device is capable of cleaning at least a part of the interior wall of the receptacle;

wherein the device comprises:

(a) a receiving component for receiving and holding the receptacle to allow for the cleaning of at least the part of the interior wall of the receptacle, wherein the receiving component comprises a first rotating element that is capable of rotating the receptacle;

(b) a cleaning component that is capable of cleaning at least part of the interior wall of the receptacle interior wherein the cleaning component comprises a cleaning element that is locatable within the interior space of the receptacle when the receptacle is held by the receiving component; and (c) a rotation driving component that is capable of driving rotation of the first rotating element, wherein the rotation driving component comprises a second rotating element;

wherein the cleaning element is capable of delivering a cleaning medium to the interior wall of the receptacle to clean at least a part of the interior wall of the receptacle;

further wherein the first rotating element is magnetically coupled to the second rotating element, wherein the second rotating element is configured to cause rotation of the first rotating element on rotation of the second rotating element; and wherein the device has one or more of the following features:

(a) the device comprises a gutter for removal of condensation that may occur through use of the device; and/or (b) the device comprises a control unit that is responsive to user input to operate the device; and/or (c) the device comprises a surface that is substantially flush with a surface on or in which the device is mounted and/or wherein the device comprises a fluid path for removal of fluid during use of after use of the device; and/or (d) the device comprises a lid wherein at least a part of the lid is removable and/or replaceable; and/or (e) at least all or part of the device is contained within at least one housing.

In another aspect, a method of cleaning a receptacle comprising use of the device according to the present invention, the method comprising: receiving the receptacle at the receiving component of the device; rotating, by the rotation driving element, the second rotating element to drive rotation of the first rotating element; and delivering, via the nozzle a cleaning medium to an interior wall of the receptacle to clean at least a part of the interior wall of the receptacle.

In another aspect, the present invention provides a method of cleaning a receptacle that is at least partly open-ended at one end and having an interior space defined by an interior wall comprising use of the device according to the present invention; wherein a receptacle is placed on the receiving component of the device and the cleaning component cleans at least part of the interior wall of the receptacle interior.

In one embodiment of the device of the present invention the receptacle is at least partly open ended at one end and having an interior space defined by an interior wall; wherein the device is capable of cleaning at least a part of the interior wall of the receptacle.

In a further embodiment, the nozzle is locatable within an interior space of the receptacle when the receptacle is held by the receiving component.

In a further embodiment, the nozzle is capable of delivering a cleaning medium to an interior wall of the receptacle to clean at least a part of the interior wall of the receptacle.

In one embodiment of the device of the present invention, the first rotating element comprises one or more magnets and/or the second rotating element comprises one or more magnets, wherein the one or more magnets are configured to cause rotation of the first rotating element on rotation of the second rotating element.

In a further embodiment, the first rotating element comprises one or more magnets, wherein the one or more magnets are configured to cause rotation of the first rotating element on rotation of the second rotating element.

In a further embodiment, the one or more magnets of the first rotating element and the one or more magnets of the second rotating element are arranged coaxially with respect to an axis of rotation of the first rotating component (90).

In a further embodiment, the one or more magnets of the first rotating element and the one or more magnets of the second rotating element are disposed apart from each other in a direction substantially perpendicular to an axis of rotation of the first rotating component (90).

In a further embodiment, the receiving component comprises a support element to support the first rotating element; wherein the support element extends into the receiving component by a distance smaller than a width of the one or more magnets of first rotating component and/or the second rotating component.

In a further embodiment, the height of a coupling region containing the one or more magnets of the first rotating component and the one or more magnets of the second rotating component in a direction parallel to the axis of rotation of the first rotating component (90) is less than the combined height of a magnet of the one or more magnets of the first rotating component and a magnet of the one or more magnets of the second rotating component.

In a further embodiment, the second rotating element comprises one or more magnets, wherein the one or more magnets are configured to cause rotation of the first rotating element on rotation of the second rotating element.

In a further embodiment, the first rotating element comprises one or more magnets and the second rotating element comprises one or more corresponding, reversed polarity magnets, wherein the corresponding, reversed polarity magnets are configured to cause rotation of the first rotating element on rotation of the second rotating element.

In a further embodiment, the first rotating element comprises a plurality of magnets and the second rotating element comprises a plurality of corresponding, reversed polarity magnets, wherein the corresponding, reversed polarity magnets are configured to cause rotation of the first rotating element on rotation of the second rotating element.

In a further embodiment, the magnets are located around the circumference of the first rotating element and/or the magnets are located around the circumference of the second rotating element.

In a further embodiment, the first rotating element and the second rotating element comprise the same number of magnets.

In a further embodiment, the first rotating element comprises two magnets and the second rotating element comprises two corresponding, reversed polarity magnets, wherein the wherein the corresponding, reversed polarity magnets are configured to cause rotation of the first rotating element on rotation of the second rotating element.

In a further embodiment, the first rotating element comprises three magnets and the second rotating element comprises three corresponding, reversed polarity magnets, wherein the corresponding, reversed polarity magnets are configured to cause rotation of the first rotating element on rotation of the second rotating element.

In a further embodiment, the first rotating element comprises four magnets and the second rotating element comprises four corresponding, reversed polarity magnets, wherein the corresponding, reversed polarity magnets are configured to cause rotation of the first rotating element on rotation of the second rotating element.

In a further embodiment, the first rotating element comprises five magnets and the second rotating element comprises five corresponding, reversed polarity magnets, wherein the corresponding, reversed polarity magnets are configured to cause rotation of the first rotating element on rotation of the second rotating element.

In a further embodiment, the first rotating element comprises six magnets and the second rotating element comprises six corresponding, reversed polarity magnets, wherein the corresponding, reversed polarity magnets are configured to cause rotation of the first rotating element on rotation of the second rotating element.

In a further embodiment, the first rotating element comprises more than six magnets and the second rotating element comprises more than six corresponding, reversed polarity magnets, wherein the corresponding, reversed polarity magnets are configured to cause rotation of the first rotating element on rotation of the second rotating element.

In one embodiment of the present invention, obstruction or prevention of the rotation of the first rotating element does not obstruct or prevent rotation of the second rotating element.

In a further embodiment, the first rotating element is capable of disengaging and/or slipping from the second rotating element.

In a further embodiment, the first rotating element disengages and/or slips from the second rotating element when there is a force opposing the rotation of the first rotating element.

In a further embodiment, the first rotating element disengages and/or slips from the second rotating element when there is a force opposing the rotation of the first rotating element that exceeds the force of the coupling between the first rotating element and the second rotating element.

In a further embodiment, the first rotating element disengages and/or slips from the second rotating element when there is a force opposing the rotation of the first rotating element that exceeds the attractive physical force between the first rotating element and the second rotating element.

In a further embodiment, the first rotating element disengages and/or slips from the second rotating element when there is a force opposing the rotation of the first rotating element that exceeds the force of the magnetic coupling between the first rotating element and the second rotating element.

In one embodiment of the device of the present invention, the first rotating element disengages and/or slips from the second rotating element when a force of more than about 5 Newton-centimetres is applied at the pivot point of the first rotating element.

In one embodiment of the device of the present invention, the first rotating element disengages and/or slips from the second rotating element when a force of more than about 10 Newton-centimetres is applied at the pivot point of the first rotating element.

In one embodiment of the device of the present invention, the first rotating element disengages and/or slips from the second rotating element when a force of more than about 30 Newton-centimetres is applied at the pivot point of the first rotating element.

In a preferred embodiment of the device of the present invention, the first rotating element disengages and/or slips from the second rotating element when a force of more than about 50 Newton-centimetres is applied at the pivot point of the first rotating element.

In one embodiment of the device of the present invention, the first rotating element disengages and/or slips from the second rotating element when a force of more than about 100 Newton-centimetres is applied at the pivot point of the first rotating element.

In one embodiment of the device of the present invention, the first rotating element disengages and/or slips from the second rotating element when a force of more than about 200 Newton-centimetres is applied at the pivot point of the first rotating element.

In one embodiment of the device of the present invention, the first rotating element disengages and/or slips from the second rotating element when a force of less than about 3000 Newton-centimetres or more is applied at the pivot point of the first rotating element.

In one embodiment of the device of the present invention, the first rotating element disengages and/or slips from the second rotating element when a force of less than about 1000 Newton-centimetres or more is applied at the pivot point of the first rotating element.

In one embodiment of the device of the present invention, the first rotating element disengages and/or slips from the second rotating element when a force of less than about 500 Newton-centimetres or more is applied at the pivot point of the first rotating element.

In one embodiment of the device of the present invention, the first rotating element disengages and/or slips from the second rotating element when a force of less than about 400 Newton-centimetres or more is applied at the pivot point of the first rotating element.

In a preferred embodiment of the device of the present invention, the first rotating element disengages and/or slips from the second rotating element when a force of less than about 300 Newton-centimetres or more is applied at the pivot point of the first rotating element.

In one embodiment of the device of the present invention, the first rotating element disengages and/or slips from the second rotating element when a force of less than about 200 Newton-centimetres or more is applied at the pivot point of the first rotating element.

In one embodiment of the device of the present invention, the first rotating element disengages and/or slips from the second rotating element when a force of less than about 100 Newton-centimetres or more is applied at the pivot point of the first rotating element.

In one embodiment of the device of the present invention, the first rotating element disengages and/or slips from the second rotating element when a force of about 5 Newton-centimetres to about 3000 Newton-centimetres is applied at the pivot point of the first rotating element.

In one embodiment of the device of the present invention, the first rotating element disengages and/or slips from the second rotating element when a force of about 10 Newton-centimetres to about 1000 Newton-centimetres is applied at the pivot point of the first rotating element.

In one embodiment, the first rotating element disengages and/or slips from the second rotating element when a force of about 30 Newton-centimetres to about 500 Newton-centimetres is applied at the pivot point of the first rotating element.

In a preferred embodiment of the device of the present invention, the first rotating element disengages and/or slips from the second rotating element when a force of about 50 Newton-centimetres to about 300 Newton-centimetres is applied at the pivot point of the first rotating element.

In one embodiment of the device of the present invention, the first rotating element disengages and/or slips from the second rotating element when a force of about 50 Newton-centimetres to about 200 Newton-centimetres is applied at the pivot point of the first rotating element.

In one embodiment of the device of the present invention, the first rotating element disengages and/or slips from the second rotating element when a force of about 50 Newton-centimetres to about 100 Newton-centimetres is applied at the pivot point of the first rotating element.

In one embodiment, the first rotating element disengages and/or slips from the second rotating element when a force of about 100 Newton-centimetres to about 300 Newton-centimetres is applied at the pivot point of the first rotating element.

In one embodiment of the device of the present invention, the first rotating element disengages and/or slips from the second rotating element when a force of about 200 Newton-centimetres to about 300 Newton-centimetres is applied at the pivot point of the first rotating element.

In one embodiment of the device of the present invention, the first rotating element disengages and/or slips from the second rotating element when a force of about 50 Newton-centimetres is applied at the pivot point of the first rotating element.

In one embodiment of the device of the present invention, the first rotating element disengages and/or slips from the second rotating element when a force of about 100 Newton-centimetres is applied at the pivot point of the first rotating element.

In one embodiment of the device of the present invention, the first rotating element disengages and/or slips from the second rotating element when a force of about 200 Newton-centimetres is applied at the pivot point of the first rotating element.

In one embodiment of the device of the present invention, the first rotating element disengages and/or slips from the second rotating element when a force of about 300 Newton-centimetres is applied at the pivot point of the first rotating element.

In a further embodiment the disengaging and/or slipping of the first rotating element from the second rotating element results in the speed of rotation of the first rotating element (measured in revolutions per minute or RPM) falling below the speed of rotation of the second rotating element.

In a further embodiment the disengaging and/or slipping of the first rotating element from the second rotating element results in the first rotating element ceasing to rotate.

In a further embodiment, the first rotating element will re-engage with the second rotating element when the force opposing the rotation of the first rotating element falls below the force of the coupling between the first rotating element and the second rotating element.

In a further embodiment, the first rotating element will re-engage with the second rotating element when the force opposing the rotation of the first rotating element falls below the attractive physical force between the first rotating element and the second rotating element.

In a further embodiment, the first rotating element will re-engage with the second rotating element when the force opposing the rotation of the first rotating element falls below the force of the magnetic coupling between the first rotating element and the second rotating element.

In one embodiment, the device of the present invention does not comprise a mechanical connection between the first rotating element and the second rotating element.

In one embodiment, the device of the present invention does not comprise a mechanical connection between the first rotating element and any other component of the device.

In one embodiment of the device of the present invention, the first rotating element can be removed from the device by overcoming the coupling between the first rotating element and the second rotating element.

In one embodiment of the device of the present invention, the first rotating element can be removed from the device by overcoming the attractive physical force between the first rotating element and the second rotating element.

In one embodiment of the device of the present invention, the first rotating element can be removed from the device by overcoming the magnetic coupling between the first rotating element and the second rotating element.

In one embodiment, the device of the present invention comprises a watertight barrier between the first rotating element and the second rotating element.

In one embodiment of the device of the present invention, the receiving component comprises a basin element that is capable of capturing spent cleaning medium.

In one embodiment of the device of the present invention, the second rotating element is locatable outside of the basin element.

In a further embodiment, at least part of the basin element is locatable between the first rotating element and the second rotating element.

In a further embodiment, the first rotating element is locatable within the basin element.

In a further embodiment of the device of the present invention, the second rotating element is locatable outside of the basin element and the first rotating element is locatable within the basin element.

In one embodiment of the device of the present invention, the cleaning element faces a part of the interior wall of the receptacle.

In a further embodiment, the first rotating element is capable of allowing rotation of the interior wall of the receptacle relative to the cleaning element.

In a further embodiment, the cleaning element is in a fixed position.

In a further embodiment, at least a part of the cleaning component is located within the receiving component.

In a further embodiment, the cleaning element extends beyond the receiving component.

In one embodiment of the device of the present invention, the first rotating element comprises a turntable element that is capable of rotating the receptacle.

In a further embodiment, the cleaning element extends beyond the turntable element.

In one embodiment of the device of the present invention, the rotation driving component comprises a means for driving the rotation of the second rotation element.

In one embodiment of the device of the present invention, the means for driving the rotation of the second rotation element comprises a motor.

In one embodiment, the means for driving the rotation of the second rotation element comprises a motor fitted with a drive gear.

In one embodiment of the device of the present invention, the second rotating element comprises a driven gear.

In a further embodiment, the drive gear is operably connected to the driven gear, wherein the drive gear is configured to cause rotation of the driven gear on rotation of the drive gear.

In a further embodiment, the motor is an electric motor.

In one embodiment, the drive gear has a diameter that is less than the diameter of the second rotating element gear.

In one embodiment of the device of the present invention, the rotation driving component comprises a controller for the motor, wherein the controller allows for the rotational speed of the first rotating element to be altered.

In one embodiment, the receiving component and/or the cleaning component comprises a drain outlet for removal of spent cleaning medium.

In a further embodiment, the receiving component comprises a drain outlet for removal of spent cleaning medium.

In a further embodiment, the drain component comprises a drain outlet for removal of spent cleaning medium.

In a further embodiment, the basin element comprises a drain outlet for removal of spent cleaning medium and the cleaning component comprises a drain closure element.

In one embodiment, the cleaning component of the device of the present invention comprises a cleaning medium preparation element that is operably connected to the cleaning element.

In a further embodiment, the device is capable of cleaning at least all of the interior base of the receptacle.

In a further embodiment, the device is capable of cleaning all of the interior wall of the receptacle.

In a further embodiment, the cleaning element comprises a nozzle through which the cleaning medium passes onto the interior wall of the receptacle.

In a further embodiment, the cleaning medium comprises heated water.

In one embodiment, the cleaning medium comprises steam.

In one embodiment, the device of the present invention further comprises a user interface module to allow a user to use the device.

In a further embodiment, the cleaning component and the receiving component are housed in an integral unit.

In a further embodiment, the cleaning component and the receiving component are housed in an integral unit; and wherein the device further comprises a user interface module to allow a user to use the device; wherein the user interface module is located on one wall of the user interface module.

In one embodiment of the present invention, the user interface module allows for the rotational speed of the first rotating device to be altered.

In a further embodiment, the user interface module allows for different rotational speeds according to a pre-programmed cycle that the user selects.

In one embodiment, the device is capable of cleaning one or more receptacles.

In one embodiment, the device is configured to clean one receptacle at a time.

In one embodiment, the receptacle is open-ended at one end.

In one embodiment, the receptacle is a receptacle for a beverage.

In one embodiment, the receptacle is a receptacle for a coffee beverage.

In one embodiment, the receptacle is cleaned by the device in a period of less than about 30 seconds.

In one embodiment, the receptacle is cleaned by the device in a period of less than about 25 seconds.

In one embodiment, the receptacle is cleaned by the device in a period of less than about 20 seconds.

In one embodiment, the receptacle is cleaned by the device in a period of less than about 15 seconds.

In one embodiment, the receptacle is cleaned by the device in a period of about 10 seconds or less than about 10 seconds.

Depending on the configuration of the receiving component, in use the receptacle is placed over the receiving component or the receiving component enters into the receptacle.

Preferably, the device is configured such that in use the receptacle is placed over the receiving component. This allows for ease of use and allows for easy cleaning of the receptacle and also for easy removal of the spent cleaning medium.

In one embodiment, the device is configured such that in use the receptacle is placed over the first rotating element.

The present invention has a number of advantages. For example, the present invention provides and allows a person to place the dirtied receptacle into the appliance wherein the receptacle is washed in a very short period of time and wherein any residues are removed from the interior and/or the exterior of the receptacle and/or a lid of the receptacle. The receptacle can be washed in a period of time less than about 30 seconds, preferably less than about 25 seconds, preferably less than about 20 seconds, preferably less than about 15 seconds, preferably less than about 10 seconds.

The device of the present invention can wash the interior and/or the exterior of the receptacle and/or a lid of the receptacle more effectively than an equivalent handwashing process.

In a preferred embodiment, the cleaning component provides or delivers steam as the cleaning medium, such as pressurised steam, into the interior and/or a lid of the receptacle of the receptacle and/or a lid of the receptacle. The use of steam is effective in removing residues in the interior and/or the exterior of the receptacle and/or a lid of the receptacle and reduces the prevalence of bacterial growth should the receptacle be the left for an extended period of time following the consumption of a previous beverage.

The device of the present invention can reduce the water consumption of the process when compared to an equivalent wash by hand or even through the use of a dishwasher.

The present invention is particularly useful in an office environment or in a coffee shop environment or in a tea shop environment. More particularly, the present invention is particularly useful in a coffee shop environment or in a tea shop environment whereby store customers may hand over a dirtied receptacle to the store staff. A staff member can make use of the device of the current invention to remove easily and quickly any residues in the interior and/or the exterior of the receptacle and/or a lid of the receptacle while they begin to prepare the beverage. This saves time as the staff member is no longer required to hand wash the receptacle in order to make it clean for serving the fresh beverage.

According to the present invention, the receiving component comprises a first rotating element that is capable of rotating the receptacle. The first rotating element is coupled to the second rotating element. Preferably, this is achieved through attractive physical forces. In a preferred aspect, the coupling is a magnetic coupling. The second rotating element is configured to cause rotation of the first rotating element on rotation of the second rotating element.

Rotation of the first rotating element being driven by coupling, preferably through attractive physical forces and more preferably through a magnetic coupling, to a second rotating element has a number of advantages over use of a traditional mechanical connection, such as a shaft, to drive rotation of the first rotating element. One such advantage is that the present invention has a simplified design and overcomes issues arising from cavities that are associated with such mechanical connections. One such problem is the build-up of washing residue, for example coffee grounds, in the cavities, which can lead to the rotational action mechanical connector becoming obstructed resulting in reliability problems with the device. A further problem associated with cavities is the build-up of organic matter, such as milk residue, that may allow for potentially harmful micro-organisms to populate in the receiving component. Hence the first rotating element being driven by coupling, preferably through attractive physical forces and more preferably through a magnetic coupling, to a second rotating element results in the device having increased reliability and safety in use.

Further, removing the need for a mechanical connection between the first rotating element and the rotation driving component allows for increased ease in manufacture and maintenance of the device. A watertight separation between the rotation driving component and spent cleaning medium is easier to achieve, since there are fewer mechanical connectors required. For the same reason, the watertight seal between the rotation driving component and spent cleaning medium is more reliable.

Rotation of the first rotating element being driven by coupling, preferably through attractive physical forces and more preferably through a magnetic coupling, to a second rotating element, rather than a mechanical connection, also overcomes issues that arise when users drop objects into or onto the receiving component that obstruct the rotation of the first rotating element. In designs wherein the rotation of the first rotating element is driven by mechanical connection, such as a shaft, such obstructions result in damage to the device, in particular to the mechanically coupled component that drives rotation of the first rotating element. This problem is overcome wherein rotation of the first rotating element is driven by coupling, preferably through attractive physical forces and more preferably through a magnetic coupling, since the first rotating element is able to disengage and/or slip, whilst allowing the coupled second rotating element to continue rotating as normal. Therefore, any obstruction to the first rotating element will not result in sudden strain or damage to the component that drives the rotation of the first rotating element.

A further advantage of the present invention and the potential for the first rotating element to disengage and/or slip from the second rotating element when there is a force opposing the rotation of the first rotating element is that it makes the device safer to use. For instance, if a user were to insert their hand into the device and contact the first rotating element, the rotation of the first rotating element would slow or cease. Thus, the present invention is less likely to cause injury to users and has improved safety.

Further advantages of rotation of the first rotating element being driven by coupling, preferably through attractive physical forces and more preferably through a magnetic coupling, to a second rotating element, rather than a mechanical connection, include increased ease in maintenance of the device. For instance, the connection between the first rotating element and the second rotating element being a magnetic, rather than a mechanical connection, means that the first rotating element can be removed with increased ease, for instance during cleaning or routine maintenance.

To implement the magnetic coupling, both the first rotating element and the second rotating element may be provided with a respective set of one or more magnets. In some examples, the two sets of magnets are arranged in a 'face-to-face' arrangement, where the sets of magnets are offset in a vertical direction (i.e., a direction parallel to the axis of rotation of the first rotating element).

In some examples however, a coaxial arrangement of the one or more magnets in the first rotating element and the one or more magnets in the second rotating element is used. According to such an arrangement, the magnets of the first rotating element and the magnets of the second rotating element are arranged coaxially with respect to the axis of rotation of the first rotating component. For example, magnets may be arranged around (or in the vicinity of) the edge (e.g., circumference) of the first rotating element. The corresponding set of reversed polarity magnets may be positioned in the second rotating element at a slightly larger radial displacement from the axis of rotation.

By employing this coaxial arrangement, it may be possible to make the device more compact. Specifically, a vertical height (in the direction of the axis of rotation) of the wash chamber can be reduced since the two sets of magnets are arranged in substantially the same horizontal plane. Accordingly, a height of the coupling region in which the set of magnets forming the magnetic coupling are placed can be reduced as compared with, for example, the face-to-face arrangement mentioned above whereby one set of magnets is positioned below the other.

Additionally, or alternatively, the coaxial arrangement for the magnetic coupling can lead to improved efficiency of the rotation mechanism. With the face-to-face arrangement for example, the magnetic force between the two sets of magnets acts in a vertical direction, thereby increasing a vertical component of the force exerted by the first rotating component on other components of the device (and correspondingly by those other components on the first rotating component). This consequently increases the friction experienced by the first rotating element that acts to restrict its rotation. By adopting the coaxial arrangement, the vertical component of the force between the first rotating component and surrounding components in the device can be reduced leading to reduced friction restraining the motion of the first rotating device. Thus the mechanism can be made more efficient, allowing less motor power to be used to drive rotation of the first rotating element for a given amount of torque.

Even further, the coaxial arrangement described herein allows the first rotating element to have a smaller contact area with a support element (e.g., the floor/shelf of the wash basin). With the magnets arranged coaxially, the support element provided to support the first rotating element within the receiving component does not need to support magnets arranged above and below the support element and so does not need to extend so far in the wash basin. For example the support element may extend into the receiving component in which the receptacle is placed by a distance smaller than a width of the magnets used in the first rotating element and/or the second rotation element. This arrangement can therefore provide improved drainage from the wash basin and reduce the risk of blockages.

The device can receive one or a plurality of receptacles. If the device is capable of receiving a plurality of receptacles then the device may comprise a further rotating platform wherein the platform comprises discrete receiving components for the receptacles. In one preferred aspect, the device is to receive one receptacle at a time.

Examples of receptacles include drinking receptacles, such as cups, beakers, mugs and the like. The receptacle may be of any suitable material, such as china, porcelain, ceramics, plastics etc. Preferably, the receptacle is made from a plastics material. In one aspect, the receptacle is a re-usable coffee cup, in particular a re-usable coffee cup made from a plastic material or glass.

As mentioned above, the device of the present invention enables a user to remove effectively residue from said receptacle and to clean the interior and/or the exterior of the receptacle and/or a lid of the receptacle in a short period of time and preferably in a shorter period of time such as with hand washing.

In accordance with the present invention, the device has one or more of the following features:

(a) the device comprises a gutter for removal of condensation that may occur through use of the device; and/or
(b) the device comprises a control unit that is responsive to user input to operate the device; and/or
(c) the device comprises a surface that is substantially flush with a surface on or in which the device is mounted and/or wherein the device comprises a fluid path for removal of fluid during use of after use of the device; and/or
(d) the device comprises a lid wherein at least a part of the lid is removable and/or replaceable; and/or
(e) at least all or part of the device is contained within at least one housing.

In one aspect, the device comprises a gutter for removal of condensation that may occur through use of the device.

In this respect, preferably, the receiving component comprises a lid assembly, the lid assembly comprising a top cover and a hinge assembly, the hinge assembly configured to enable motion of the top cover between a closed position for enclosing the receptacle in the receiving component and an open position for providing access to the receiving component; and wherein the hinge assembly is formed in a gutter shape to direct fluid flow from the top cover to the receptacle when the top cover is in the open position.

Preferably wherein the top cover comprises a lip to direct fluid to towards the hinge assembly.

Preferably wherein the gutter shape extends from a lowermost point of the top cover when the top cover is in the open position.

Preferably at least a part of the top cover is removable and/or replaceable.

Preferably at least a part of the top cover is made from glass, preferably tempered glass.

In one aspect, the device comprises a control unit that is responsive to user input to operate the device.

In this respect, preferably, the receiving component comprises a lid assembly movable between at least an open configuration and a closed configuration;

wherein the device comprises a control unit and at least one interactive element configured to receive user input;

wherein the control unit is responsive to user input via the at least one interactive element when in an initial standby state in which the lid assembly is in the closed configuration to move the lid assembly to the open configuration and to adopt a primed state; and wherein the control unit is responsive to user input via the at least one interactive element when in the primed state and the lid assembly is in the closed configuration to begin a receptacle washing cycle.

Preferably the interactive element is a button.

Preferably the control unit is responsive to the user input via the at least one interactive element when in the primed state and the lid assembly is in the closed configuration to lock the lid assembly in the closed configuration before beginning the receptacle washing cycle.

In one aspect, the device comprises a surface that is substantially flush with a surface on or in which the device is mounted and/or wherein the device comprises a fluid path for removal of fluid during use of after use of the device.

In this respect, preferably, the device comprises a mounting assembly configured to enable mounting of the device in a cut-out within a surface;

wherein the receiving component comprises a lid assembly that is movable between at least an open configuration and a closed configuration;

wherein the mounting assembly and the lid assembly are configured such that when the device is mounted in the cut-out within the surface and the lid assembly is in the closed configuration, the lid assembly is substantially flush with the surface.

Preferably wherein the lid assembly is configured to provide, when the lid assembly is in the closed configuration, a fluid path into the receiving component.

Preferably wherein the fluid path enables fluid on the surface to flow into the receiving component when the device is mounted in the cut-out within the surface.

In one aspect, the device comprises a lid wherein at least a part of the lid is removable and/or replaceable.

In this respect, preferably, the device comprises a top portion;

wherein the receiving component comprises a lid assembly movable between an open configuration and a closed configuration;

wherein the lid assembly is configured to close an opening in the top portion when in the closed configuration; and wherein the lid assembly is removably connected to connecting portion of the receiving component and/or the top portion is removably connected to a connecting portion of the device.

Preferably wherein at least one of the lid assembly and the top portion are independently replaceable.

Preferably wherein all or a part of the lid is glass.

Preferably wherein all or part of the lid is tempered glass.

In one aspect, at least all or part of the device is contained within at least one housing.

In this respect, preferably the device further comprises a steam generating element; and wherein the device comprises a first housing to house at least the receiving component, the nozzle, and the first rotating element and a second housing to house at least the steam generating element.

Preferably wherein the first housing comprises a mounting assembly to enable mounting of the first housing in a cut-out in a surface.

Preferably wherein the device further comprises one or more conduits between the first housing and the second housing.

Broad aspects of the present invention will now be described by the following sets of numbered embodiments.

1. A device (200) for cleaning a receptacle (80), wherein the device (200) comprises:
   a receiving component for receiving and holding the receptacle (80);
   a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;
   a lid (550) for enclosing the receptacle in the receiving component; and
   a gutter arranged to channel fluid from the lid into the receiving component.
2. A device (200) for cleaning a receptacle (80), wherein the device (200) comprises:
   a receiving component for receiving and holding the receptacle (80);
   a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;

a lid (550) for enclosing the receptacle in the receiving component; and a control unit that is responsive to user input to operate the device;

wherein the control unit is responsive to a first form of user input when the lid is in a closed position to allow the lid to open;

wherein the control unit is responsive a second form of user input to initiate a receptacle washing cycle;

wherein the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle.

3. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;

a lid (550) for enclosing the receptacle in the receiving component;

a gutter arranged to channel fluid from the lid into the receiving component; and a control unit that is responsive to user input to operate the device;

wherein the control unit is responsive to a first form of user input when the lid is in a closed position to allow the lid to open;

wherein the control unit is responsive a second form of user input to initiate a receptacle washing cycle;

wherein the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle; and wherein the device comprises a hinge connecting the lid to one or more other components of the device, the hinge enabling the lid to open to provide access to the receiving component; and optionally whrein the gutter comprises a channel formed in the hinge.

4. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;

a lid (550) for enclosing the receptacle in the receiving component;

a gutter arranged to channel fluid from the lid into the receiving component; and a control unit that is responsive to user input to operate the device;

wherein the control unit is responsive to a first form of user input when the lid is in a closed position to allow the lid to open;

wherein the control unit is responsive a second form of user input to initiate a receptacle washing cycle;

wherein the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle; and wherein the device comprises a hinge connecting the lid to one or more other components of the device, the hinge enabling the lid to open to provide access to the receiving component; and the gutter comprises a channel formed in the hinge.

5. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and a cleaning medium provision apparatus to supply a cleaning medium to the nozzle;

wherein the device is arranged as a split system comprising:

a head unit that comprises at least the receiving component and the nozzle; and an auxiliary unit comprising at least the cleaning medium provision apparatus.

6. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;

a gutter arranged to channel fluid from the lid into the receiving component; and a cleaning medium provision apparatus to supply a cleaning medium to the nozzle;

wherein the device is arranged as a split system comprising:

a head unit that comprises at least the receiving component and the nozzle; and an auxiliary unit comprising at least the cleaning medium provision apparatus;

wherein the device comprises a hinge connecting the lid to one or more other components of the device, the hinge enabling the lid to open to provide access to the receiving component; and optionally wherein the gutter comprises a channel formed in the hinge.

7. A device (200) for cleaning a receptacle (80), wherein the device (200) comprises:
   a receiving component for receiving and holding the receptacle (80);
   a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;
   a gutter arranged to channel fluid from the lid into the receiving component; and
   a cleaning medium provision apparatus to supply a cleaning medium to the nozzle;
   wherein the device is arranged as a split system comprising:
      a head unit that comprises at least the receiving component and the nozzle; and
      an auxiliary unit comprising at least the cleaning medium provision apparatus;
   wherein the device comprises a hinge connecting the lid to one or more other components of the device, the hinge enabling the lid to open to provide access to the receiving component; and the gutter comprises a channel formed in the hinge.
8. A device (200) for cleaning a receptacle (80), wherein the device (200) comprises:
   a receiving component for receiving and holding the receptacle (80);
   a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and
   a lid (550) for enclosing the receptacle in the receiving component;
   wherein at least a portion of the device is arranged to be mounted on or in a mounting surface such that a surface of the device is substantially flush with the mounting surface on or in which the device is mounted; and
   wherein a top surface of the lid is arranged to be substantially flush with the mounting surface on or in which the device is mounted when the lid is in a closed position.
9. A device (200) for cleaning a receptacle (80), wherein the device (200) comprises:
   a receiving component for receiving and holding the receptacle (80);
   a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;
   a lid (550) for enclosing the receptacle in the receiving component; and
   a gutter arranged to channel fluid from the lid into the receiving component;
   wherein at least a portion of the device is arranged to be mounted on or in a mounting surface such that a surface of the device is substantially flush with the mounting surface on or in which the device is mounted;
   wherein a top surface of the lid is arranged to be substantially flush with the mounting surface on or in which the device is mounted when the lid is in a closed position;
   wherein the device comprises a hinge connecting the lid to one or more other components of the device, the hinge enabling the lid to open to provide access to the receiving component; and optionally wherein the gutter comprises a channel formed in the hinge.
10. A device (200) for cleaning a receptacle (80), wherein the device (200) comprises:
   a receiving component for receiving and holding the receptacle (80);
   a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;
   a lid (550) for enclosing the receptacle in the receiving component; and
   a gutter arranged to channel fluid from the lid into the receiving component;
   wherein at least a portion of the device is arranged to be mounted on or in a mounting surface such that a surface of the device is substantially flush with the mounting surface on or in which the device is mounted;
   wherein a top surface of the lid is arranged to be substantially flush with the mounting surface on or in which the device is mounted when the lid is in a closed position;
   wherein the device comprises a hinge connecting the lid to one or more other components of the device, the hinge enabling the lid to open to provide access to the receiving component; and the gutter comprises a channel formed in the hinge.
11. A device (200) for cleaning a receptacle (80), wherein the device (200) comprises:
   a receiving component for receiving and holding the receptacle (80);
   a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;
   a lid (550) for enclosing the receptacle in the receiving component; and
   a control unit that is responsive to user input to operate the device;
   wherein the control unit is responsive to a first form of user input when the lid is in a closed position to allow the lid to open;
   wherein the control unit is responsive a second form of user input to initiate a receptacle washing cycle;
   wherein the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle; and
   wherein the device comprises:
   a cleaning medium provision apparatus to supply a cleaning medium to the nozzle;

wherein the device is arranged as a split system comprising:

a head unit that comprises at least the receiving component and the nozzle; and an auxiliary unit comprising at least the cleaning medium provision apparatus.

12. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;

a lid (550) for enclosing the receptacle in the receiving component;

a gutter arranged to channel fluid from the lid into the receiving component; and a control unit that is responsive to user input to operate the device;

wherein the control unit is responsive to a first form of user input when the lid is in a closed position to allow the lid to open;

wherein the control unit is responsive a second form of user input to initiate a receptacle washing cycle;

wherein the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle; and wherein the device comprises:

a cleaning medium provision apparatus to supply a cleaning medium to the nozzle;

wherein the device is arranged as a split system comprising:

a head unit that comprises at least the receiving component and the nozzle; and an auxiliary unit comprising at least the cleaning medium provision apparatus; and wherein the device comprises a hinge connecting the lid to one or more other components of the device, the hinge enabling the lid to open to provide access to the receiving component; and optionally wherein the gutter comprises a channel formed in the hinge.

13. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;

a lid (550) for enclosing the receptacle in the receiving component;

a gutter arranged to channel fluid from the lid into the receiving component; and a control unit that is responsive to user input to operate the device;

wherein the control unit is responsive to a first form of user input when the lid is in a closed position to allow the lid to open;

wherein the control unit is responsive a second form of user input to initiate a receptacle washing cycle;

wherein the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle; and wherein the device comprises:

a cleaning medium provision apparatus to supply a cleaning medium to the nozzle;

wherein the device is arranged as a split system comprising:

a head unit that comprises at least the receiving component and the nozzle; and an auxiliary unit comprising at least the cleaning medium provision apparatus; and wherein the device comprises a hinge connecting the lid to one or more other components of the device, the hinge enabling the lid to open to provide access to the receiving component; and the gutter comprises a channel formed in the hinge.

14. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;

a lid (550) for enclosing the receptacle in the receiving component; and a control unit that is responsive to user input to operate the device;

wherein the control unit is responsive to a first form of user input when the lid is in a closed position to allow the lid to open;

wherein the control unit is responsive a second form of user input to initiate a receptacle washing cycle;

wherein the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle;

wherein at least a portion of the device is arranged to be mounted on or in a mounting surface such that a surface of the device is substantially flush with the mounting surface on or in which the device is mounted;

wherein a top surface of the lid is arranged to be substantially flush with the mounting surface on or in which the device is mounted when the lid is in a closed position.

15. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;

a lid (550) for enclosing the receptacle in the receiving component;

a gutter arranged to channel fluid from the lid into the receiving component; and a control unit that is responsive to user input to operate the device;

wherein the control unit is responsive to a first form of user input when the lid is in a closed position to allow the lid to open;

wherein the control unit is responsive a second form of user input to initiate a receptacle washing cycle;

wherein the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle;

wherein at least a portion of the device is arranged to be mounted on or in a mounting surface such that a surface of the device is substantially flush with the mounting surface on or in which the device is mounted;

wherein a top surface of the lid is arranged to be substantially flush with the mounting surface on or in which the device is mounted when the lid is in a closed position; and wherein the device comprises a hinge connecting the lid to one or more other components of the device, the hinge enabling the lid to open to provide access to the receiving component; and optionally wherein the gutter comprises a channel formed in the hinge.

16. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;

a lid (550) for enclosing the receptacle in the receiving component;

a gutter arranged to channel fluid from the lid into the receiving component; and a control unit that is responsive to user input to operate the device;

wherein the control unit is responsive to a first form of user input when the lid is in a closed position to allow the lid to open;

wherein the control unit is responsive a second form of user input to initiate a receptacle washing cycle;

wherein the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle;

wherein at least a portion of the device is arranged to be mounted on or in a mounting surface such that a surface of the device is substantially flush with the mounting surface on or in which the device is mounted;

wherein a top surface of the lid is arranged to be substantially flush with the mounting surface on or in which the device is mounted when the lid is in a closed position; and wherein the device comprises a hinge connecting the lid to one or more other components of the device, the hinge enabling the lid to open to provide access to the receiving component; and the gutter comprises a channel formed in the hinge.

17. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and a cleaning medium provision apparatus to supply a cleaning medium to the nozzle;

wherein the device is arranged as a split system comprising:

a head unit that comprises at least the receiving component and the nozzle; and an auxiliary unit comprising at least the cleaning medium provision apparatus;

wherein the device comprises a lid (550) for enclosing the receptacle in the receiving component;

wherein at least a portion of the device is arranged to be mounted on or in a mounting surface such that a surface of the device is substantially flush with the mounting surface on or in which the device is mounted; and wherein a top surface of the lid is arranged to be substantially flush with the mounting surface on or in which the device is mounted when the lid is in a closed position.

18. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;

a gutter arranged to channel fluid from the lid into the receiving component; and a cleaning medium provision apparatus to supply a cleaning medium to the nozzle;

wherein the device is arranged as a split system comprising:

a head unit that comprises at least the receiving component and the nozzle; and an auxiliary unit comprising at least the cleaning medium provision apparatus;

wherein the device comprises a lid (550) for enclosing the receptacle in the receiving component;

wherein at least a portion of the device is arranged to be mounted on or in a mounting surface such that a surface of the device is substantially flush with the mounting surface on or in which the device is mounted;

wherein a top surface of the lid is arranged to be substantially flush with the mounting surface on or in which the device is mounted when the lid is in a closed position;

wherein the device comprises a hinge connecting the lid to one or more other components of the device, the hinge enabling the lid to open to provide access to the receiving component; and optionally wherein the gutter comprises a channel formed in the hinge.

19. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;

a gutter arranged to channel fluid from the lid into the receiving component; and a cleaning medium provision apparatus to supply a cleaning medium to the nozzle;

wherein the device is arranged as a split system comprising:

a head unit that comprises at least the receiving component and the nozzle; and an auxiliary unit comprising at least the cleaning medium provision apparatus;

wherein the device comprises a lid (550) for enclosing the receptacle in the receiving component;

wherein at least a portion of the device is arranged to be mounted on or in a mounting surface such that a surface of the device is substantially flush with the mounting surface on or in which the device is mounted;

wherein a top surface of the lid is arranged to be substantially flush with the mounting surface on or in which the device is mounted when the lid is in a closed position;

wherein the device comprises a hinge connecting the lid to one or more other components of the device, the hinge enabling the lid to open to provide access to the receiving component; and the gutter comprises a channel formed in the hinge.

20. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;

a lid (550) for enclosing the receptacle in the receiving component; and a control unit that is responsive to user input to operate the device;

wherein the control unit is responsive to a first form of user input when the lid is in a closed position to allow the lid to open;

wherein the control unit is responsive a second form of user input to initiate a receptacle washing cycle;

wherein the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle;

wherein the device comprises:

a cleaning medium provision apparatus to supply a cleaning medium to the nozzle;

wherein the device is arranged as a split system comprising:

a head unit that comprises at least the receiving component and the nozzle; and an auxiliary unit comprising at least the cleaning medium provision apparatus;

wherein the device comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and a lid (550) for enclosing the receptacle in the receiving component;

wherein at least a portion of the device is arranged to be mounted on or in a mounting surface such that a surface of the device is substantially flush with the mounting surface on or in which the device is mounted;

wherein a top surface of the lid is arranged to be substantially flush with the mounting surface on or in which the device is mounted when the lid is in a closed position.

21. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;

a gutter arranged to channel fluid from the lid into the receiving component;

a lid (550) for enclosing the receptacle in the receiving component; and a control unit that is responsive to user input to operate the device;

wherein the control unit is responsive to a first form of user input when the lid is in a closed position to allow the lid to open;

wherein the control unit is responsive a second form of user input to initiate a receptacle washing cycle;

wherein the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle;

wherein the device comprises:

a cleaning medium provision apparatus to supply a cleaning medium to the nozzle;

wherein the device is arranged as a split system comprising:

a head unit that comprises at least the receiving component and the nozzle; and an auxiliary unit comprising at least the cleaning medium provision apparatus;

wherein the device comprises:

a lid (550) for enclosing the receptacle in the receiving component;

wherein at least a portion of the device is arranged to be mounted on or in a mounting surface such that a surface of the device is substantially flush with the mounting surface on or in which the device is mounted;

wherein a top surface of the lid is arranged to be substantially flush with the mounting surface on or in which the device is mounted when the lid is in a closed position;

wherein the device comprises a hinge connecting the lid to one or more other components of the device, the hinge enabling the lid to open to provide access to the receiving component; and optionally wherein the gutter comprises a channel formed in the hinge.

22. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;

a gutter arranged to channel fluid from the lid into the receiving component;

a lid (550) for enclosing the receptacle in the receiving component; and a control unit that is responsive to user input to operate the device;

wherein the control unit is responsive to a first form of user input when the lid is in a closed position to allow the lid to open;

wherein the control unit is responsive a second form of user input to initiate a receptacle washing cycle;

wherein the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle;

wherein the device comprises:

a cleaning medium provision apparatus to supply a cleaning medium to the nozzle;

wherein the device is arranged as a split system comprising:

a head unit that comprises at least the receiving component and the nozzle; and an auxiliary unit comprising at least the cleaning medium provision apparatus; wherein the device comprises:

a lid (550) for enclosing the receptacle in the receiving component;

wherein at least a portion of the device is arranged to be mounted on or in a mounting surface such that a surface of the device is substantially flush with the mounting surface on or in which the device is mounted;

wherein a top surface of the lid is arranged to be substantially flush with the mounting surface on or in which the device is mounted when the lid is in a closed position;

wherein the device comprises a hinge connecting the lid to one or more other components of the device, the hinge enabling the lid to open to provide access to the receiving component; and the gutter comprises a channel formed in the hinge.

23. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and a second nozzle for cleaning at least a part (such all or substantially all) of the exterior of the receptacle (80), optionally wherein the cleaning medium comprises steam.

24. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and wherein the receptacle comprises a base portion and a lid portion, wherein the receiving component comprises a first portion for receiving and holding the base portion and a second portion for receiving and holding the lid portion.

25. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and wherein the cleaning medium provision apparatus comprises a steam generation apparatus and one or more tanks.

26. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and wherein the device comprises a cleaning medium provision apparatus to supply a cleaning medium to the nozzle; wherein the device comprises a head unit that comprises at least the receiving component and the nozzle and an auxiliary unit comprising at least the cleaning medium provision apparatus; wherein the cleaning medium provision apparatus is moveable from a first position within the auxiliary unit to a second position outside the auxiliary unit.

The present invention also includes a method of cleaning a receptacle comprising use of the device (200) according to any one of the preceding embodiments, the method comprising:

receiving the receptacle (80) at the receiving component of the device (200); and delivering, via the nozzle (110) a cleaning medium to an interior wall of the receptacle (80) to clean at least a part of the interior wall of the receptacle (80).

The present invention also includes a method of cleaning a receptacle (80) that is at least partly open-ended at one end (81) and having an interior space (82) defined by an interior wall (83) comprising use of the device according to any one of the preceding embodiments; wherein a receptacle (80) is placed on the receiving component of the device and the cleaning component cleans at least part of the interior wall (83) of the receptacle interior (82).

Some preferred features of the present invention will now be described. These preferred features relate inter alia to the numbered embodiments presented above.

Preferably, the device comprises a lid for enclosing the receptacle in the receiving component.

Preferably, the device comprises a gutter arranged to channel fluid from the lid into the receiving component.

Preferably, the nozzle is capable of delivering a cleaning medium to an interior wall of the receptacle to clean at least a part of the interior wall of the receptacle, optionally wherein the cleaning medium comprises steam.

Preferably, the fluid comprises condensation occurring on the lid through use of the device.

Preferably, the device comprises a hinge connecting the lid to one or more other components of the device, the hinge enabling the lid to open to provide access to the receiving component.

Preferably, the gutter comprises a channel formed in the hinge.

Preferably, the device comprises a hinge connecting the lid to one or more other components of the device, the hinge enabling the lid to open to provide access to the receiving component; and the gutter comprises a channel formed in the hinge.

Preferably, the lid comprises a lip arranged to direct fluid from the lid into the gutter.

Preferably, the device comprises a drain formed in the receiving component.

Preferably, the gutter is arranged to channel the fluid towards drain.

Preferably, the device comprises a drain formed in the receiving component and the gutter is arranged to channel the fluid towards drain.

Preferably, the device comprises: a control unit that is responsive to user input to operate the device; wherein the control unit is responsive to a first form of user input when the lid is in a closed position to allow the lid to open Preferably, the device comprises: a control unit that is responsive to user input to operate the device; wherein the control unit is responsive to a first form of user input when the lid is in a closed position to allow the lid to open; and wherein the control unit is responsive a second form of user input to initiate a receptacle washing cycle.

Preferably, the device comprises at least one button and wherein at least one of the first form of user input and second form of user input comprises a button press.

Preferably, the control unit is responsive to the second form of user input when the lid is in an open position to prevent initiation of the receptacle washing cycle.

Preferably, the device comprises a lid closing mechanism and the control unit is responsive to the second form of user input when the lid in in an open position to close the lid and to initiate the receptacle washing cycle.

Preferably, the device enables a user to access the receiving component and initiate a receptacle washing cycle with two instances of user input.

Preferably, at least a portion of the device is arranged to be mounted on or in a mounting surface such that a surface of the device is substantially flush with the mounting surface on or in which the device is mounted.

Preferably, a top surface of the lid is arranged to be substantially flush with the mounting surface on or in which the device is mounted when the lid is in a closed position.

Preferably, the device provides a fluid path for fluid to flow from the surface and/or the mounting surface into the receiving component optionally wherein the device provides the fluid path for fluid to flow from the surface and/or the mounting surface into the receiving component when the lid is in a closed position.

Preferably, the surface is substantially flush with a surface on or in which the device is mounted.

Preferably, the lid is removable and/or replaceable.

Preferably, the device comprises a mounting assembly comprising one or more lid mounting points for removably securing the lid.

Preferably, a top surface of the device is removable and/or replaceable, optionally wherein the top surface and the lid are independently removable and/or replaceable, the device optionally comprising a mounting assembly comprising one or more top surface mounting points for removably securing the top surface.

Preferably, the device comprises a cleaning medium provision apparatus to supply a cleaning medium to the nozzle.

Preferably, the device comprises a cleaning medium provision apparatus to supply a cleaning medium to the nozzle; wherein the device is arranged as a split system comprising: a head unit that comprises at least the receiving component and the nozzle; and an auxiliary unit comprising at least the cleaning medium provision apparatus.

Preferably, the head unit and the auxiliary unit are connected by one or more conduits, optionally wherein the one or more conduits are arranged to communicate at least one of the cleaning medium, power, control signals, and waste water between the head unit and the auxiliary unit.

Preferably, the head unit is arranged to be mounted on or in a mounting surface.

Preferably, the device comprises a separate housing for at least one of the head unit and the auxiliary unit.

Preferably, the receiving component comprises a first rotating element (80) that is capable of rotating the receptacle (80).

Preferably, the receiving component comprises a first rotating element (80) that is capable of rotating the receptacle (80); the device comprises a rotation driving component (400) comprising a second rotating element (130), wherein the rotation driving component (400) is arranged to drive rotation of the second rotating element (130); and the second rotating element (130) is magnetically coupled to the first rotating element (90) such that rotation of the second rotating element (130) by the rotation driving component (400) drives rotation of the first rotating element (90).

Preferably, the device has one or more of the following features:

(a) the device comprises a gutter for removal of condensation that may occur through use of the device; and/or (b) the device comprises a control unit that is responsive to user input to operate the device; and/or (c) the device comprises a surface that is substantially flush with a surface on or in which the device is mounted and/or wherein the device comprises a fluid path for removal of fluid during use of after use of the device; and/or (d) the device comprises a lid wherein at least a part of the lid is removable and/or replaceable; and/or (e) at least all or part of the device is contained within at least one housing.

Preferably, the device additionally comprises a second nozzle for cleaning at least a part (such all or substantially all) of the exterior of the receptacle (80), optionally wherein the cleaning medium comprises steam. In this way, the exterior of the receptacle can be cleaned in addition to the interior.

Preferably, the receptacle comprises a base portion and a lid portion, wherein the receiving component comprises a first portion for receiving and holding the base portion and a second portion for receiving and holding the lid portion. In this way, the lid portion of the receptacle which the user may drink from can also be cleaned.

Preferably, the receptacle comprises a base portion and a lid portion, wherein the receiving component comprises a first portion for receiving and holding the base portion and a second portion for receiving and holding the lid portion and the device additionally comprises a third nozzle for cleaning at least a part (such all or substantially all) of the lid portion of the receptacle (80), optionally wherein the cleaning medium comprises steam.

Preferably, the device additionally comprises a hinge connecting the lid to one or more other components of the device, the hinge enabling the lid to open to provide access to the receiving component; and the gutter comprises a channel formed in the hinge; and wherein the hinge is moveable between a first, open position and a second, closed position, wherein the receptacle comprises a base portion and a lid portion, wherein the receiving component comprises a first portion for receiving and holding the base portion and a second portion for receiving and holding the lid portion, wherein the second portion of the receiving component is, in use, located below the hinge in the second position.

Preferably, the cleaning medium provision apparatus comprises a steam generation apparatus and one or more tanks.

Preferably, the device comprises a cleaning medium provision apparatus to supply a cleaning medium to the nozzle; wherein the device comprises a head unit that comprises at least the receiving component and the nozzle and an auxiliary unit comprising at least the cleaning medium provision apparatus; wherein the cleaning medium provision apparatus is moveable from a first position within the auxiliary unit to a second position outside the auxiliary unit.

The following text provides a series of sets of numbered paragraphs that present aspects of the present invention. The sets of numbered paragraphs are not mutually exclusive and features from any one set are also applicable to any of the other sets. Simply for convenience, the series of sets of numbered paragraphs have been numbered.

The following set (1) of numbered paragraphs presents aspects of the present invention.

1. A device (200) for cleaning a receptacle (80), wherein the device (200) comprises:
   a receiving component for receiving and holding the receptacle (80);
   a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;
   a lid (550) for enclosing the receptacle in the receiving component; and
   a gutter arranged to channel fluid from the lid into the receiving component.
2. The device according to paragraph 1, wherein the nozzle (80) is capable of delivering a cleaning medium to an interior wall of the receptacle (80) to clean at least a part of the interior wall of the receptacle (80), optionally wherein the cleaning medium comprises steam.
3. The device according to paragraph 1 or paragraph 2, wherein the fluid comprises condensation occurring on the lid through use of the device.
4. The device according to any preceding paragraph, wherein:
   the device comprises a hinge connecting the lid to one or more other components of the device, the hinge enabling the lid to open to provide access to the receiving component; and
   the gutter comprises a channel formed in the hinge.
5. The device according to any preceding paragraph, wherein the lid comprises a lip arranged to direct fluid from the lid into the gutter.
6. The device according to any preceding paragraph, wherein:
   the device comprises a drain formed in the receiving component; and
   the gutter is arranged to channel the fluid towards drain.
7. A device according to any preceding paragraph wherein the device comprises:
   a receiving component for receiving and holding the receptacle (80);
   a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component;
   a lid (550) for enclosing the receptacle in the receiving component; and
   a control unit that is responsive to user input to operate the device;
   wherein the control unit is responsive to a first form of user input when the lid is in a closed position to allow the lid to open; and
   wherein the control unit is responsive a second form of user input to initiate a receptacle washing cycle.
8. The device according to paragraph 7, the device comprising at least one button and wherein at least one of the first form of user input and second form of user input comprises a button press.

9. The device according to paragraph 7 or paragraph 8, wherein:
   the control unit is responsive to the second form of user input when the lid is in an open position to prevent initiation of the receptacle washing cycle, or
   the device comprises a lid closing mechanism and the control unit is responsive to the second form of user input when the lid in in an open position to close the lid and to initiate the receptacle washing cycle.
10. The device according to any of paragraphs 7-9, wherein the device enables a user to access the receiving component and initiate a receptacle washing cycle with two instances of user input.
11. A device according to any preceding paragraph wherein the device comprises:
   a receiving component for receiving and holding the receptacle (80);
   a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and
   a lid (550) for enclosing the receptacle in the receiving component;
   wherein at least a portion of the device is arranged to be mounted on or in a mounting surface such that a surface of the device is substantially flush with the mounting surface on or in which the device is mounted.
12. The device according to paragraph 11, wherein a top surface of the lid is arranged to be substantially flush with the mounting surface on or in which the device is mounted when the lid is in a closed position.
13. The device according to paragraph 11 or paragraph 12, wherein the device provides a fluid path for fluid to flow from the surface and/or the mounting surface into the receiving component optionally wherein the device provides the fluid path for fluid to flow from the surface and/or the mounting surface into the receiving component when the lid is in a closed position.
14. The device according to any of paragraphs 11-13, wherein the surface is substantially flush with a surface on or in which the device is mounted.
15. A device according to any preceding paragraph wherein the device comprises:
   a receiving component for receiving and holding the receptacle (80);
   a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and
   a lid (550) for enclosing the receptacle in the receiving component;
   wherein the lid is removable and/or replaceable.
16. The device according to paragraph 15, comprising a mounting assembly comprising one or more lid mounting points for removably securing the lid.
17. The device according to paragraph 15 or paragraph 16, wherein a top surface of the device is removable and/or replaceable, optionally wherein the top surface and the lid are independently removable and/or replaceable, the device optionally comprising a mounting assembly comprising one or more top surface mounting points for removably securing the top surface.
18. A device according to any preceding paragraph wherein the device comprises:
   a receiving component for receiving and holding the receptacle (80);
   a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and
   a cleaning medium provision apparatus to supply a cleaning medium to the nozzle;
   wherein the device is arranged as a split system comprising:
      a head unit that comprises at least the receiving component and the nozzle; and
   an auxiliary unit comprising at least the cleaning medium provision apparatus.
19. The device according to paragraph 18, wherein the head unit and the auxiliary unit are connected by one or more conduits, optionally wherein the one or more conduits are arranged to communicate at least one of the cleaning medium, power, control signals, and waste water between the head unit and the auxiliary unit.
20. The device according to paragraph 18 or paragraph 19, wherein the head unit is arranged to be mounted on or in a mounting surface.
21. The device according to any of paragraphs 18-20, wherein the device comprises a separate housing for at least one of the head unit and the auxiliary unit.
22. The device according to any of paragraphs 1-21, wherein:
   the receiving component comprises a first rotating element (80) that is capable of rotating the receptacle (80);
   the device comprises a rotation driving component (400) comprising a second rotating element (130), wherein the rotation driving component (400) is arranged to drive rotation of the second rotating element (130); and
   the second rotating element (130) is magnetically coupled to the first rotating element (90) such that rotation of the second rotating element (130) by the rotation driving component (400) drives rotation of the first rotating element (90).
23. The device according to any preceding paragraph, wherein the device has one or more of the following features:
   (a) the device comprises a gutter for removal of condensation that may occur through use of the device; and/or
   (b) the device comprises a control unit that is responsive to user input to operate the device; and/or
   (c) the device comprises a surface that is substantially flush with a surface on or in which the device is mounted and/or wherein the device comprises a fluid path for removal of fluid during use of after use of the device; and/or
   (d) the device comprises a lid wherein at least a part of the lid is removable and/or replaceable; and/or
   (e) at least all or part of the device is contained within at least one housing.
24. The device according to any preceding paragraph, additionally comprising a second nozzle for cleaning at least a part (such all or substantially all) of the exterior of the receptacle (80), optionally wherein the cleaning medium comprises steam.

25. The device according to any preceding paragraph, wherein the receptacle comprises a base portion and a lid portion, wherein the receiving component comprises a first portion for receiving and holding the base portion and a second portion for receiving and holding the lid portion.
26. The device according to any preceding paragraph, wherein the receptacle comprises a base portion and a lid portion, wherein the receiving component comprises a first portion for receiving and holding the base portion and a second portion for receiving and holding the lid portion and the device additionally comprises a third nozzle for cleaning at least a part (such all or substantially all) of the lid portion of the receptacle (80), optionally wherein the cleaning medium comprises steam.
27. The device according to any preceding paragraph, wherein:
    the device comprises a hinge connecting the lid to one or more other components of the device, the hinge enabling the lid to open to provide access to the receiving component; and
    the gutter comprises a channel formed in the hinge; and
    wherein the hinge is moveable between a first, open position and a second, closed position, wherein the receptacle comprises a base portion and a lid portion, wherein the receiving component comprises a first portion for receiving and holding the base portion and a second portion for receiving and holding the lid portion, wherein the second portion of the receiving component is, in use, located below the hinge in the second position.
28. The device according to any preceding paragraph, wherein the cleaning medium provision apparatus comprises a steam generation apparatus and one or more tanks.
29. The device according to any preceding paragraph wherein the device comprises a cleaning medium provision apparatus to supply a cleaning medium to the nozzle; wherein the device comprises a head unit that comprises at least the receiving component and the nozzle and an auxiliary unit comprising at least the cleaning medium provision apparatus; wherein the cleaning medium provision apparatus is moveable from a first position within the auxiliary unit to a second position outside the auxiliary unit.
30. A method of cleaning a receptacle comprising use of the device (200) according to any preceding paragraph, the method comprising:
    receiving the receptacle (80) at the receiving component of the device (200); and
    delivering, via the first nozzle (110) a cleaning medium to an interior wall of the receptacle (80) to clean at least a part of the interior wall of the receptacle (80).
31. The method of cleaning a receptacle according to paragraph 30, additionally comprising delivering, via a second nozzle, the cleaning medium to an exterior of the receptacle (80), optionally wherein comprises steam.
32. The method of cleaning a receptacle according to paragraph 30 or paragraph 31, wherein receiving the receptacle comprises receiving a base portion and a lid portion, wherein the receiving component comprises a first portion for receiving and holding the base portion and a second portion for receiving and holding the lid portion.
33. The method of cleaning a receptacle according to paragraph 32, additionally comprising delivering, via a third nozzle, the cleaning medium to the lid portion of the receptacle, optionally wherein comprises steam.
34. A method of cleaning a receptacle (80) that is at least partly open-ended at one end (81) and having an interior space (82) defined by an interior wall (83) comprising use of the device according to any one of paragraphs 1 to 29; wherein a receptacle (80) is placed on the receiving component of the device and the cleaning component cleans at least part of the interior wall (83) of the receptacle interior (82).

The following set (2) of numbered paragraphs presents aspects of the present invention.

1. A device (200) for cleaning a receptacle (80), wherein the device (200) comprises:
    a receiving component for receiving and holding the receptacle (80);
    a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and
    a lid (550) for enclosing the receptacle in the receiving component;
    a cleaning medium provision apparatus to supply a cleaning medium to the nozzle;
    wherein the device is arranged as a split system comprising:
        a head unit that comprises at least the receiving component and the nozzle; and
        an auxiliary unit comprising at least the cleaning medium provision apparatus; and
        wherein the device (200) optionally comprises a gutter arranged to channel fluid from the lid into the receiving component.
2. The device according to paragraph 1, wherein the device (200) comprises a gutter arranged to channel fluid from the lid into the receiving component.
3. The device according to paragraph 1 or paragraph 2, wherein the nozzle (80) is capable of delivering a cleaning medium to an interior wall of the receptacle (80) to clean at least a part of the interior wall of the receptacle (80), optionally wherein the cleaning medium comprises steam.
4. The device according to according to any preceding paragraph, wherein the fluid comprises condensation occurring on the lid through use of the device.
5. The device according to any preceding paragraph, wherein:
    the device comprises a hinge connecting the lid to one or more other components of the device, the hinge enabling the lid to open to provide access to the receiving component; and
    the gutter comprises a channel formed in the hinge.
6. The device according to any preceding paragraph, wherein the lid comprises a lip arranged to direct fluid from the lid into the gutter.
7. The device according to any preceding paragraph, wherein:
    the device comprises a drain formed in the receiving component; and
    the gutter is arranged to channel the fluid towards drain.

8. A device according to any preceding paragraph wherein the device comprises:
   a control unit that is responsive to user input to operate the device;
   wherein the control unit is responsive to a first form of user input when the lid is in a closed position to allow the lid to open; and
   wherein the control unit is responsive a second form of user input to initiate a receptacle washing cycle.
9. The device according to paragraph 8, the device comprising at least one button and wherein at least one of the first form of user input and second form of user input comprises a button press.
10. The device according to paragraph 8 or paragraph 9, wherein:
   the control unit is responsive to the second form of user input when the lid is in an open position to prevent initiation of the receptacle washing cycle, or
   the device comprises a lid closing mechanism and the control unit is responsive to the second form of user input when the lid in in an open position to close the lid and to initiate the receptacle washing cycle.
11. The device according to any of paragraphs 8-10, wherein the device enables a user to access the receiving component and initiate a receptacle washing cycle with two instances of user input.
12. A device according to any preceding paragraph wherein at least a portion of the device is arranged to be mounted on or in a mounting surface such that a surface of the device is substantially flush with the mounting surface on or in which the device is mounted.
13. The device according to paragraph 12, wherein a top surface of the lid is arranged to be substantially flush with the mounting surface on or in which the device is mounted when the lid is in a closed position.
14. The device according to paragraph 12 or paragraph 13, wherein the device provides a fluid path for fluid to flow from the surface and/or the mounting surface into the receiving component optionally wherein the device provides the fluid path for fluid to flow from the surface and/or the mounting surface into the receiving component when the lid is in a closed position.
15. The device according to any of paragraphs 12-14, wherein the surface is substantially flush with a surface on or in which the device is mounted.
16. A device according to any preceding paragraph wherein the lid is removable and/or replaceable.
17. The device according to paragraph 16, comprising a mounting assembly comprising one or more lid mounting points for removably securing the lid.
18. The device according to paragraph 16 or paragraph 17, wherein a top surface of the device is removable and/or replaceable, optionally wherein the top surface and the lid are independently removable and/or replaceable, the device optionally comprising a mounting assembly comprising one or more top surface mounting points for removably securing the top surface.
19. The device according to any preceding paragraph, wherein the head unit and the auxiliary unit are connected by one or more conduits, optionally wherein the one or more conduits are arranged to communicate at least one of the cleaning medium, power, control signals, and waste water between the head unit and the auxiliary unit.
20. The device according to any preceding paragraph, wherein the head unit is arranged to be mounted on or in a mounting surface.
21. The device according to any preceding paragraph, wherein the device comprises a separate housing for at least one of the head unit and the auxiliary unit.
22. The device according to any of paragraphs 1-21, wherein:
   the receiving component comprises a first rotating element (80) that is capable of rotating the receptacle (80);
   the device comprises a rotation driving component (400) comprising a second rotating element (130), wherein the rotation driving component (400) is arranged to drive rotation of the second rotating element (130); and
   the second rotating element (130) is magnetically coupled to the first rotating element (90) such that rotation of the second rotating element (130) by the rotation driving component (400) drives rotation of the first rotating element (90).
23. The device according to any preceding paragraph, wherein the device has one or more of the following features:
   (a) the device comprises a gutter for removal of condensation that may occur through use of the device; and/or
   (b) the device comprises a control unit that is responsive to user input to operate the device; and/or
   (c) the device comprises a surface that is substantially flush with a surface on or in which the device is mounted and/or wherein the device comprises a fluid path for removal of fluid during use of after use of the device; and/or
   (d) the device comprises a lid wherein at least a part of the lid is removable and/or replaceable; and/or
   (e) at least all or part of the device is contained within at least one housing.
24. The device according to any preceding paragraph, additionally comprising a second nozzle for cleaning at least a part (such all or substantially all) of the exterior of the receptacle (80), optionally wherein the cleaning medium comprises steam.
25. The device according to any preceding paragraph, wherein the receptacle comprises a base portion and a lid portion, wherein the receiving component comprises a first portion for receiving and holding the base portion and a second portion for receiving and holding the lid portion.
26. The device according to any preceding paragraph, wherein the receptacle comprises a base portion and a lid portion, wherein the receiving component comprises a first portion for receiving and holding the base portion and a second portion for receiving and holding the lid portion and the device additionally comprises a third nozzle for cleaning at least a part (such all or substantially all) of the lid portion of the receptacle (80), optionally wherein the cleaning medium comprises steam.
27. The device according to any preceding paragraph, wherein:
   the device comprises a hinge connecting the lid to one or more other components of the device, the hinge enabling the lid to open to provide access to the receiving component; and
   the gutter comprises a channel formed in the hinge; and
   wherein the hinge is moveable between a first, open position and a second, closed position, wherein the receptacle comprises a base portion and a lid portion, wherein the receiving component comprises a first portion for receiving and holding the base portion and a second portion for receiving and holding the lid portion, wherein the second portion of the receiving component is, in use, located below the hinge in the second position.

28. The device according to any preceding paragraph, wherein the cleaning medium provision apparatus comprises a steam generation apparatus and one or more tanks.

29. The device according to any preceding paragraph wherein the device comprises a cleaning medium provision apparatus to supply a cleaning medium to the nozzle; wherein the device comprises a head unit that comprises at least the receiving component and the nozzle and an auxiliary unit comprising at least the cleaning medium provision apparatus; wherein the cleaning medium provision apparatus is moveable from a first position within the auxiliary unit to a second position outside the auxiliary unit.

30. A method of cleaning a receptacle comprising use of the device (200) according to any preceding paragraph, the method comprising:

receiving the receptacle (80) at the receiving component of the device (200); and delivering, via the first nozzle (110) a cleaning medium to an interior wall of the receptacle (80) to clean at least a part of the interior wall of the receptacle (80).

31. The method of cleaning a receptacle according to paragraph 30, additionally comprising delivering, via a second nozzle, the cleaning medium to an exterior of the receptacle (80), optionally wherein comprises steam.

32. The method of cleaning a receptacle according to paragraph 30 or paragraph 31, wherein receiving the receptacle comprises receiving a base portion and a lid portion, wherein the receiving component comprises a first portion for receiving and holding the base portion and a second portion for receiving and holding the lid portion.

33. The method of cleaning a receptacle according to paragraph 32, additionally comprising delivering, via a third nozzle, the cleaning medium to the lid portion of the receptacle, optionally wherein comprises steam.

34. A method of cleaning a receptacle (80) that is at least partly open-ended at one end (81) and having an interior space (82) defined by an interior wall (83) comprising use of the device according to any one of paragraphs 1 to 29; wherein a receptacle (80) is placed on the receiving component of the device and the cleaning component cleans at least part of the interior wall (83) of the receptacle interior (82).

The following set (3) of numbered paragraphs presents aspects of the present invention.

1. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and a second nozzle for cleaning at least a part (such all or substantially all) of the exterior of the receptacle (80), optionally wherein the cleaning medium comprises steam.

2. A device according to paragraph 1 wherein the device comprises:

a receiving component for receiving and holding the receptacle (80);

a lid (550) for enclosing the receptacle in the receiving component; and a gutter arranged to channel fluid from the lid into the receiving component.

3. The device according to paragraph 1 or paragraph 2, wherein the nozzle (80) is capable of delivering a cleaning medium to an interior wall of the receptacle (80) to clean at least a part of the interior wall of the receptacle (80), optionally wherein the cleaning medium comprises steam.

4. The device according to any preceding paragraph, wherein the fluid comprises condensation occurring on the lid through use of the device.

5. The device according to any preceding paragraph, wherein:

the device comprises a hinge connecting the lid to one or more other components of the device, the hinge enabling the lid to open to provide access to the receiving component; and the gutter comprises a channel formed in the hinge.

6. The device according to any preceding paragraph, wherein the lid comprises a lip arranged to direct fluid from the lid into the gutter.

7. The device according to any preceding paragraph, wherein:

the device comprises a drain formed in the receiving component; and the gutter is arranged to channel the fluid towards drain.

8. A device according to any preceding paragraph wherein the device comprises:

a control unit that is responsive to user input to operate the device;

wherein the control unit is responsive to a first form of user input when the lid is in a closed position to allow the lid to open; and wherein the control unit is responsive a second form of user input to initiate a receptacle washing cycle.

9. The device according to paragraph 8, the device comprising at least one button and wherein at least one of the first form of user input and second form of user input comprises a button press.

10. The device according to paragraph 8 or paragraph 9, wherein:

the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle.

11. The device according to any of paragraphs 8-10, wherein the device enables a user to access the receiving component and initiate a receptacle washing cycle with two instances of user input.

12. A device according to any preceding paragraph wherein at least a portion of the device is arranged to be mounted on or in a mounting surface such that a surface of the device is substantially flush with the mounting surface on or in which the device is mounted.

13. The device according to paragraph 12, wherein a top surface of the lid is arranged to be substantially flush with the mounting surface on or in which the device is mounted when the lid is in a closed position.

14. The device according to paragraph 12 or paragraph 13, wherein the device provides a fluid path for fluid to flow from the surface and/or the mounting surface into the receiving component optionally wherein the device provides the fluid path for fluid to flow from the surface and/or the mounting surface into the receiving component when the lid is in a closed position.
15. The device according to any of paragraphs 12-14, wherein the surface is substantially flush with a surface on or in which the device is mounted.
16. A device according to any preceding paragraph wherein the lid is removable and/or replaceable.
17. The device according to paragraph 16, comprising a mounting assembly comprising one or more lid mounting points for removably securing the lid.
18. The device according to paragraph 16 or paragraph 17, wherein a top surface of the device is removable and/or replaceable, optionally wherein the top surface and the lid are independently removable and/or replaceable, the device optionally comprising a mounting assembly comprising one or more top surface mounting points for removably securing the top surface.
19. A device according to any preceding paragraph wherein the device comprises:
a cleaning medium provision apparatus to supply a cleaning medium to the nozzle;
wherein the device is arranged as a split system comprising:
a head unit that comprises at least the receiving component and the nozzle; and
an auxiliary unit comprising at least the cleaning medium provision apparatus.
20. The device according to paragraph 19, wherein the head unit and the auxiliary unit are connected by one or more conduits, optionally wherein the one or more conduits are arranged to communicate at least one of the cleaning medium, power, control signals, and waste water between the head unit and the auxiliary unit.
21. The device according to paragraph 19 or paragraph 20, wherein the head unit is arranged to be mounted on or in a mounting surface.
22. The device according to any of paragraphs 19-21, wherein the device comprises a separate housing for at least one of the head unit and the auxiliary unit.
23. The device according to any of paragraphs 1-22, wherein:
the receiving component comprises a first rotating element (80) that is capable of rotating the receptacle (80);
the device comprises a rotation driving component (400) comprising a second rotating element (130), wherein the rotation driving component (400) is arranged to drive rotation of the second rotating element (130); and
the second rotating element (130) is magnetically coupled to the first rotating element (90) such that rotation of the second rotating element (130) by the rotation driving component (400) drives rotation of the first rotating element (90).
24. The device according to any preceding paragraph, wherein the device has one or more of the following features:
(a) the device comprises a gutter for removal of condensation that may occur through use of the device; and/or
(b) the device comprises a control unit that is responsive to user input to operate the device; and/or
(c) the device comprises a surface that is substantially flush with a surface on or in which the device is mounted and/or wherein the device comprises a fluid path for removal of fluid during use of after use of the device; and/or
(d) the device comprises a lid wherein at least a part of the lid is removable and/or replaceable; and/or
(e) at least all or part of the device is contained within at least one housing.
25. The device according to any preceding paragraph, wherein the receptacle comprises a base portion and a lid portion, wherein the receiving component comprises a first portion for receiving and holding the base portion and a second portion for receiving and holding the lid portion.
26. The device according to any preceding paragraph, wherein the receptacle comprises a base portion and a lid portion, wherein the receiving component comprises a first portion for receiving and holding the base portion and a second portion for receiving and holding the lid portion and the device additionally comprises a third nozzle for cleaning at least a part (such all or substantially all) of the lid portion of the receptacle (80), optionally wherein the cleaning medium comprises steam.
27. The device according to any preceding paragraph, wherein:
the device comprises a hinge connecting the lid to one or more other components of the device, the hinge enabling the lid to open to provide access to the receiving component; and
the gutter comprises a channel formed in the hinge; and
wherein the hinge is moveable between a first, open position and a second, closed position, wherein the receptacle comprises a base portion and a lid portion, wherein the receiving component comprises a first portion for receiving and holding the base portion and a second portion for receiving and holding the lid portion, wherein the second portion of the receiving component is, in use, located below the hinge in the second position.
28. The device according to any preceding paragraph, wherein the cleaning medium provision apparatus comprises a steam generation apparatus and one or more tanks.
29. The device according to any preceding paragraph wherein the device comprises a cleaning medium provision apparatus to supply a cleaning medium to the nozzle; wherein the device comprises a head unit that comprises at least the receiving component and the nozzle and an auxiliary unit comprising at least the cleaning medium provision apparatus; wherein the cleaning medium provision apparatus is moveable from a first position within the auxiliary unit to a second position outside the auxiliary unit.
30. A method of cleaning a receptacle comprising use of the device (200) according to any preceding paragraph, the method comprising:
receiving the receptacle (80) at the receiving component of the device (200); and
delivering, via the first nozzle (110) a cleaning medium to an interior wall of the receptacle (80) to clean at least a part of the interior wall of the receptacle (80).
31. The method of cleaning a receptacle according to paragraph 30, additionally comprising delivering, via a second nozzle, the cleaning medium to an exterior of the receptacle (80), optionally wherein comprises steam.

32. The method of cleaning a receptacle according to paragraph 30 or paragraph 31, wherein receiving the receptacle comprises receiving a base portion and a lid portion, wherein the receiving component comprises a first portion for receiving and holding the base portion and a second portion for receiving and holding the lid portion.

33. The method of cleaning a receptacle according to paragraph 32, additionally comprising delivering, via a third nozzle, the cleaning medium to the lid portion of the receptacle, optionally wherein comprises steam.

34. A method of cleaning a receptacle (80) that is at least partly open-ended at one end (81) and having an interior space (82) defined by an interior wall (83) comprising use of the device according to any one of paragraphs 1 to 29; wherein a receptacle (80) is placed on the receiving component of the device and the cleaning component cleans at least part of the interior wall (83) of the receptacle interior (82).

The following set (4) of numbered paragraphs presents aspects of the present invention.

1. A device (200) for cleaning a receptacle (80), wherein the device (200) comprises:
   a receiving component for receiving and holding the receptacle (80);
   a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and
   wherein the receptacle comprises a base portion and a lid portion, wherein the receiving component comprises a first portion for receiving and holding the base portion and a second portion for receiving and holding the lid portion.

2. A device according to paragraph 1 wherein the device comprises:
   a receiving component for receiving and holding the receptacle (80);
   a lid (550) for enclosing the receptacle in the receiving component; and
   a gutter arranged to channel fluid from the lid into the receiving component.

3. The device according to paragraph 1 or paragraph 2, wherein the nozzle (80) is capable of delivering a cleaning medium to an interior wall of the receptacle (80) to clean at least a part of the interior wall of the receptacle (80), optionally wherein the cleaning medium comprises steam.

4. The device according to any preceding paragraph, wherein the fluid comprises condensation occurring on the lid through use of the device.

5. The device according to any preceding paragraph, wherein:
   device comprises a hinge connecting the lid to one or more other components of the device, the hinge enabling the lid to open to provide access to the receiving component; and
   the gutter comprises a channel formed in the hinge.

6. The device according to any preceding paragraph, wherein the lid comprises a lip arranged to direct fluid from the lid into the gutter.

7. The device according to any preceding paragraph, wherein:
   the device comprises a drain formed in the receiving component; and
   the gutter is arranged to channel the fluid towards drain.

8. A device according to any preceding paragraph wherein the device comprises:
   a control unit that is responsive to user input to operate the device;
   wherein the control unit is responsive to a first form of user input when the lid is in a closed position to allow the lid to open; and
   wherein the control unit is responsive a second form of user input to initiate a receptacle washing cycle.

9. The device according to paragraph 8, the device comprising at least one button and wherein at least one of the first form of user input and second form of user input comprises a button press.

10. The device according to paragraph 8 or paragraph 9, wherein:
    the control unit is responsive to the second form of user input when the lid is in an open position to prevent initiation of the receptacle washing cycle, or
    the device comprises a lid closing mechanism and the control unit is responsive to the second form of user input when the lid in in an open position to close the lid and to initiate the receptacle washing cycle.

11. The device according to any of paragraphs 8-10, wherein the device enables a user to access the receiving component and initiate a receptacle washing cycle with two instances of user input.

12. A device according to any preceding paragraph wherein at least a portion of the device is arranged to be mounted on or in a mounting surface such that a surface of the device is substantially flush with the mounting surface on or in which the device is mounted.

13. The device according to paragraph 12, wherein a top surface of the lid is arranged to be substantially flush with the mounting surface on or in which the device is mounted when the lid is in a closed position.

14. The device according to paragraph 12 or paragraph 13, wherein the device provides a fluid path for fluid to flow from the surface and/or the mounting surface into the receiving component optionally wherein the device provides the fluid path for fluid to flow from the surface and/or the mounting surface into the receiving component when the lid is in a closed position.

15. The device according to any of paragraphs 12-14, wherein the surface is substantially flush with a surface on or in which the device is mounted.

16. A device according to any preceding paragraph wherein the lid is removable and/or replaceable.

17. The device according to paragraph 16, comprising a mounting assembly comprising one or more lid mounting points for removably securing the lid.

18. The device according to paragraph 16 or paragraph 17, wherein a top surface of the device is removable and/or replaceable, optionally wherein the top surface and the lid are independently removable and/or replaceable, the device optionally comprising a mounting assembly comprising one or more top surface mounting points for removably securing the top surface.

19. A device according to any preceding paragraph wherein the device comprises:
    a cleaning medium provision apparatus to supply a cleaning medium to the nozzle;

wherein the device is arranged as a split system comprising:

a head unit that comprises at least the receiving component and the nozzle; and an auxiliary unit comprising at least the cleaning medium provision apparatus.

20. The device according to paragraph 19, wherein the head unit and the auxiliary unit are connected by one or more conduits, optionally wherein the one or more conduits are arranged to communicate at least one of the cleaning medium, power, control signals, and waste water between the head unit and the auxiliary unit.

21. The device according to paragraph 19 or paragraph 20, wherein the head unit is arranged to be mounted on or in a mounting surface.

22. The device according to any of paragraphs 19-21, wherein the device comprises a separate housing for at least one of the head unit and the auxiliary unit.

23. The device according to any of paragraphs 1-22, wherein:

the receiving component comprises a first rotating element (80) that is capable of rotating the receptacle (80);

the device comprises a rotation driving component (400) comprising a second rotating element (130), wherein the rotation driving component (400) is arranged to drive rotation of the second rotating element (130); and the second rotating element (130) is magnetically coupled to the first rotating element (90) such that rotation of the second rotating element (130) by the rotation driving component (400) drives rotation of the first rotating element (90).

24. The device according to any preceding paragraph, wherein the device has one or more of the following features:

(a) the device comprises a gutter for removal of condensation that may occur through use of the device; and/or (b) the device comprises a control unit that is responsive to user input to operate the device; and/or (c) the device comprises a surface that is substantially flush with a surface on or in which the device is mounted and/or wherein the device comprises a fluid path for removal of fluid during use of after use of the device; and/or (d) the device comprises a lid wherein at least a part of the lid is removable and/or replaceable; and/or (e) at least all or part of the device is contained within at least one housing.

25. The device according to any preceding paragraph, additionally comprising a second nozzle for cleaning at least a part (such all or substantially all) of the exterior of the receptacle (80), optionally wherein the cleaning medium comprises steam.

26. The device according to any preceding paragraph, wherein the receptacle comprises a base portion and a lid portion, wherein the receiving component comprises a first portion for receiving and holding the base portion and a second portion for receiving and holding the lid portion and the device additionally comprises a third nozzle for cleaning at least a part (such all or substantially all) of the lid portion of the receptacle (80), optionally wherein the cleaning medium comprises steam.

27. The device according to any preceding paragraph, wherein:

the device comprises a hinge connecting the lid to one or more other components of the device, the hinge enabling the lid to open to provide access to the receiving component; and the gutter comprises a channel formed in the hinge; and wherein the hinge is moveable between a first, open position and a second, closed position, wherein the receptacle comprises a base portion and a lid portion, wherein the receiving component comprises a first portion for receiving and holding the base portion and a second portion for receiving and holding the lid portion, wherein the second portion of the receiving component is, in use, located below the hinge in the second position.

28. The device according to any preceding paragraph, wherein the cleaning medium provision apparatus comprises a steam generation apparatus and one or more tanks.

29. The device according to any preceding paragraph wherein the device comprises a cleaning medium provision apparatus to supply a cleaning medium to the nozzle; wherein the device comprises a head unit that comprises at least the receiving component and the nozzle and an auxiliary unit comprising at least the cleaning medium provision apparatus; wherein the cleaning medium provision apparatus is moveable from a first position within the auxiliary unit to a second position outside the auxiliary unit.

30. A method of cleaning a receptacle comprising use of the device (200) according to any preceding paragraph, the method comprising:

receiving the receptacle (80) at the receiving component of the device (200); and delivering, via the first nozzle (110) a cleaning medium to an interior wall of the receptacle (80) to clean at least a part of the interior wall of the receptacle (80).

31. The method of cleaning a receptacle according to paragraph 30, additionally comprising delivering, via a second nozzle, the cleaning medium to an exterior of the receptacle (80), optionally wherein the cleaning medium comprises steam.

32. The method of cleaning a receptacle according to paragraph 30 or paragraph 31, wherein receiving the receptacle comprises receiving a base portion and a lid portion, wherein the receiving component comprises a first portion for receiving and holding the base portion and a second portion for receiving and holding the lid portion.

33. The method of cleaning a receptacle according to paragraph 32, additionally comprising delivering, via a third nozzle, the cleaning medium to the lid portion of the receptacle, optionally wherein the cleaning medium comprises steam.

34. A method of cleaning a receptacle (80) that is at least partly open-ended at one end (81) and having an interior space (82) defined by an interior wall (83) comprising use of the device according to any one of paragraphs 1 to 29; wherein a receptacle (80) is placed on the receiving component of the device and the cleaning component cleans at least part of the interior wall (83) of the receptacle interior (82).

The following set (5) of numbered paragraphs presents aspects of the present invention.

1. A device (200) for cleaning a receptacle (80), wherein the device (200) comprises:

a receiving component for receiving and holding the receptacle (80);

a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and wherein the cleaning medium provision apparatus comprises a steam generation apparatus and one or more tanks.

2. A device according to paragraph 1 wherein the device comprises:

a receiving component for receiving and holding the receptacle (80);

a lid (550) for enclosing the receptacle in the receiving component; and a gutter arranged to channel fluid from the lid into the receiving component.

3. The device according to paragraph 1 or paragraph 2, wherein the nozzle (80) is capable of delivering a cleaning medium to an interior wall of the receptacle (80) to clean at least a part of the interior wall of the receptacle (80), optionally wherein the cleaning medium comprises steam.

4. The device according to any preceding paragraph, wherein the fluid comprises condensation occurring on the lid through use of the device.

5. The device according to any preceding paragraph, wherein:

the device comprises a hinge connecting the lid to one or more other components of the device, the hinge enabling the lid to open to provide access to the receiving component; and the gutter comprises a channel formed in the hinge.

6. The device according to any preceding paragraph, wherein the lid comprises a lip arranged to direct fluid from the lid into the gutter.

7. The device according to any preceding paragraph, wherein:

the device comprises a drain formed in the receiving component; and the gutter is arranged to channel the fluid towards drain.

8. A device according to any preceding paragraph wherein the device comprises:

a control unit that is responsive to user input to operate the device;

wherein the control unit is responsive to a first form of user input when the lid is in a closed position to allow the lid to open; and wherein the control unit is responsive a second form of user input to initiate a receptacle washing cycle.

9. The device according to paragraph 8, the device comprising at least one button and wherein at least one of the first form of user input and second form of user input comprises a button press.

10. The device according to paragraph 8 or paragraph 9, wherein:

the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle.

11. The device according to any of paragraphs 8-10, wherein the device enables a user to access the receiving component and initiate a receptacle washing cycle with two instances of user input.

12. A device according to any preceding paragraph wherein at least a portion of the device is arranged to be mounted on or in a mounting surface such that a surface of the device is substantially flush with the mounting surface on or in which the device is mounted.

13. The device according to paragraph 12, wherein a top surface of the lid is arranged to be substantially flush with the mounting surface on or in which the device is mounted when the lid is in a closed position.

14. The device according to paragraph 12 or paragraph 13, wherein the device provides a fluid path for fluid to flow from the surface and/or the mounting surface into the receiving component optionally wherein the device provides the fluid path for fluid to flow from the surface and/or the mounting surface into the receiving component when the lid is in a closed position.

15. The device according to any of paragraphs 12-14, wherein the surface is substantially flush with a surface on or in which the device is mounted.

16. A device according to any preceding paragraph wherein the lid is removable and/or replaceable.

17. The device according to paragraph 16, comprising a mounting assembly comprising one or more lid mounting points for removably securing the lid.

18. The device according to paragraph 16 or paragraph 17, wherein a top surface of the device is removable and/or replaceable, optionally wherein the top surface and the lid are independently removable and/or replaceable, the device optionally comprising a mounting assembly comprising one or more top surface mounting points for removably securing the top surface.

19. A device according to any preceding paragraph wherein the device comprises:

a cleaning medium provision apparatus to supply a cleaning medium to the nozzle;

wherein the device is arranged as a split system comprising:

a head unit that comprises at least the receiving component and the nozzle; and an auxiliary unit comprising at least the cleaning medium provision apparatus.

20. The device according to paragraph 19, wherein the head unit and the auxiliary unit are connected by one or more conduits, optionally wherein the one or more conduits are arranged to communicate at least one of the cleaning medium, power, control signals, and waste water between the head unit and the auxiliary unit.

21. The device according to paragraph 19 or paragraph 20, wherein the head unit is arranged to be mounted on or in a mounting surface.

22. The device according to any of paragraphs 19-21, wherein the device comprises a separate housing for at least one of the head unit and the auxiliary unit.

23. The device according to any of paragraphs 1-22, wherein:

the receiving component comprises a first rotating element (80) that is capable of rotating the receptacle (80);

the device comprises a rotation driving component (400) comprising a second rotating element (130), wherein the rotation driving component (400) is arranged to drive rotation of the second rotating element (130); and the second rotating element (130) is magnetically coupled to the first rotating element (90) such that rotation of the second rotating element (130) by the rotation driving component (400) drives rotation of the first rotating element (90).

24. The device according to any preceding paragraph, wherein the device has one or more of the following features:
    (a) the device comprises a gutter for removal of condensation that may occur through use of the device; and/or
    (b) the device comprises a control unit that is responsive to user input to operate the device; and/or
    (c) the device comprises a surface that is substantially flush with a surface on or in which the device is mounted and/or wherein the device comprises a fluid path for removal of fluid during use of after use of the device; and/or
    (d) the device comprises a lid wherein at least a part of the lid is removable and/or replaceable; and/or
    (e) at least all or part of the device is contained within at least one housing.
25. The device according to any preceding paragraph, additionally comprising a second nozzle for cleaning at least a part (such all or substantially all) of the exterior of the receptacle (80), optionally wherein the cleaning medium comprises steam.
26. The device according to any preceding paragraph, wherein the receptacle comprises a base portion and a lid portion, wherein the receiving component comprises a first portion for receiving and holding the base portion and a second portion for receiving and holding the lid portion.
27. The device according to any preceding paragraph, wherein the receptacle comprises a base portion and a lid portion, wherein the receiving component comprises a first portion for receiving and holding the base portion and a second portion for receiving and holding the lid portion and the device additionally comprises a third nozzle for cleaning at least a part (such all or substantially all) of the lid portion of the receptacle (80), optionally wherein the cleaning medium comprises steam.
28. The device according to any preceding paragraph, wherein:
    the device comprises a hinge connecting the lid to one or more other components of the device, the hinge enabling the lid to open to provide access to the receiving component; and
    the gutter comprises a channel formed in the hinge; and
    wherein the hinge is moveable between a first, open position and a second, closed position, wherein the receptacle comprises a base portion and a lid portion, wherein the receiving component comprises a first portion for receiving and holding the base portion and a second portion for receiving and holding the lid portion, wherein the second portion of the receiving component is, in use, located below the hinge in the second position.
29. The device according to any preceding paragraph wherein the device comprises a cleaning medium provision apparatus to supply a cleaning medium to the nozzle; wherein the device comprises a head unit that comprises at least the receiving component and the nozzle and an auxiliary unit comprising at least the cleaning medium provision apparatus; wherein the cleaning medium provision apparatus is moveable from a first position within the auxiliary unit to a second position outside the auxiliary unit.
30. A method of cleaning a receptacle comprising use of the device (200) according to any preceding paragraph, the method comprising:
    receiving the receptacle (80) at the receiving component of the device (200); and
    delivering, via the first nozzle (110) a cleaning medium to an interior wall of the receptacle (80) to clean at least a part of the interior wall of the receptacle (80).
31. The method of cleaning a receptacle according to paragraph 30, additionally comprising delivering, via a second nozzle, the cleaning medium to an exterior of the receptacle (80), optionally wherein the cleaning medium comprises steam.
32. The method of cleaning a receptacle according to paragraph 30 or paragraph 31, wherein receiving the receptacle comprises receiving a base portion and a lid portion, wherein the receiving component comprises a first portion for receiving and holding the base portion and a second portion for receiving and holding the lid portion.
33. The method of cleaning a receptacle according to paragraph 32, additionally comprising delivering, via a third nozzle, the cleaning medium to the lid portion of the receptacle, optionally wherein the cleaning medium comprises steam.
4. A method of cleaning a receptacle (80) that is at least partly open-ended at one end (81) and having an interior space (82) defined by an interior wall (83) comprising use of the device according to any one of paragraphs 1 to 29; wherein a receptacle (80) is placed on the receiving component of the device and the cleaning component cleans at least part of the interior wall (83) of the receptacle interior (82).

The following set (6) of numbered paragraphs presents aspects of the present invention.

1. A device (200) for cleaning a receptacle (80), wherein the device (200) comprises:
    a receiving component for receiving and holding the receptacle (80);
    a nozzle (110) arranged to be directed at an interior of the receptacle (80) when the receptacle (80) is held by the receiving component, optionally a first nozzle (110) arranged to be directed at an interior of the receptacle (80) when the receptacle (80) is held by the receiving component; and
    wherein the device comprises a cleaning medium provision apparatus to supply a cleaning medium to the nozzle; wherein the device comprises a head unit that comprises at least the receiving component and the nozzle and an auxiliary unit comprising at least the cleaning medium provision apparatus; wherein the cleaning medium provision apparatus is moveable from a first position within the auxiliary unit to a second position outside the auxiliary unit.
2. A device according to paragraph 1 wherein the device comprises:
    a receiving component for receiving and holding the receptacle (80);
    a lid (550) for enclosing the receptacle in the receiving component; and
    a gutter arranged to channel fluid from the lid into the receiving component.
3. The device according to paragraph 1 or paragraph 2, wherein the nozzle (80) is capable of delivering a cleaning medium to an interior wall of the receptacle (80) to clean at least a part of the interior wall of the receptacle (80), optionally wherein the cleaning medium comprises steam.

4. The device according to any preceding paragraph, wherein the fluid comprises condensation occurring on the lid through use of the device.

5. The device according to any preceding paragraph, wherein:

the device comprises a hinge connecting the lid to one or more other components of the device, the hinge enabling the lid to open to provide access to the receiving component; and the gutter comprises a channel formed in the hinge.

6. The device according to any preceding paragraph, wherein the lid comprises a lip arranged to direct fluid from the lid into the gutter.

7. The device according to any preceding paragraph, wherein:

the device comprises a drain formed in the receiving component; and the gutter is arranged to channel the fluid towards drain.

8. A device according to any preceding paragraph wherein the device comprises:

a control unit that is responsive to user input to operate the device;

wherein the control unit is responsive to a first form of user input when the lid is in a closed position to allow the lid to open; and wherein the control unit is responsive a second form of user input to initiate a receptacle washing cycle.

9. The device according to paragraph 8, the device comprising at least one button and wherein at least one of the first form of user input and second form of user input comprises a button press.

10. The device according to paragraph 8 or paragraph 9, wherein:

the control unit is responsive to the second form of user input when the lid is in an open position to prevent initiation of the receptacle washing cycle, or the device comprises a lid closing mechanism and the control unit is responsive to the second form of user input when the lid in in an open position to close the lid and to initiate the receptacle washing cycle.

11. The device according to any of paragraphs 8-10, wherein the device enables a user to access the receiving component and initiate a receptacle washing cycle with two instances of user input.

12. A device according to any preceding paragraph wherein at least a portion of the device is arranged to be mounted on or in a mounting surface such that a surface of the device is substantially flush with the mounting surface on or in which the device is mounted.

13. The device according to paragraph 12, wherein a top surface of the lid is arranged to be substantially flush with the mounting surface on or in which the device is mounted when the lid is in a closed position.

14. The device according to paragraph 12 or paragraph 13, wherein the device provides a fluid path for fluid to flow from the surface and/or the mounting surface into the receiving component optionally wherein the device provides the fluid path for fluid to flow from the surface and/or the mounting surface into the receiving component when the lid is in a closed position.

15. The device according to any of paragraphs 12-14, wherein the surface is substantially flush with a surface on or in which the device is mounted.

16. A device according to any preceding paragraph wherein the lid is removable and/or replaceable.

17. The device according to paragraph 16, comprising a mounting assembly comprising one or more lid mounting points for removably securing the lid.

18. The device according to paragraph 16 or paragraph 17, wherein a top surface of the device is removable and/or replaceable, optionally wherein the top surface and the lid are independently removable and/or replaceable, the device optionally comprising a mounting assembly comprising one or more top surface mounting points for removably securing the top surface.

19. A device according to any preceding paragraph wherein the device comprises:

a cleaning medium provision apparatus to supply a cleaning medium to the nozzle;

wherein the device is arranged as a split system comprising:

a head unit that comprises at least the receiving component and the nozzle; and an auxiliary unit comprising at least the cleaning medium provision apparatus.

20. The device according to paragraph 19, wherein the head unit and the auxiliary unit are connected by one or more conduits, optionally wherein the one or more conduits are arranged to communicate at least one of the cleaning medium, power, control signals, and waste water between the head unit and the auxiliary unit.

21. The device according to paragraph 19 or paragraph 20, wherein the head unit is arranged to be mounted on or in a mounting surface.

22. The device according to any of paragraphs 19-21, wherein the device comprises a separate housing for at least one of the head unit and the auxiliary unit.

23. The device according to any of paragraphs 1-22, wherein:

the receiving component comprises a first rotating element (80) that is capable of rotating the receptacle (80);

the device comprises a rotation driving component (400) comprising a second rotating element (130), wherein the rotation driving component (400) is arranged to drive rotation of the second rotating element (130); and the second rotating element (130) is magnetically coupled to the first rotating element (90) such that rotation of the second rotating element (130) by the rotation driving component (400) drives rotation of the first rotating element (90).

24. The device according to any preceding paragraph, wherein the device has one or more of the following features:

(a) the device comprises a gutter for removal of condensation that may occur through use of the device; and/or (b) the device comprises a control unit that is responsive to user input to operate the device; and/or (c) the device comprises a surface that is substantially flush with a surface on or in which the device is mounted and/or wherein the device comprises a fluid path for removal of fluid during use of after use of the device; and/or (d) the device comprises a lid wherein at least a part of the lid is removable and/or replaceable; and/or (e) at least all or part of the device is contained within at least one housing.

25. The device according to any preceding paragraph, additionally comprising a second nozzle for cleaning at least a part (such all or substantially all) of the exterior of the receptacle (80), optionally wherein the cleaning medium comprises steam.

26. The device according to any preceding paragraph, wherein the receptacle comprises a base portion and a lid portion, wherein the receiving component comprises a first portion for receiving and holding the base portion and a second portion for receiving and holding the lid portion.

26. The device according to any preceding paragraph, wherein the receptacle comprises a base portion and a lid portion, wherein the receiving component comprises a first portion for receiving and holding the base portion and a second portion for receiving and holding the lid portion and the device additionally comprises a third nozzle for cleaning at least a part (such all or substantially all) of the lid portion of the receptacle (80), optionally wherein the cleaning medium comprises steam.

27. The device according to any preceding paragraph, wherein:

the device comprises a hinge connecting the lid to one or more other components of the device, the hinge enabling the lid to open to provide access to the receiving component; and the gutter comprises a channel formed in the hinge; and wherein the hinge is moveable between a first, open position and a second, closed position, wherein the receptacle comprises a base portion and a lid portion, wherein the receiving component comprises a first portion for receiving and holding the base portion and a second portion for receiving and holding the lid portion, wherein the second portion of the receiving component is, in use, located below the hinge in the second position.

28. The device according to any preceding paragraph, wherein the cleaning medium provision apparatus comprises a steam generation apparatus and one or more tanks.

29. A method of cleaning a receptacle comprising use of the device (200) according to any preceding paragraph, the method comprising:

receiving the receptacle (80) at the receiving component of the device (200); and delivering, via the first nozzle (110) a cleaning medium to an interior wall of the receptacle (80) to clean at least a part of the interior wall of the receptacle (80).

30. The method of cleaning a receptacle according to paragraph 29, additionally comprising delivering, via a second nozzle, the cleaning medium to an exterior of the receptacle (80), optionally wherein the cleaning medium comprises steam.

31. The method of cleaning a receptacle according to paragraph 29 or paragraph 30, wherein receiving the receptacle comprises receiving a base portion and a lid portion, wherein the receiving component comprises a first portion for receiving and holding the base portion and a second portion for receiving and holding the lid portion.

32. The method of cleaning a receptacle according to paragraph 31, additionally comprising delivering, via a third nozzle, the cleaning medium to the lid portion of the receptacle, optionally wherein the cleaning medium comprises steam.

33. A method of cleaning a receptacle (80) that is at least partly open-ended at one end (81) and having an interior space (82) defined by an interior wall (83) comprising use of the device according to any one of paragraphs 1 to 28; wherein a receptacle (80) is placed on the receiving component of the device and the cleaning component cleans at least part of the interior wall (83) of the receptacle interior (82).

BRIEF DESCRIPTION OF THE DRAWINGS

The present invention will now be described by way of example only and with reference to the following Figures.

Figure 1:
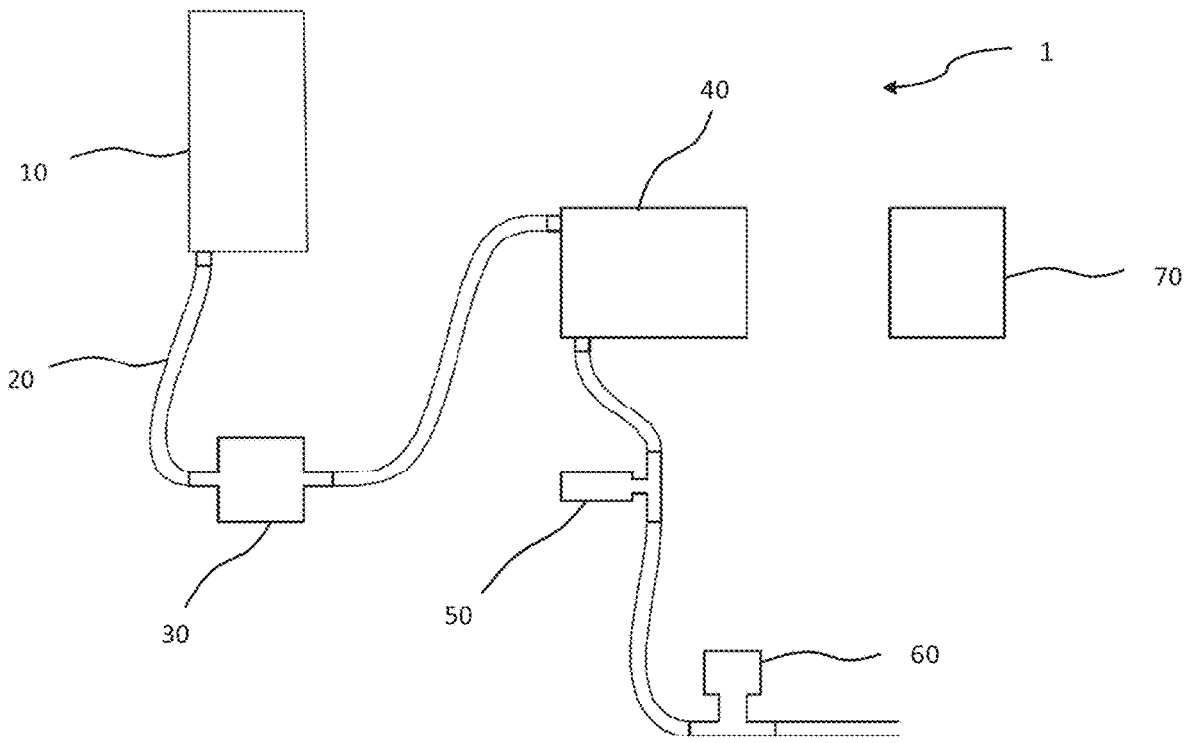
FIG. 1—which presents a schematic diagram of the cleaning component of the device of the present invention.

In the Examples, reference will be made to the following elements shown in the Figures:

1—Cleaning medium (for example steam) generating system of the cleaning component of the device.
10—Liquid source, such as a fresh water source, such as a water reservoir or a mains water inlet.
20—Hose.
30—Electric water pump.
40—Electric water heating block having an inlet and an outlet.
50—Electronic pressure transducer.
60—Valve—such as a solenoid valve.
70—Electronic control box with microprocessor.
80—Receptacle—such as a beverage vessel.
80*a*—Receptacle base portion
80*b*—Receptacle lid portion
81—Open-end of receptacle
82—Interior space of receptacle
83—Interior wall of receptacle
90—First rotating element—such as an upper turntable.
95—Drain outlet to waste.
97—Drain.
100—Rotary washing bay of the receiving component of the device.
110—Cleaning element—such as a nozzle.
110*a*—first nozzle
110*b*—second nozzle
110*c*—third nozzle
120—Shaft.
130—Second rotating element—such as a lower turntable.
140—Drain enclosure.
150—Electric Motor.
160—Gear attached to second rotating element.
170—A worm drive attached to motor.
180—Hose.
195—Bearing.
200—Device.
210—Rotating lid.
220—Human User Interface Module—can comprise a display and/or buttons, such as an LCD display.
230—Casing.
315—Array of magnets
320—Basin element
322—Basin shelf
325—Side wall of basin element 320
400—Rotation driving component
410—Gear attached to motor
460—Array of magnets corresponding, reversed polarity to 315
470—Gearbox housing
500—housing containing the device
520—housing unit
550—device lid
600—top surface of housing unit 520
620—lower part of housing unit 520
700—lid receiving structure
710—mounting assembly
720—surround for part 700
730—aperture
740—user interface button (A)
760—user interface button (B)
780—user interface button (C)
790—screen
820—surround for lid 550
840—glass cover
850—lip
890—hinge
900—gutter within hinge 890
910—receptacle lid receiving portion
925—inner recess
950—chamber
970—gutter in chamber 950
980—cup
990—surface
995—cabinet
996—door
1005—surface mounted unit or head unit
1010—steam generating apparatus or auxiliary unit
1012—drain line
1015—conduits
1015*a*—drain hose
1015*b*—water supply line
1015*c*—conduits
1015*d*—conduits
1020—waste tank
1030—supply tank

DETAILED DESCRIPTION OF THE INVENTION

Reference will now be made in detail to embodiments of the invention examples of which are illustrated in the accompanying drawings. Since the invention may be modified in various ways and may have various forms, specific embodiments are illustrated in the drawings and are described in detail in the specification. However, it should be understood that the invention is not limited to specific disclosed embodiments, but includes all modifications, equivalents and substitutes included within the technical scope of the invention.

The terms 'first', 'second', etc., may be used to describe various components, but the components are not limited by such terms. The terms are used only for the purpose of distinguishing one component from other components.

For example, a first component may be designated as a second component without departing from the scope of the embodiments of the invention. In the same manner, the second component may be designated as the first component.

The term "and/or" encompasses both combinations of the plurality of related items disclosed and any item from among the plurality of related items disclosed.

When an arbitrary component is described as "being connected to" or "being linked to" another component, this should be understood to mean that still another component(s) may exist between them, although the arbitrary component may be directly connected to, or linked to, the second component.

On the other hand, when an arbitrary component is described as "being directly connected to" or "being directly linked to" another component, this should be understood to mean that no other component exists between them.

The terms used in this application are used to describe only specific embodiments or examples, and are not intended to limit the invention. A singular expression can include a plural expression as long as it does not have an apparently different meaning in context.

In this application, the terms "include" and "have" should be understood to be intended to designate that illustrated features, numbers, steps, operations, components, parts or combinations thereof exist and not to preclude the existence of one or more different features, numbers, steps, operations, components, parts or combinations thereof, or the possibility of the addition thereof.

In the drawings, the thickness of layers, films, panels, regions, etc., are exaggerated for clarity. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Unless otherwise specified, all of the terms which are used herein, including the technical or scientific terms, have the same meanings as those that are generally understood by a person having ordinary knowledge in the art to which the invention pertains.

The terms defined in a generally used dictionary must be understood to have meanings identical to those used in the context of a related art, and are not to be construed to have ideal or excessively formal meanings unless they are obviously specified in this application.

The following example embodiments of the invention are provided to those skilled in the art in order to describe the invention more completely. Accordingly, shapes and sizes of elements shown in the drawings may be exaggerated for clarity.

Example embodiments of the invention will be described with reference to the accompanying drawings.

Figure 6:
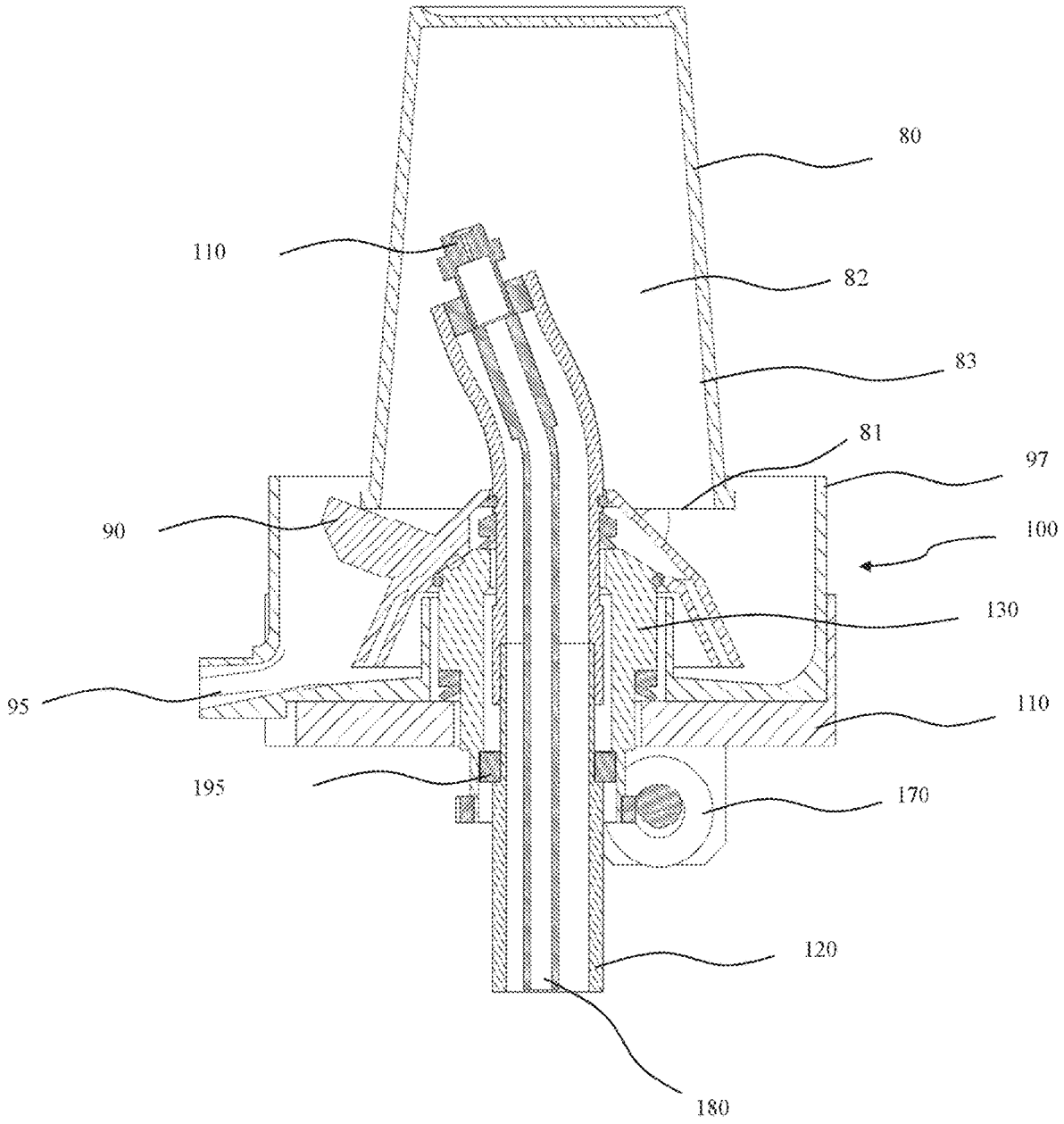
FIG. 6—which presents a cross-sectional view of the receiving component of the device of the present invention and the Receptacle.
Figure 7:
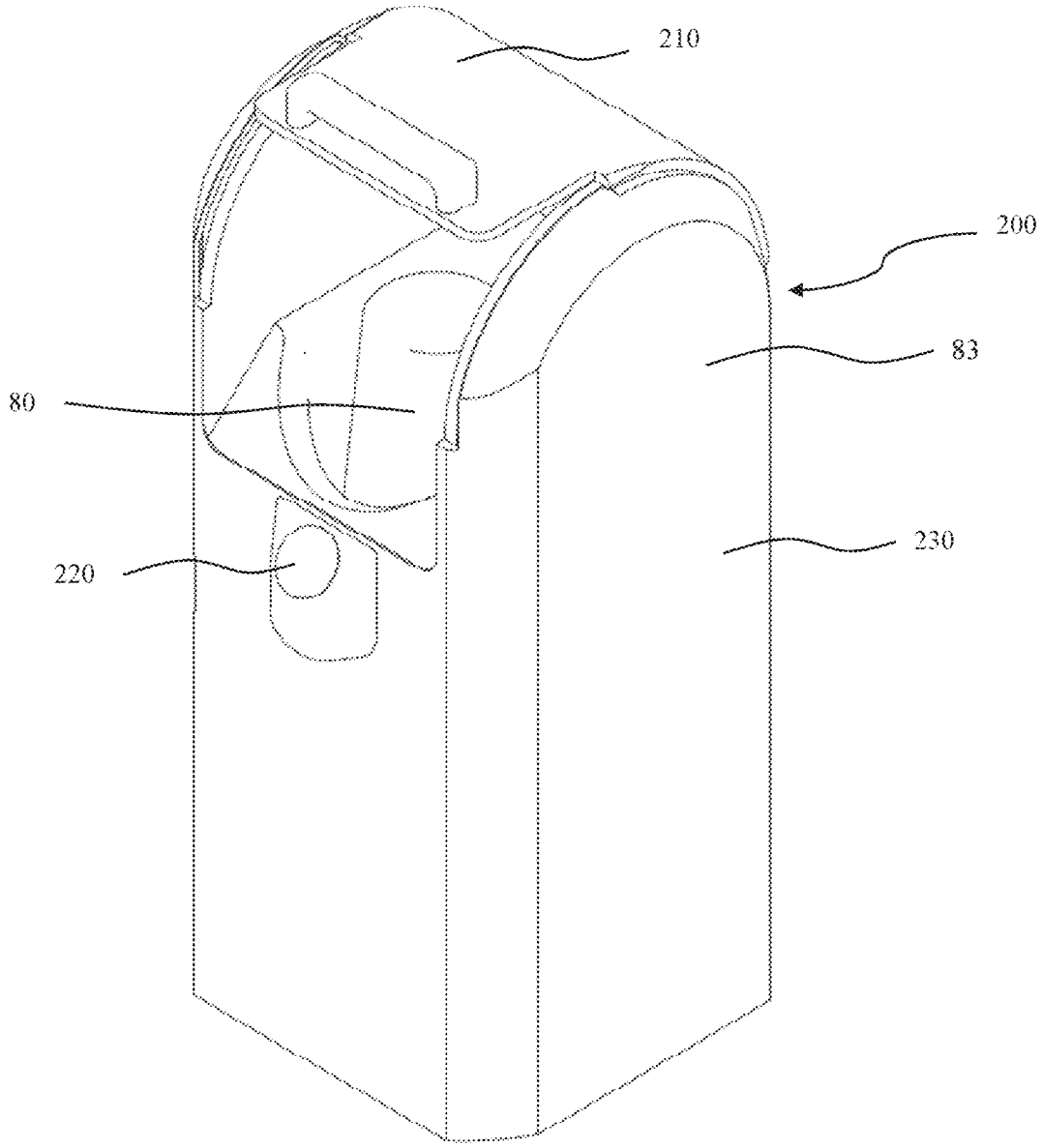
FIG. 7—which presents a view of the device of the present invention.

The device of the present invention—generally shown as 200 in FIG. 7—comprises a receiving component for receiving and holding a receptacle and a cleaning component that is extendable into at least a part of the interior of the receptacle when the receptacle is placed on the receiving component. The receiving component of the device is illustrated in FIGS. 2-6 and 8-11. Further elements thereof may be seen in FIG. 7. The cleaning component of the device is illustrated in FIG. 1. A preferred embodiment of the rotation driving component is illustrated in FIG. 9. In the Figures the receptacle is presented as receptacle 80, which is not part of the device as such but is shown for ease of understanding of the present invention. The receptacle 80 is open-ended at one end 81 and has an inner wall 83 and an inner base that defines an inner space 82.

Referring to FIG. 1 the cleaning medium generating system 1 of the cleaning component of the device comprises a system that generates steam that is used to clean the interior of a receptacle (not shown in FIG. 1). The cleaning medium generating system 1 comprises a water source 10 operably connected to a hose 20 that is operably connected to a water pump 30. Water pump 30 is operably connected to a water heater 40 that is operably connected to a pressure sensor 50. Pressure sensor 50 is operably connected to a valve 60 that is operably connected to the rotary washing bay 100 of the receiving component of the device (not shown in FIG. 1).

Also referring to FIG. 1 the cleaning medium generating system 1 comprises an electronic control box 70 that is operably connected to each of the water pump 30, the water heater 40, the pressure sensor 50 and the valve 60—such as by means of electrical leads or cables (not shown in FIG. 1).

The device of the present invention has generally two separate cycles in normal usage—namely a standby cycle and an operating cycle.

In the case of the standby cycle: the valve 60 is closed, the pump 30 delivers water from the water source 10 through the water heater 40 and pressure sensor 50. When a sufficient body of water is in the water heater 40 and the pressure sensor 50, the pump 30 turns off and encloses said body of water in the channel comprising the water heater 40 and pressure sensor 50. Upon the pump 30 turning off, the water heater 40 turns on. This action causes the body of water in said channel to vaporise and increase the pressure in the channel comprising of the water heater 40 and pressure sensor 50. The pressure sensor 50 relays the measured pressure value of said channel to the electronic control box 70. The electronic control box 70 receives this value and compares it against a preconfigured standby pressure value. If the pressure sensor 50 value exceeds the preconfigured standby pressure value, the electronic control box 70 signals to the water heater 40 to turn off. The pressure within said channel of water heater 40 and pressure sensor 50 will then fall. Once the pressure sensor 50 returns a value that does not exceed the preconfigured standby pressure value, the water heater 40 will turn on again. This cycle continues indefinitely until the cleaning medium generating system 1 is either turned off or the user initiates the operating cycle.

Figure 2:
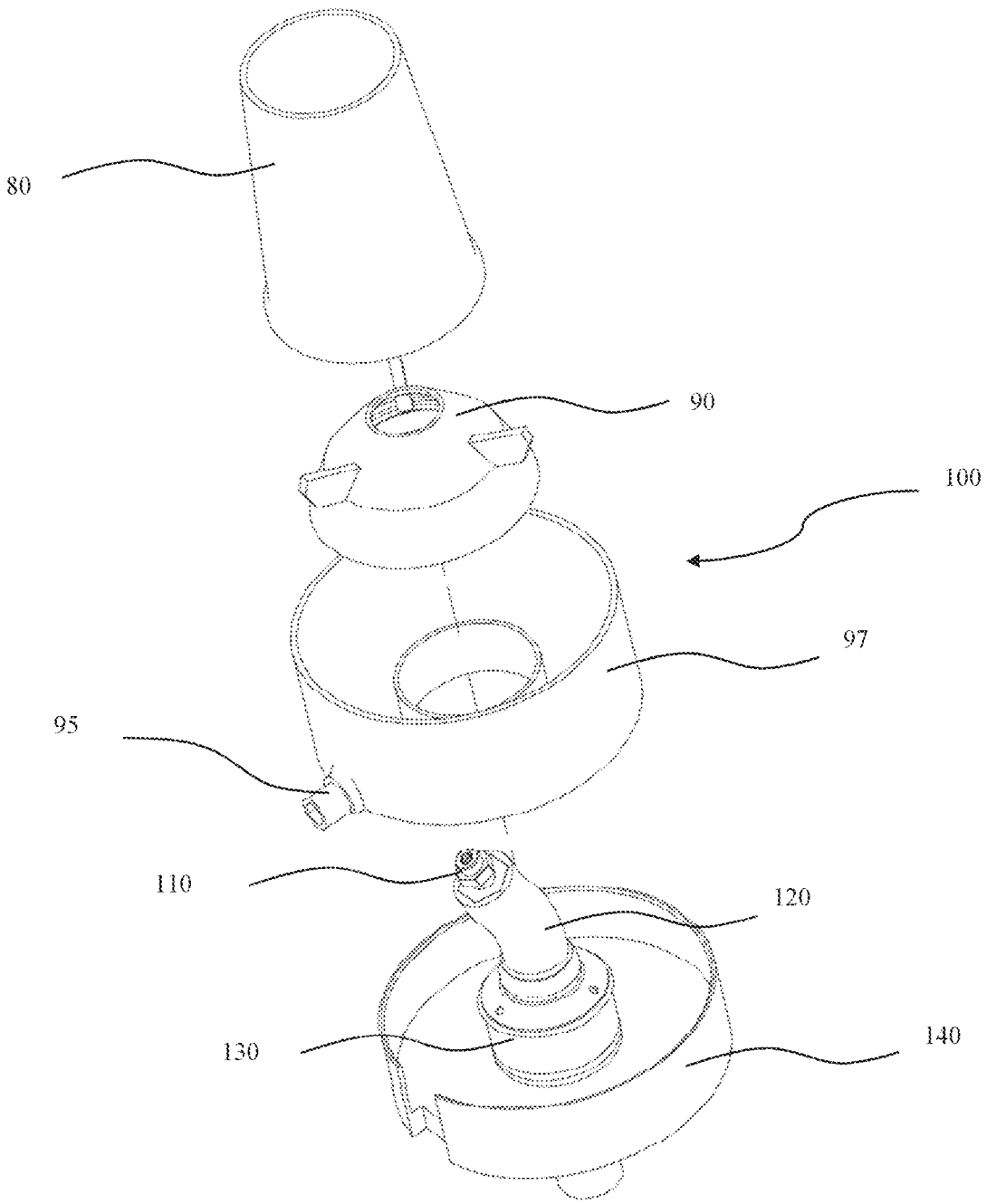
FIG. 2—which presents a view of some of the parts of the receiving component of the device of the present invention.

Referring to FIG. 2 the rotary washing bay 100 of the receiving component of the device comprises a system that rotates a rotary assembly about a stationary assembly. The rotary assembly comprises first rotating element 90, shown as an upper turntable, which operably connects to a second rotating element 130, shown as a lower turntable. The stationary assembly comprises a base plate 140, which operably connects to a drain module 97 and a shaft 120 (connection not shown). Cleaning element—shown as a nozzle 110—operably connects to the shaft 120.

The first rotating element 90 is shown as an upper turntable. This upper turntable is an example of a first rotating element that is capable of rotating the receptacle. The second rotating element 130 is shown as a lower turntable. This lower turntable is an example of a second rotating element capable of driving rotation of the first rotating element. The nozzle 110 is an example of a cleaning element. The drain module 97 is an example of a basin element. The drain outlet 95 is an example of a drain outlet for removal of spent cleaning medium.

Figure 3:
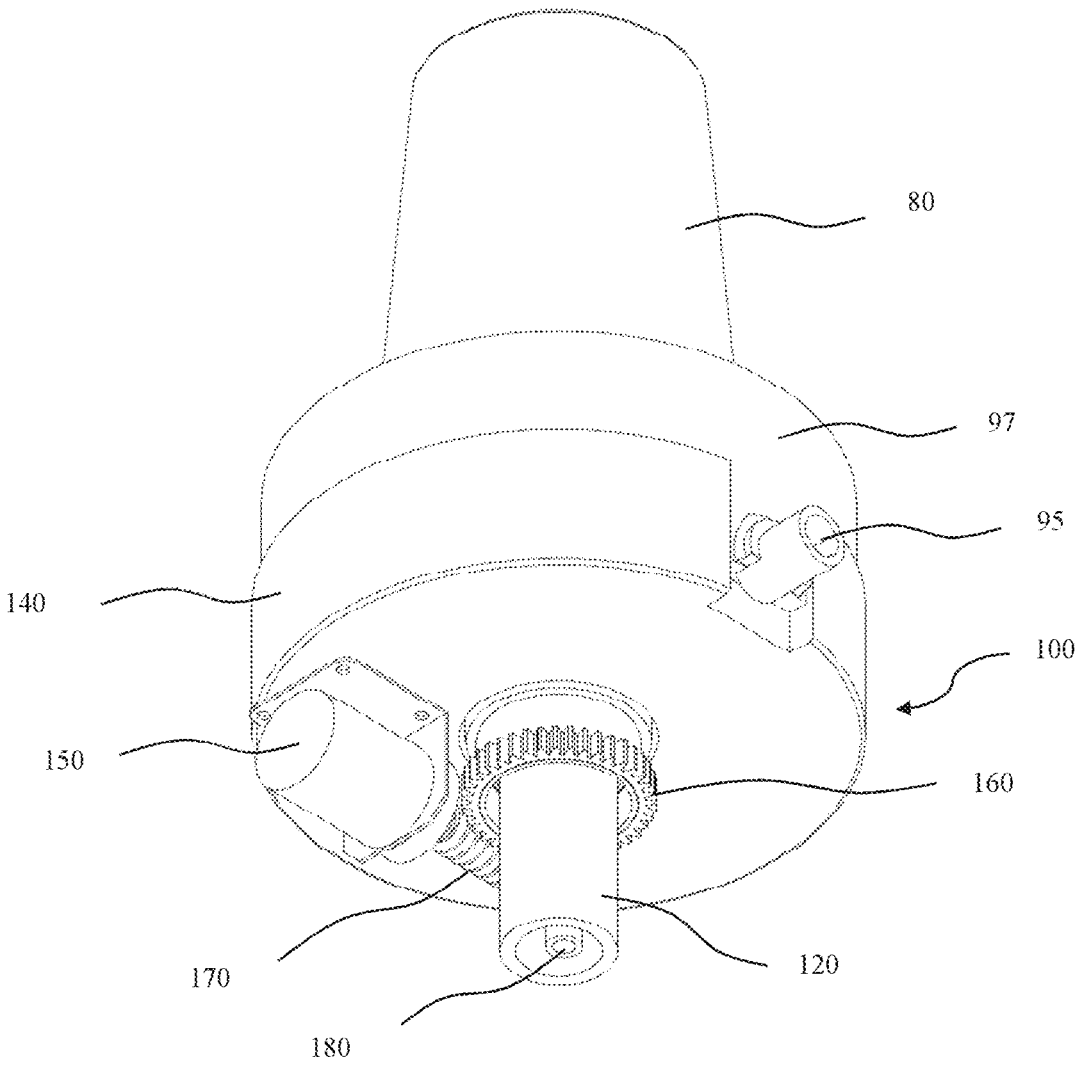
FIG. 3—which presents a view of the receiving component of the device of the present invention.

Referring to FIGS. 2 and 3, in use a receptacle, such as a beverage vessel 80, is shown to be placed into device 100. The beverage vessel 80 is placed into the receiving component, onto the first rotating element 90, shown as an upper turntable, and becomes operably connected.

Figure 4:
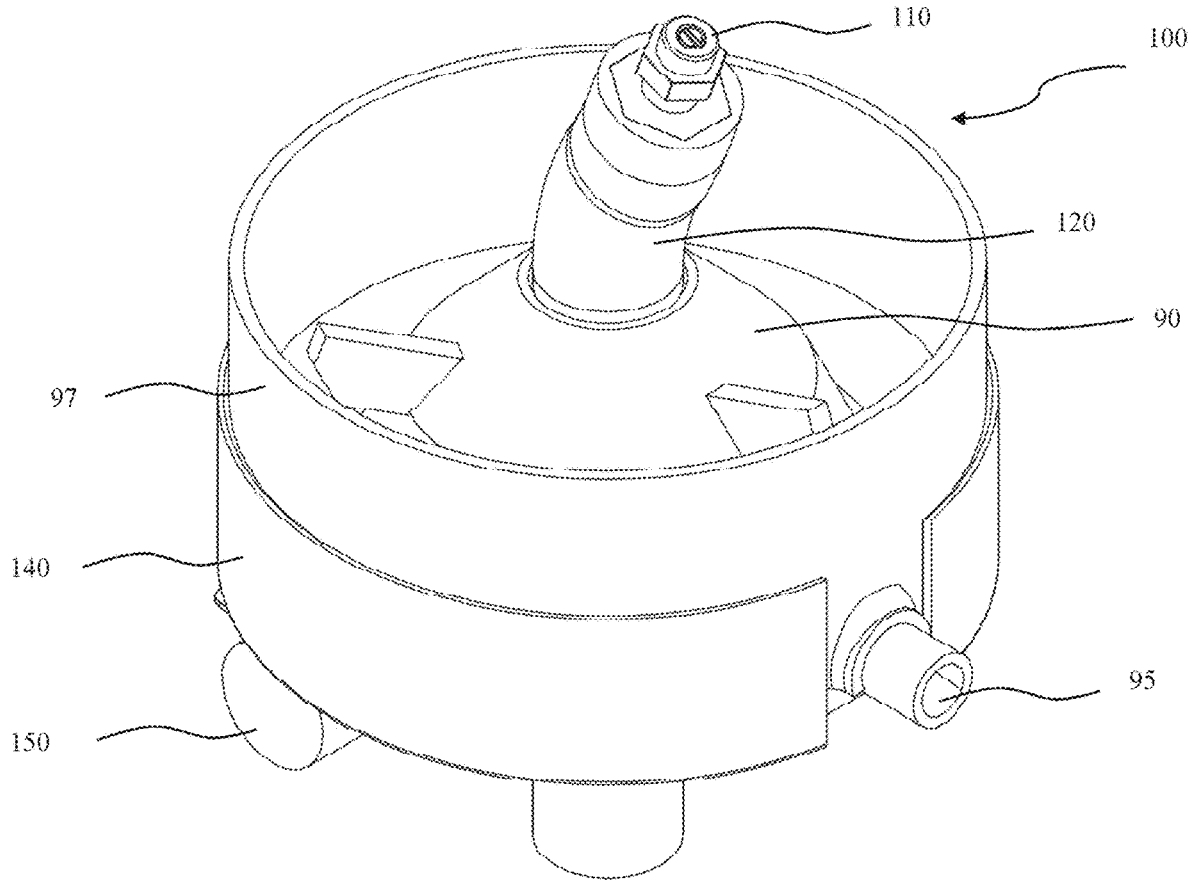
FIG. 4—which presents a view of the receiving component of the device of the present invention.

Referring to FIG. 4, the device 100 can be seen without the placement of the beverage vessel.

Figure 5:
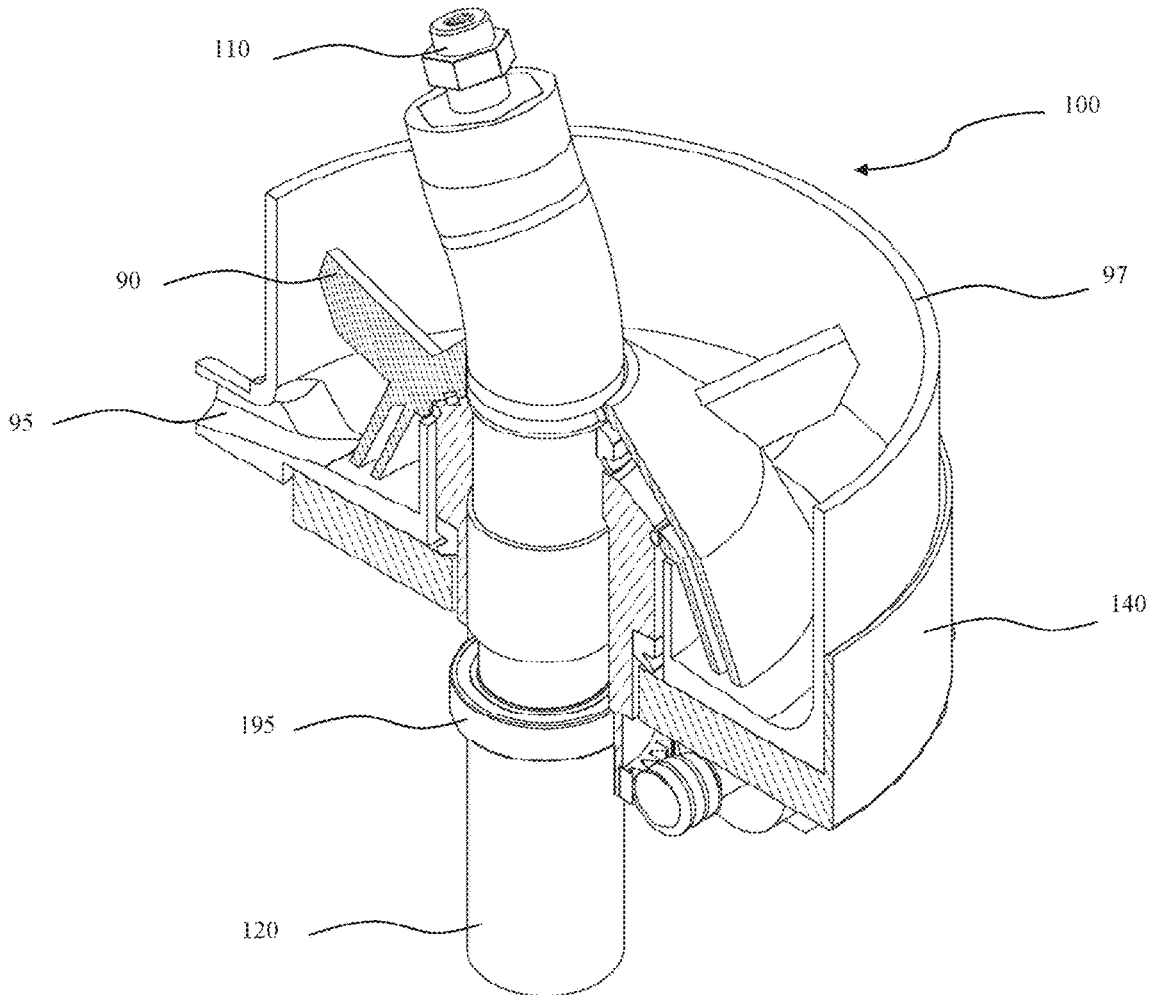
FIG. 5—which presents a part cross-sectional view of the receiving component of the device of the present invention.

Referring to FIG. 5, the rotary assembly comprises the first rotating element 90 shown as an upper turntable, which is part of the receiving component, and second rotating element 130 shown as a lower turntable. In use, the first rotating element 90 and the second rotating element 130 are rotationally driven about a bearing 195 on the stationary shaft 120 by an electric motor 150, a worm gear 170 and ring gear 160.

The gear attached to second rotating element 160 is an example of a driven gear. The worm gear 170 is an example of a drive gear. The electric motor 150 fitted with the worm gear 170 is an example of a means for driving the rotation of the second rotation element.

Referring to FIG. 6, the rotary washing bay 100 comprises a delivery hose which is operably connected to the nozzle 110 through which fluid can be delivered from device 1. The receptacle 80 is at least partly open-ended at one end 81 and having an interior space 82 defined by an interior wall 83. As can be seen from FIG. 6 the cleaning element nozzle 110 is located in the interior space 82 of the receptacle 80. The cleaning element nozzle 110 is configured to face all of the surface of at least a part of the interior wall 83 of the receptacle 80 on rotation of the receptacle 80 about its central axis by turntable 90—thereby allowing the cleaning thereof by the cleaning medium such as steam (not shown) that exits the end of the cleaning element nozzle 110.

Referring to FIG. 7, the device 200 comprises: the main body enclosure 230 which operably connects to a lid 210 which operably connects to the human user interface module 220. The cleaning medium generating system 1 and the rotary washing bay 100 are both enclosed in the casing 200.

In the case of the operating cycle, the user (not shown) will place the beverage vessel 80 into device 200, on top of the first rotating element 90, shown as an upper turntable, in the rotary washing bay 100. The user will then close the lid 210, enclosing the beverage vessel 80 within the device 200. Then the user will initiate the operating cycle by means of the human interface module 220. Upon this, the human interface module 220 sends a signal to the electronic control box 70.

The electronic control box 70 compares the current value of the pressure sensor 50 to the preconfigured operating pressure value. If the pressure sensor 50 value is lower than the preconfigured operating pressure value, the electronic control box 70 signals to the water heater 40 to turn on. Once the pressure sensor 50 value equals or exceeds the preconfigured operating pressure value, the control box 70 sends a signal simultaneously to the water pump 30 and the valve 60. The water pump 30 will turn on and the valve 60 will open. Water from the water source 10 will now be pumped constantly through the water heater 40 and vaporise to steam. This vaporised fluid continues through the now open valve 60 to the delivery hose 180, also shown in the rotary washing bay 100.

The flow of vaporised fluid travels through the delivery hose 180 to the nozzle 110 and exits the rotary washing bay 100 at high speed. The flow of vaporised fluid proceeds to remove residue from the internal face of the beverage vessel 80.

At the point the valve 60 is opened and the pump 30 is turned on, the electronic control box 70 turns on the electric motor 150. The electric motor 150 drives the worm gear 170, ring gear 160, second rotating element 130 (shown as an lower turntable), first rotating element 90 (shown as an upper turntable), and beverage vessel 80. The rotation of the beverage vessel 80 above the nozzle 110 allows the flow of vaporised fluid to remove residue from the complete circumference of the internal face of the beverage vessel 80.

The condensed waste liquid will exit the rotary washing bay 100 through the drain outlet 95 to waste collection external of the device 200 (not shown).

After a preconfigured duration, the electronic control box 70 sends a signal simultaneously to the pump 30, the water heater 40, the valve 60 and electric motor 150. The pump 30, the water heater 40 and the electric motor 150 will now turn off and the valve 60 will close. Following this the flow of vaporised fluid from the cleaning medium generating system 1 halts to the rotary washing bay 100.

Upon the halting of the flow of vaporised fluid, the user is now informed via the human user interface module 220 to open the lid 210 and remove the cleaned beverage vessel 80. This marks the end of the operating cycle. Following the end of the operating cycle, the cleaning medium generating system 1 will automatically return to the standby cycle until the next operating cycle is initiated or until the current invention is switched off.

Periodically, the human user interface module 220 will alert the user that maintenance is required. Maintenance can include the removal of the first rotating element 90, shown as an upper turntable, and drain module 97 for the user to clean externally of device 200 (not shown). The first rotating element 90 and drain module 97 can both be removed with ease from device 200. The use of seals (not shown) ensure the water tightness of the rotary washing bay 100 when the first rotating element 90 and drain module 97 are returned to the rotary washing bay 100 in preparation for normal usage.

Figure 8:
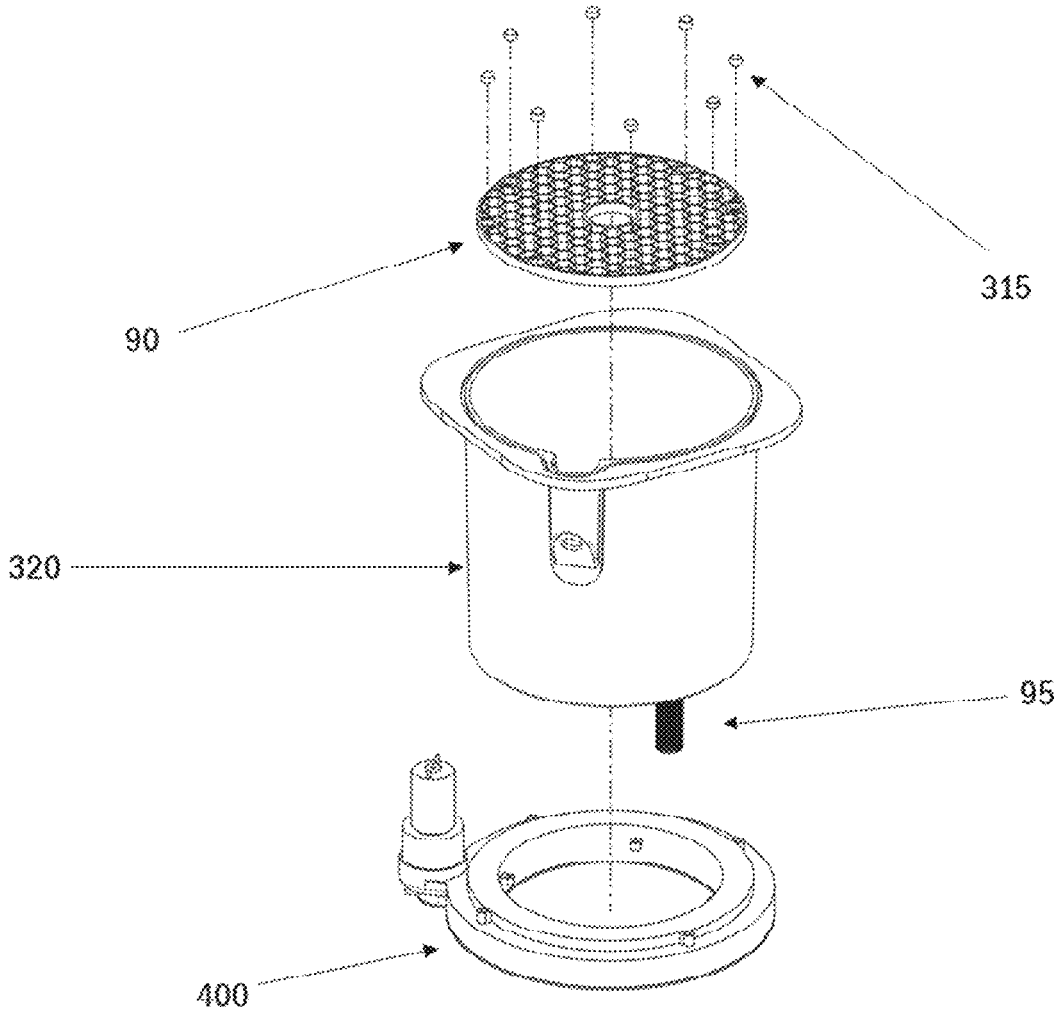
FIG. 8—which presents an expanded view of the receiving component, including the first rotating element, and the rotation driving component of a preferred embodiment the present invention.
Figure 9:
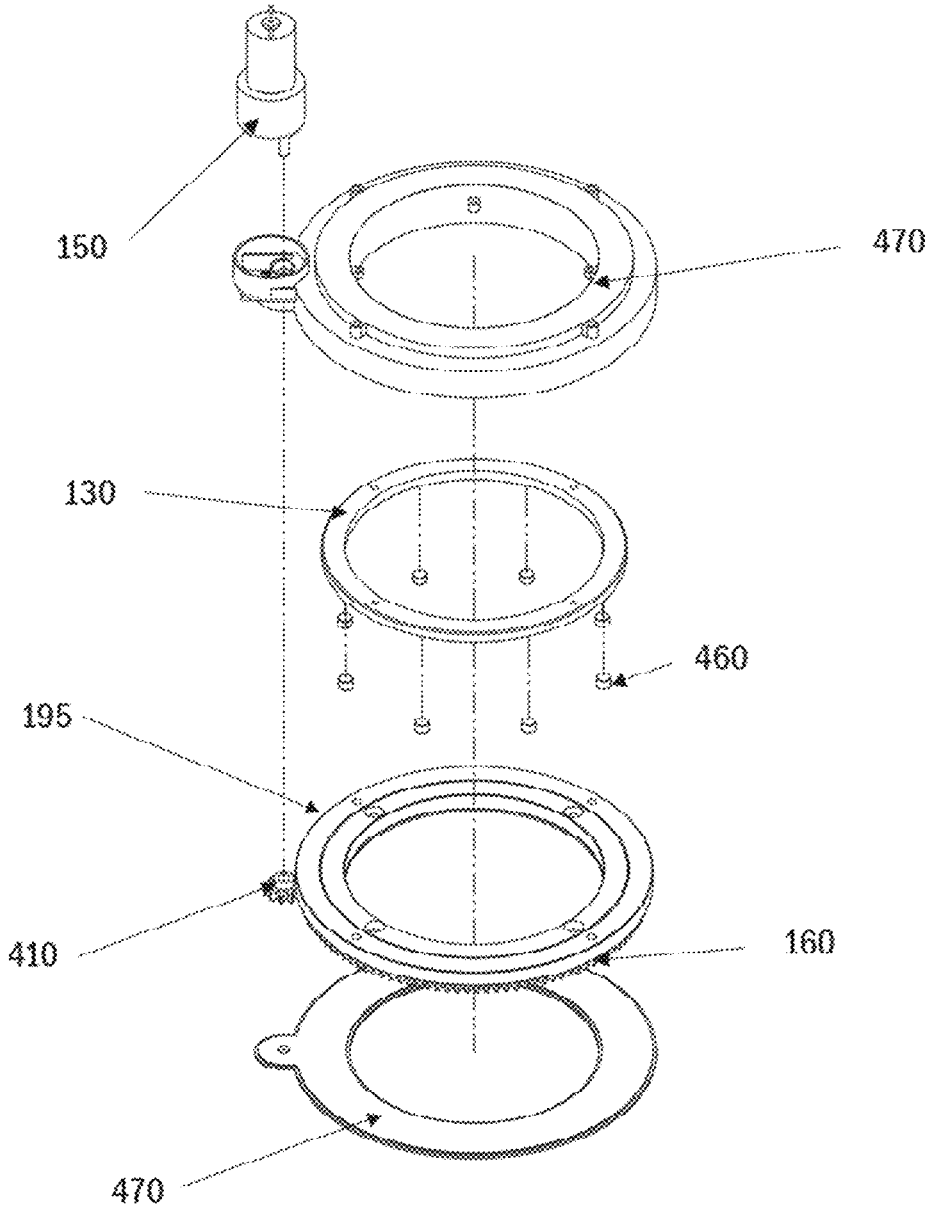
FIG. 9—which presents an expanded view of the rotation driving component of a preferred embodiment the present invention.

FIG. 8 illustrates the receiving component and rotation driving component of a preferred embodiment of the device. The device comprises a first rotating element 90, shown as an upper turntable. The first rotating element 90, shown as an upper turntable, comprises an array of magnets 315 that are sunk into first rotating element 90. The first rotating element 90, shown as an upper turntable, is magnetically coupled to the rotation driving component 400. The receiving component further comprises a basin element 320 and a drain outlet 95. In use, the basin element 320 is capable of capturing and retaining spent cleaning medium until it drains from the basin element 320 via the drain outlet 95. As can be seen from FIG. 8, the first rotating element 90 is located within the basin element 320. The first rotating element 90, shown as an upper turntable, is able to rotate within the basin element 320 and may be removed with ease from the device by overcoming the magnetic coupling between the first rotating element 90 and the rotation driving component 400. The rotation driving component 400 is located outside of the basin element 320.

The first rotating element 90 is shown as an upper turntable. This upper turntable is an example of a first rotating element that is capable of rotating the receptacle. The basin element 320 is an example of a basin element that is capable of capturing spent cleaning medium. The drain outlet 95 is an example of a drain outlet for removal of spent cleaning medium.

Referring to FIG. 9, in a preferred embodiment the rotation driving component 400 comprises an electric motor 150, a gear attached to the motor 410, a gear attached to second rotating element 160, a bearing 195, a second rotating element 130, an array of magnets 460 and gearbox housing 470. The gear attached to the motor 410, the gear attached to second rotating element 160, the bearing 195, the second rotating element 130, and the array of magnets 460 are all located within the gearbox housing 470. The electric motor 150 is capable of rotating the gear attached to the motor 410. The gear attached to the motor 410 is operably attached to gear attached to second rotating element 160.

The gear attached to the motor 410 is configured to cause rotation of gear attached to second rotating element 160 on rotation of the gear attached to the motor 410. The array of magnets 460 are mounted on the second rotating element 130. The second rotating element 130, together the array of magnets 460 mounted thereon, rotates with gear attached to second rotating element 160. Both the second rotating element 130 and gear attached to second rotating element 160 are attached to inner race of the bearing 195. The array of magnets 460 comprised in the rotation driving component 400 correspond (are of opposing polarity) to the array of magnets 315 (not shown in this figure) that are sunk into first rotating element 90 (not shown in this figure). The arrays of opposing magnets 315 (not shown in this figure), 460 are configured to cause the first rotating element 90 (not shown in this figure) to be magnetically coupled to the second rotating element 130. The arrays of opposing magnets 315 (not shown in this figure), 460 are configured to cause rotation of the first rotating element 90 on rotation of the second rotating element 130.

The second rotating element 130 is an example of second rotating element that is capable of driving rotation of the first rotating element. The arrays of opposing magnets 315, 460 are an example of a magnetic coupling. The gear attached to second rotating element 160 is an example of a driven gear. The gear attached to the motor 410 is an example of a drive gear. The electric motor 150 fitted with the gear 410 is an example of a means for driving the rotation of the second rotation element.

Figure 10:
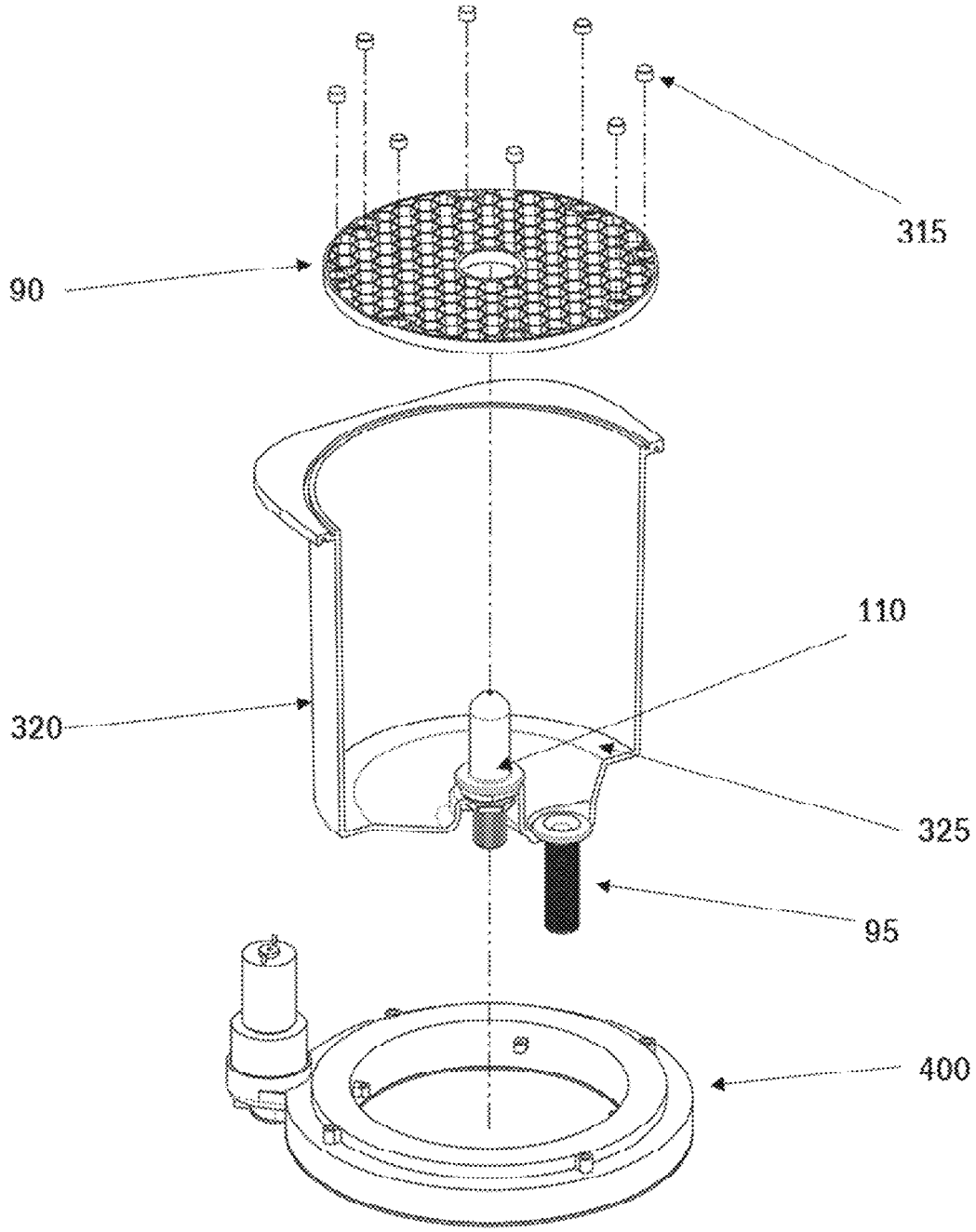
FIG. 10—which presents a part cross-sectional view the receiving component, including the first rotating element, and the rotation driving component of a preferred embodiment the present invention.
Figure 11:
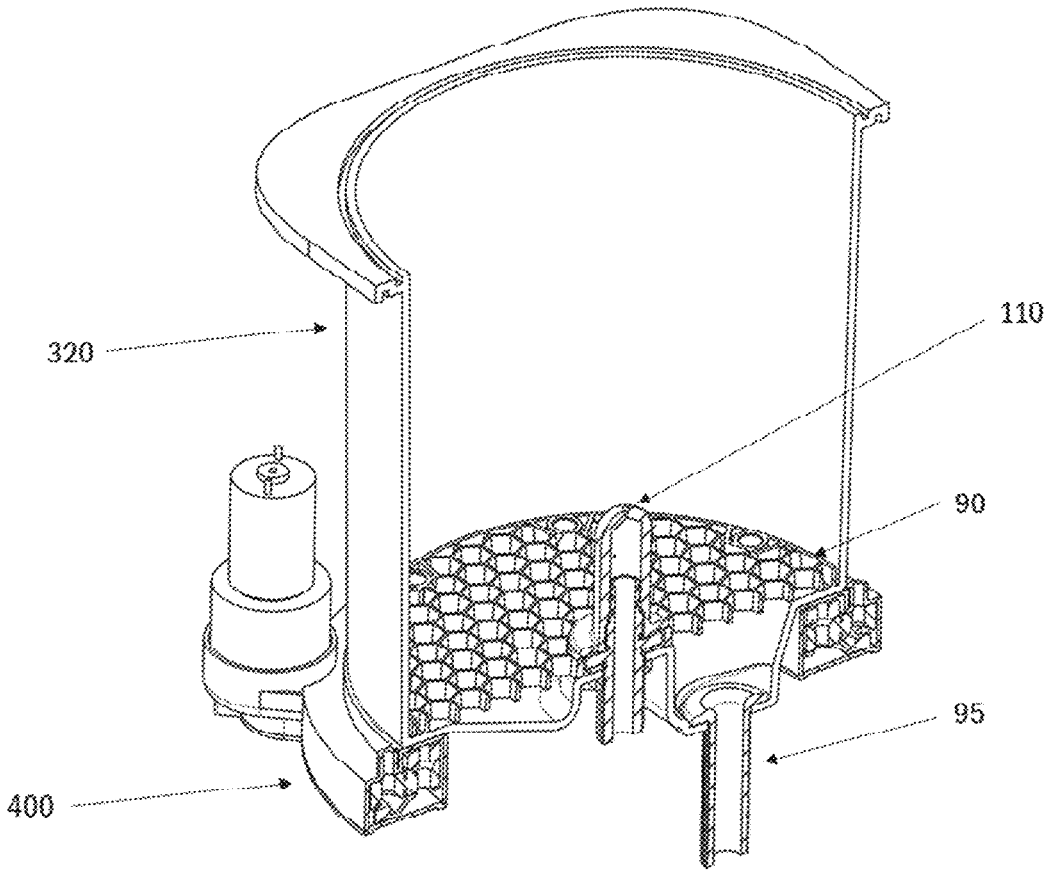
FIG. 11—which presents a cross-sectional view the receiving component, including the first rotating element, and the rotation driving component of a preferred embodiment the present invention.

Referring to FIGS. 10 and 11, the first rotating element 90, shown as an upper turntable, is mounted on a shelf 325 that offsets from the wall and base of the basin element 320. The cleaning element 110 in located within the basin element 320 and extends beyond the basin element 320 and the first rotating element 90. In use, the first rotating element 90, shown as an upper turntable, within the basin element 320 supports the receptacle 80 placed by the user.

As can be seen from FIG. 10, the cleaning element nozzle 110 is located so as it will be positioned within the interior space of a receptacle 80 in use of the specific device shown. The receptacle 80 is rotated about its central axis by first rotating element 90, shown as an upper turntable, thereby allowing the cleaning element nozzle 110 to face all of the surface of at least a part of the interior wall 83 of the receptacle 80—thereby allowing the cleaning thereof by the cleaning medium such as steam (not shown) that exits the end of the cleaning element nozzle 110.

Figure 12A:
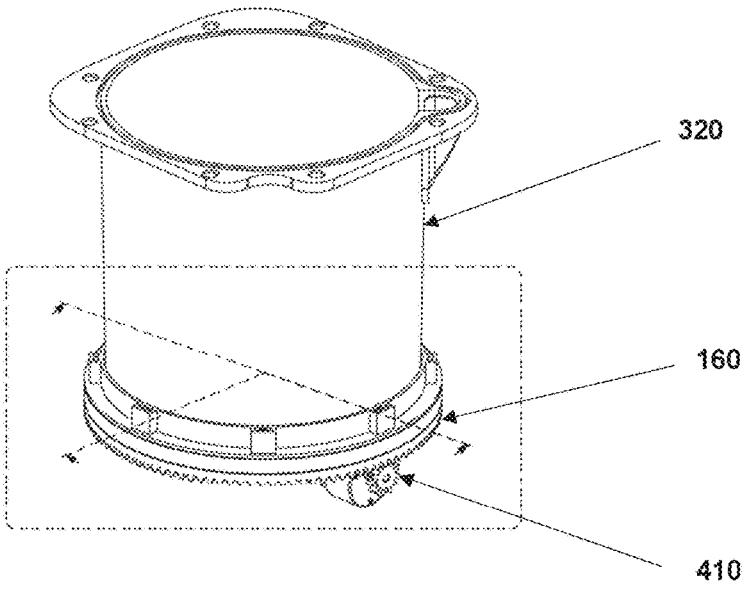
FIGS. 12A-12B—which present views of the device according to an embodiment employing a coaxial arrangement of magnets.

FIG. 12A presents a view of the device 200 where a coaxial arrangement of the magnets providing the magnetic coupling between the first rotating element 90 and the second rotating element 130 is employed. As illustrated in FIG. 12A, the device 200 has a basin element 320. As discussed above, the electric motor 150 drives a gear 410 which is mechanically connected to a gear 160 of the second rotating element 130. Rotation of the electric motor 150 therefore effects rotation of the gears 410, 160 and consequently the second rotating element 130.

Figure 12B:
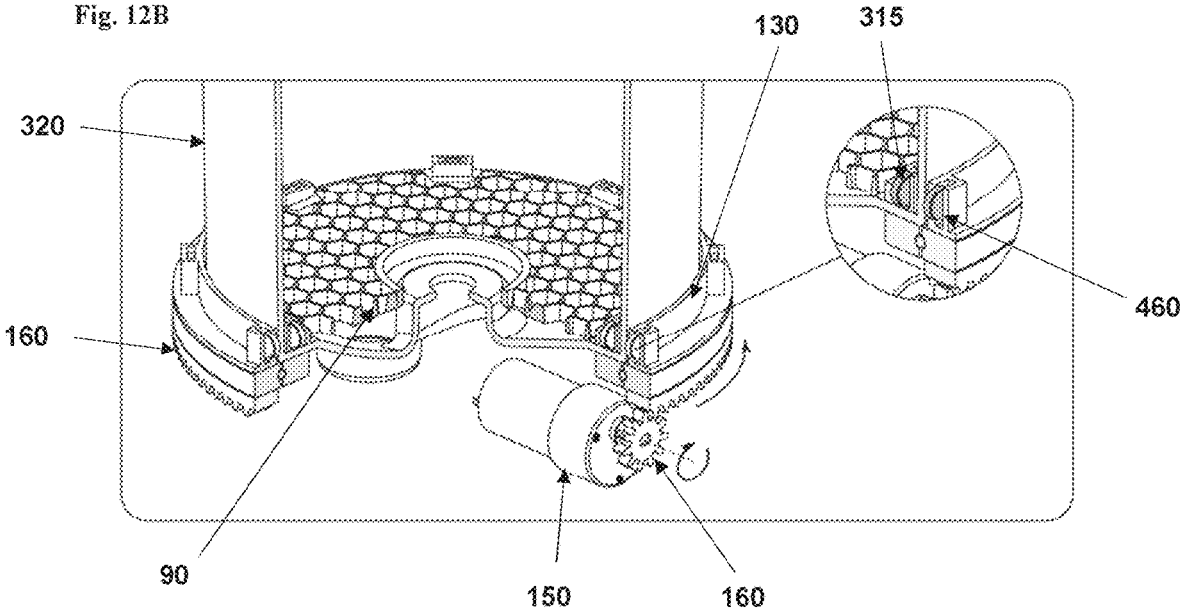

FIG. 12B shows a more detailed view of the device of FIG. 12A with the front-most section removed so that the magnetic coupling can be seen. As shown in FIG. 12B, the first rotating element 90 (here the turntable) is provided with a series of magnets 315 arranged at intervals around the circumference of the turntable 90. Disposed coaxially with respect to these magnets 315, the second rotating element 130 is provided with a set of magnets 415 at a greater radial displacement from the axis of rotation of the turntable 90. In this sense, the two sets are offset from each other in a horizontal plane (i.e., perpendicular to the axis of rotation).

Figure 13:
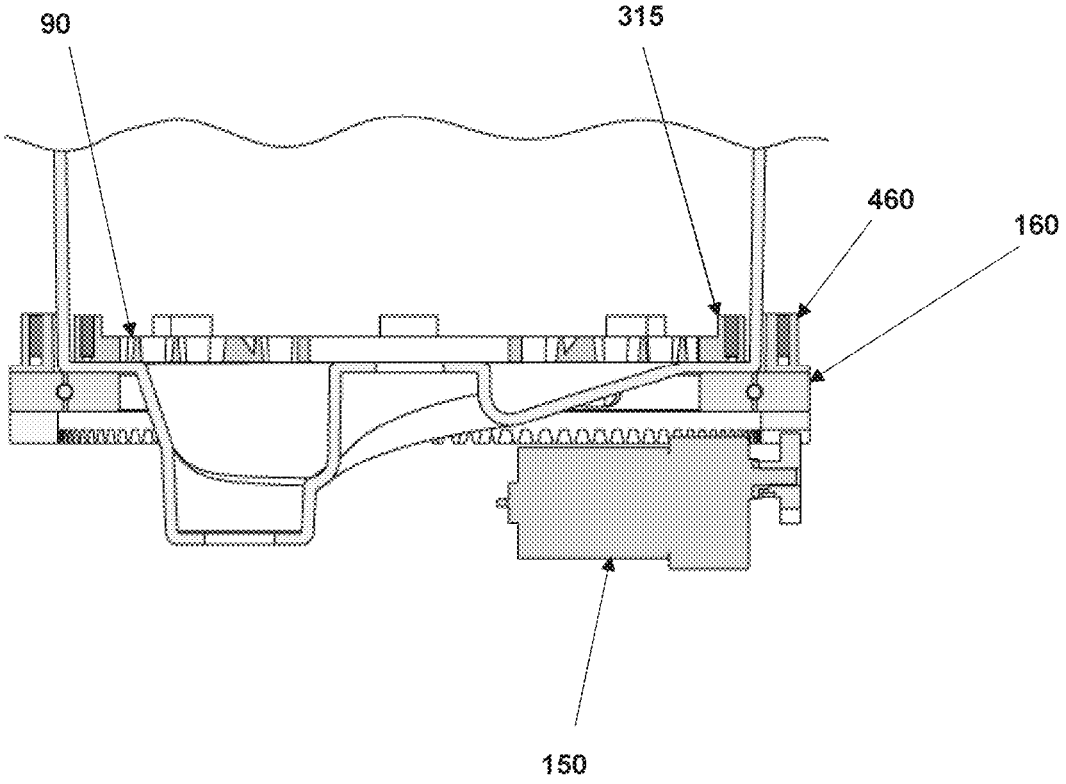
FIG. 13—which presents a cross-sectional view of the device according to the embodiment employing the coaxial arrangement of magnets.

FIG. 13 presents a cross-sectional view of the device 200 with the coaxial arrangement of magnets. In this view, it can again be seen that the two sets of magnets 315, 460 are offset from each other in a horizontal plane (i.e., coaxially). This allows the vertical height of the coupling region to be reduced since vertical space does not need to be provided to accommodate both sets of magnets one above the other.

Figure 14:
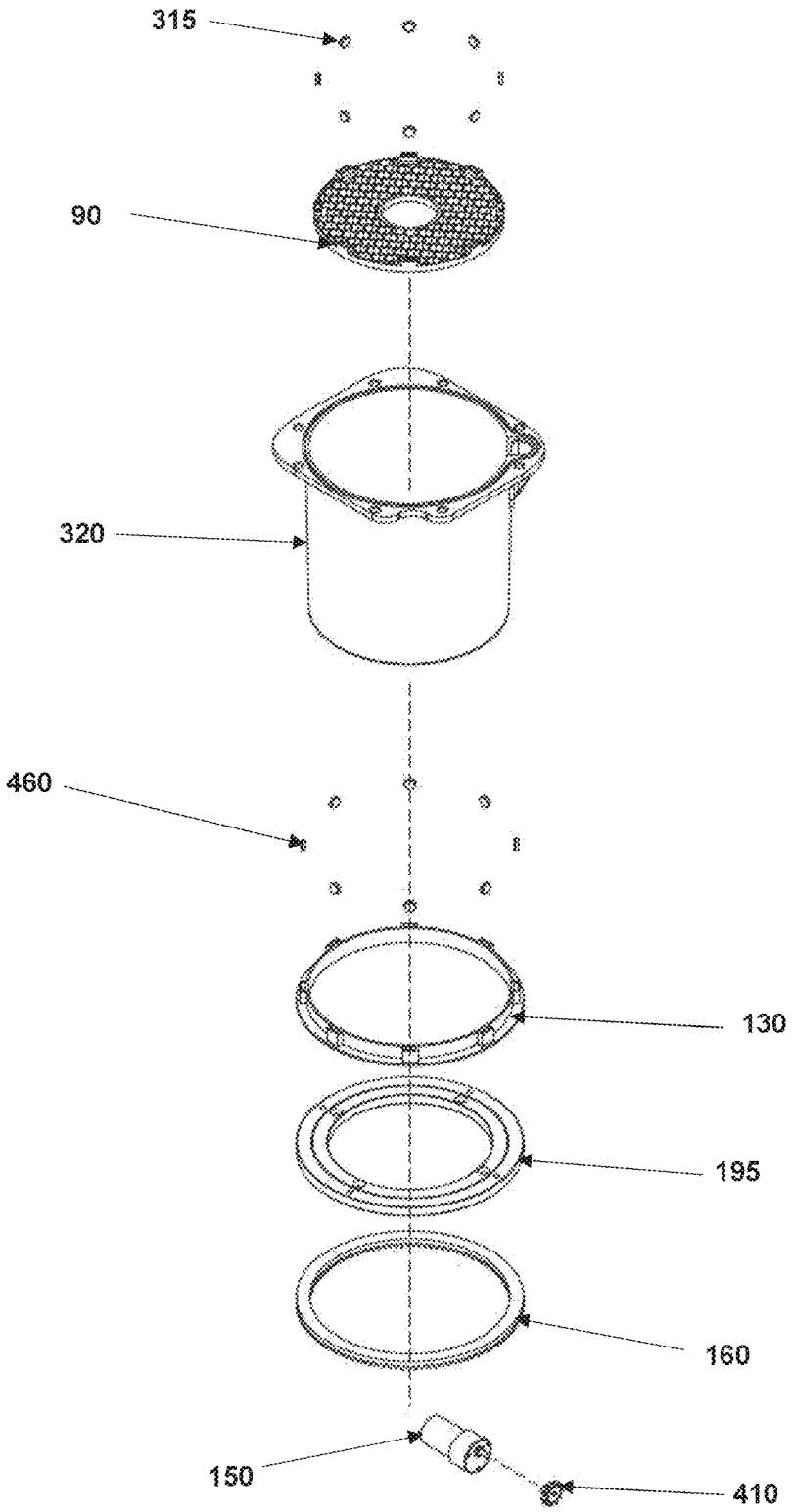
FIG. 14—which presents an expanded view of the device according to the embodiment employing the coaxial arrangement of magnets.

FIG. 14 presents an expanded view of the device 200 according to the embodiment employing the coaxial arrangement of magnets. As shown in FIG. 14, the turntable 90 is provided with a set of magnets 315 that oppose a set of magnets 460 positioned in the second rotating element 130 to form a magnetic coupling. The first and second rotating elements are arranged within a basin element 320. The second rotating element 130 is connected to a bearing 195 which permits rotation of the first and second rotating elements (and a receptacle) with respect to the rest of the device 200. An electric motor 150 is provided to drive rotation the gears 410, 160 so as to rotate the second rotating element 130 and drive rotation of the first rotating element 90.

Figure 15:
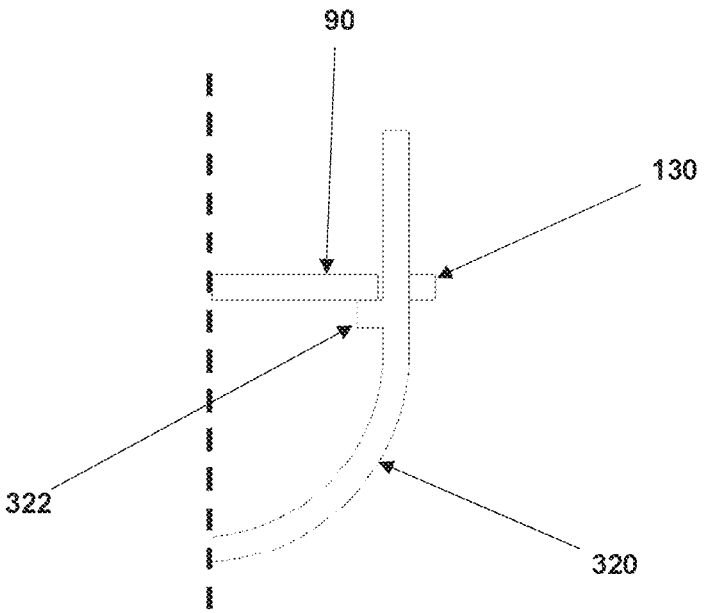
FIG. 15—which presents a cross-sectional view of the device according to the embodiment employing the coaxial arrangement of magnets.
Figure 16:
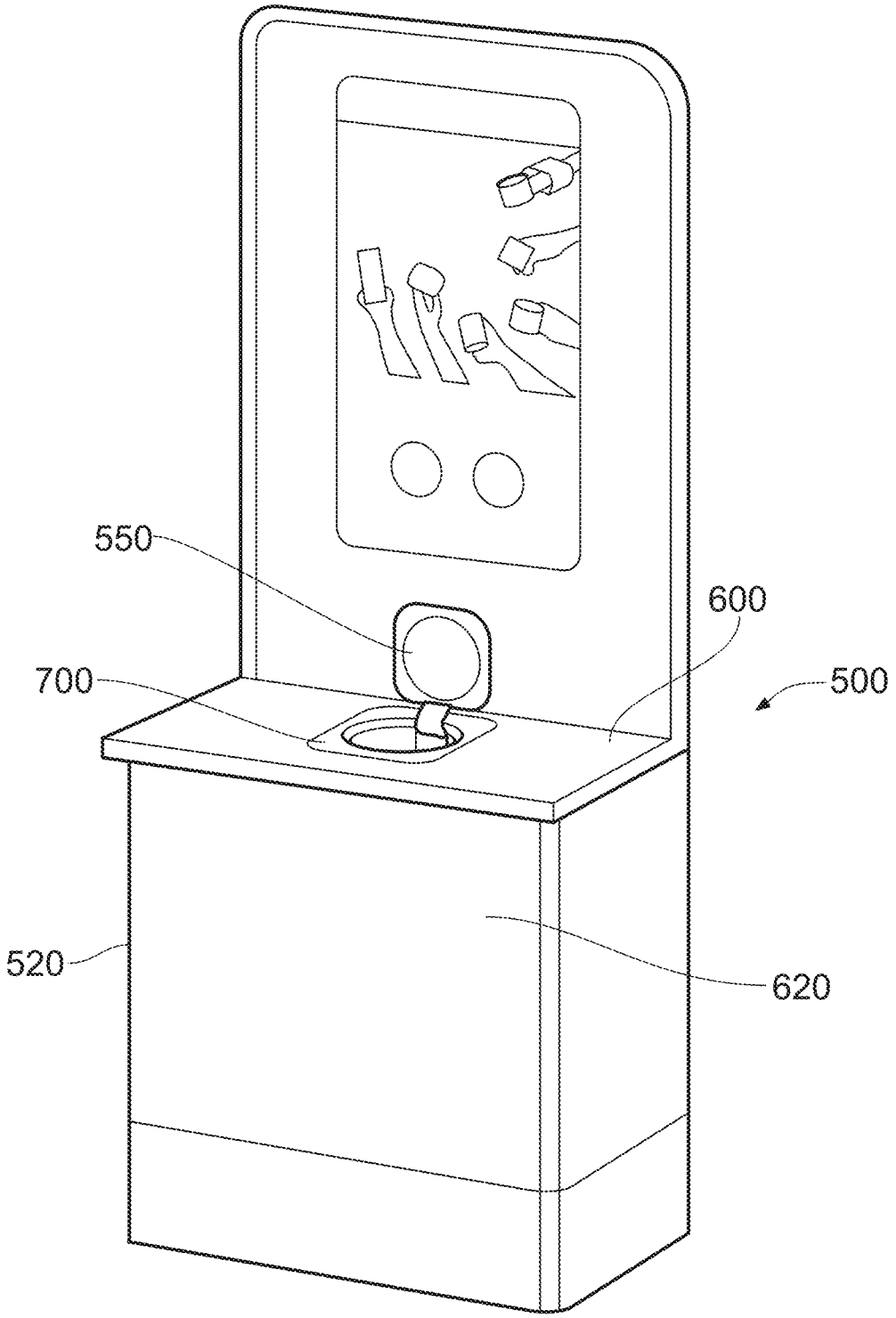
FIG. 16—which presents an illustration of the device in a housing.
Figure 17:
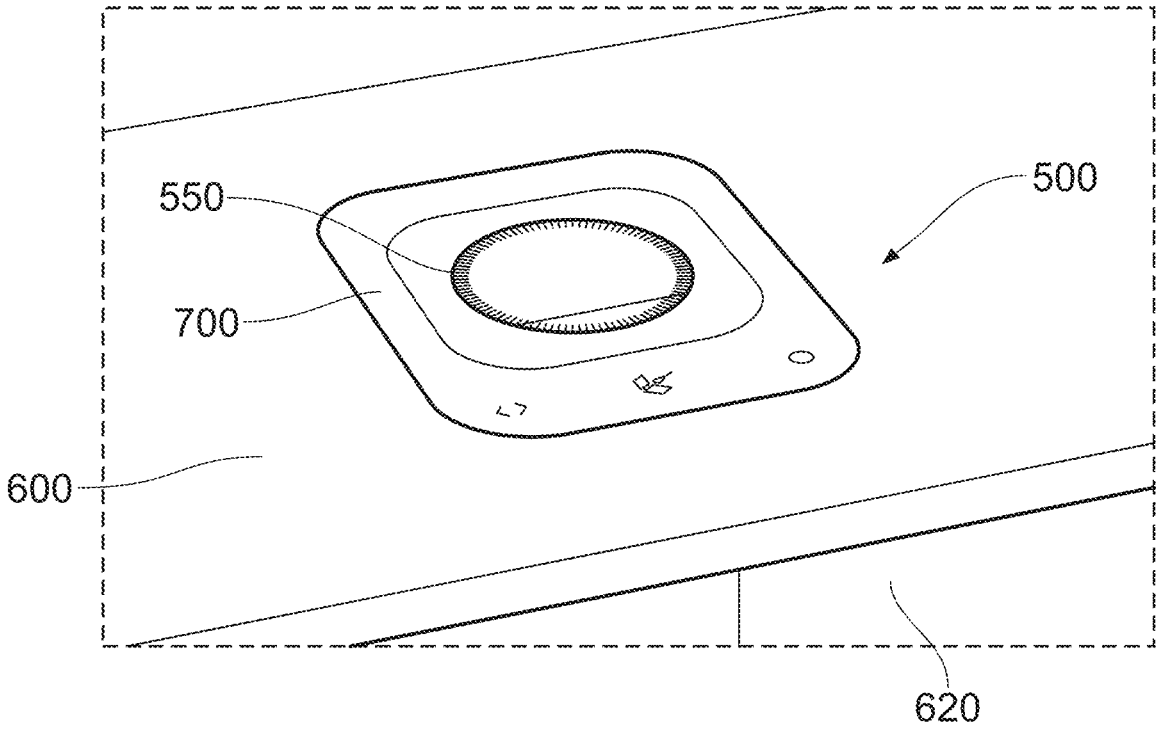
FIG. 17—which presents an illustration of the device contained in a housing, wherein the lid is in a closed position.
Figure 18:
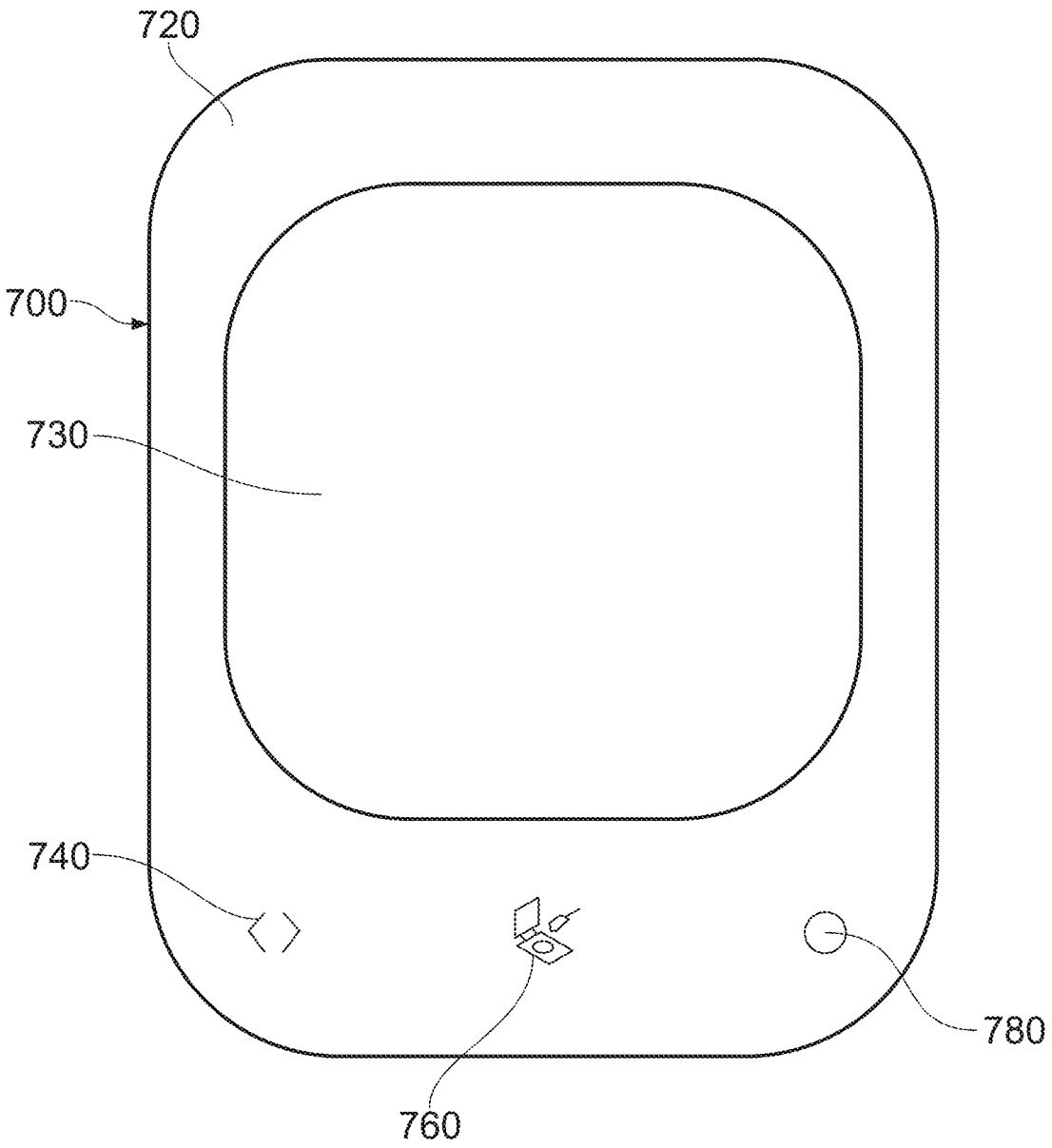
FIG. 18—which presents an illustration of part of the device that accommodates the lid of the device.
Figure 19:
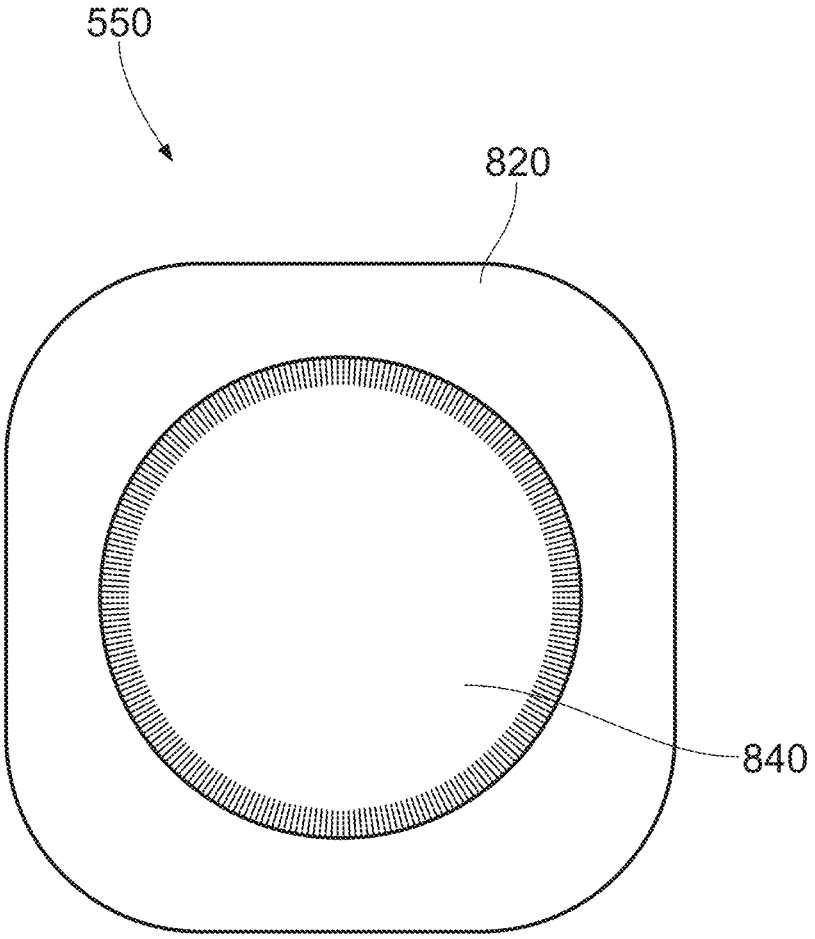
FIG. 19—which presents an illustration of part of the lid of the device.
Figure 20:
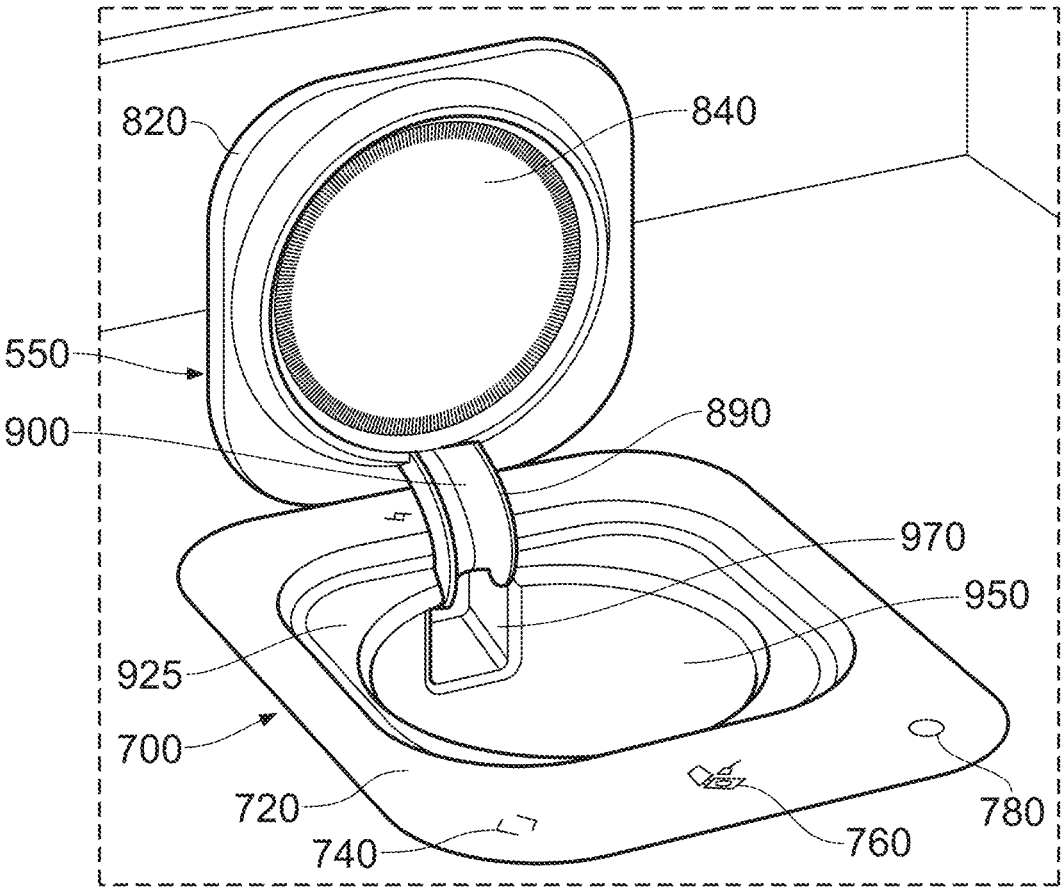
FIG. 20—which presents an illustration of the lid in an open position.

FIG. 15 presents a cross-sectional view of the device 200 according to the embodiment employing the coaxial arrangement of magnets. As shown in FIG. 15, the basin element 320 comprises a basin shelf 322 (also referred to as a support element) on which the turntable 90 is supported. The second rotating element 130, incorporating the set of magnets 460 is disposed outside the basin element 320 in a radial direction. Since the basin shelf 322 does not need to support the two sets of magnets being positioned with an offset in the axial (vertical) direction, a small basin shelf 322 can be used. This simplifies the design of the device, improves drainage and reduces the risk of blockages.

FIGS. 16 to 20 illustrate one or more of the following features of the device:

(a) a gutter for removal of condensation that may occur through use of the device; and/or
(b) a control unit that is responsive to user input to operate the device; and/or
(c) a surface that is substantially flush with a surface on or in which the device is mounted and/or wherein the device comprises a fluid path for removal of fluid during use of after use of the device; and/or
(d) a removable lid; and/or
(e) at least all or part of the device is contained within at least one housing.

In these embodiments, a housing 500 contains the device. The housing 500 has a housing unit 520. The housing until 520 can have an upper surface 600 and a lower part 620. In this design, the device includes a lid 550 and a lid receiving structure 700. When lowered to be within the lid receiving structure 700, the device lid 550 and the lid receiving structure 700 are substantially flush with the upper surface 600 thereby enabling the device to be easily cleaned. The lid receiving structure 700 releasably receives the lid 550 and in such a manner that there is no or very little degree of fluid egress between the lid receiving structure 700 and the lid 550 during use of the device.

The lid receiving structure 700 comprises an aperture 730 defined by surround 720. Aperture 730 releasably and snuggly accommodates the lid 550. Lid 550 has a surround portion 820 that defines an aperture into which is releasably mounted a glass cover 840. The glass cover 840 is removable for ease of cleaning and can be replaced.

The lid receiving structure 700 houses three user interface buttons. User interface button (A) 740 informs allows the user to cycle backwards and forwards throughout the program cycle. User interface button (B) 760 informs the user for the next steps when using the device. User interface button (C) 780 allows the user to operate the device.

The lid 550 is releasably mounted in recess 925 to form a snug fit. Recess 925 has a configuration to allow flow of liquid to the inner chamber.

The lid receiving structure 700 and the lid 550 are connected by means of a hinge 890. Hinge 890 has a gutter 900 along which any condensed water may flow when the lid 550 has opened. The water flows along gutter 900 into the chamber 950.

Chamber 950 has a gutter 970 that can act as a support for hinge 890.

In use, following steps are undertaken:

1. User presses button 780
2. Lid component 700 and lid component 800 open
3. User is prompted to place receptacle—for example a cup—in the chamber 950 by means of a display on button 760
4. User places receptacle-for example a cup in the chamber 950
5. User shuts lid component 700 and lid component 800
6. User presses button 780
7. The device then undergoes 1 or more wash cycles
8. Lid component 700 and lid component 800 open at end of the cycle(s)
9. User is prompted to remove receptacle—for example a cup—from the chamber 950 by means of a display on button 760
10. User removes receptacle
11. User is prompted to shut the lid component 700 and lid component 800 by means of a display on button 760.

Figure 24A:
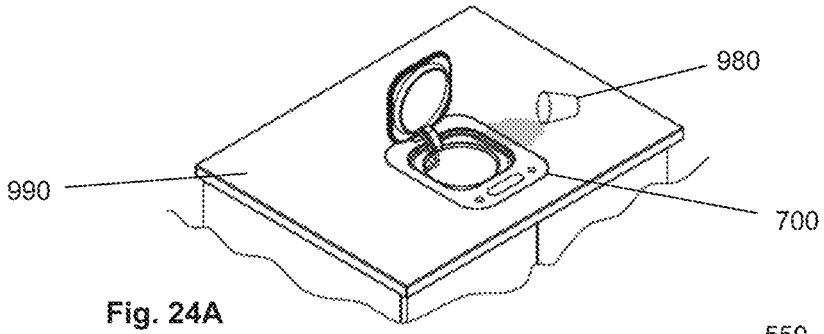
FIGS. 24A-24F—which present illustrations in which a portion of the device is mounted in a surface.
Figure 24B:
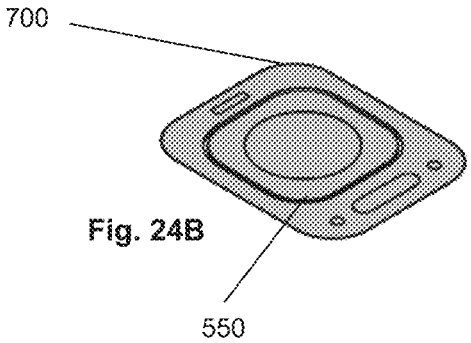
Figure 24C:
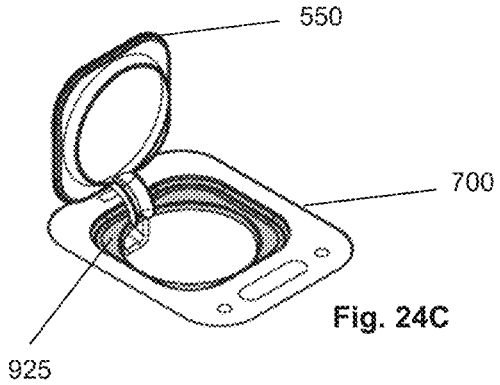
Figure 24D:
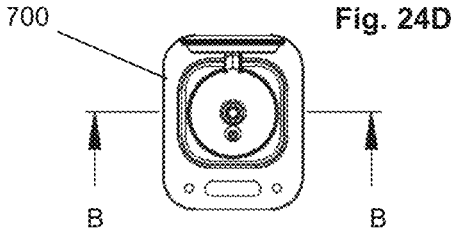
Figure 24E:
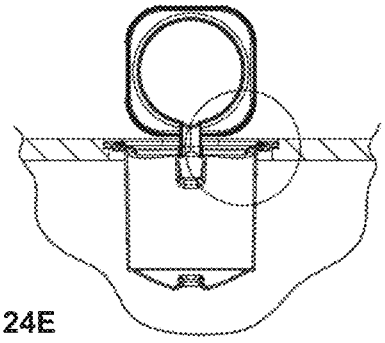
Figure 24F:
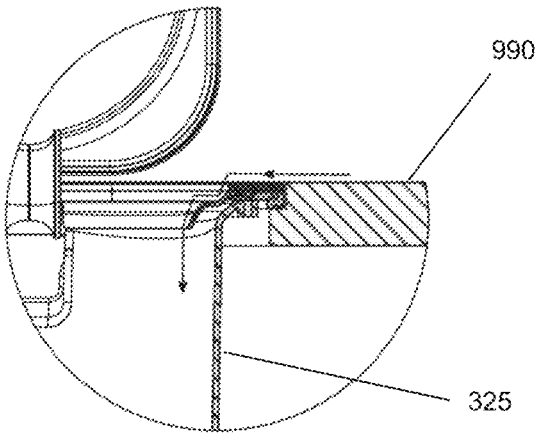
Figure 25A:
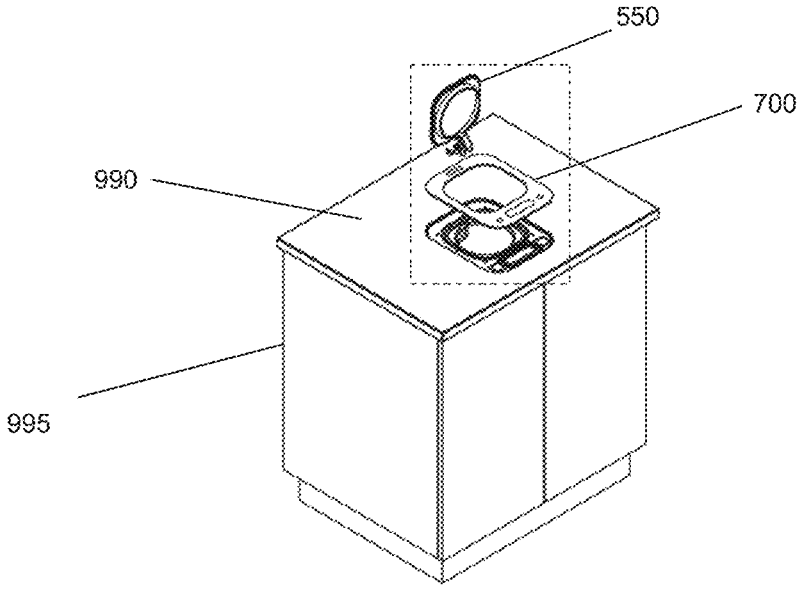
FIGS. 25A-25B—which present illustrations of a device with a removable lid and top surface.
Figure 25B:
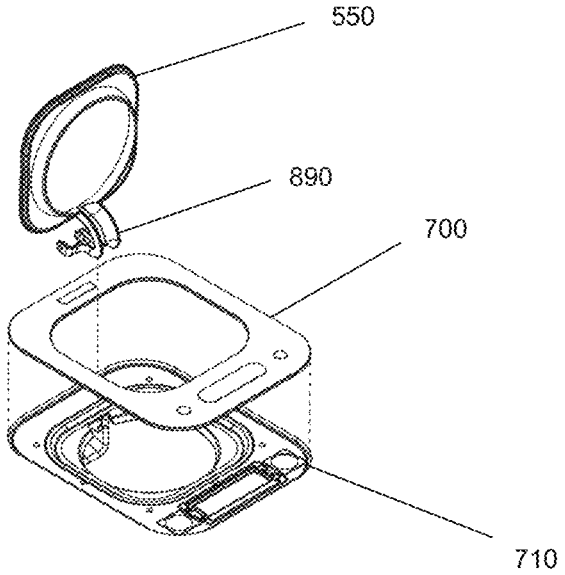
Figure 26A:
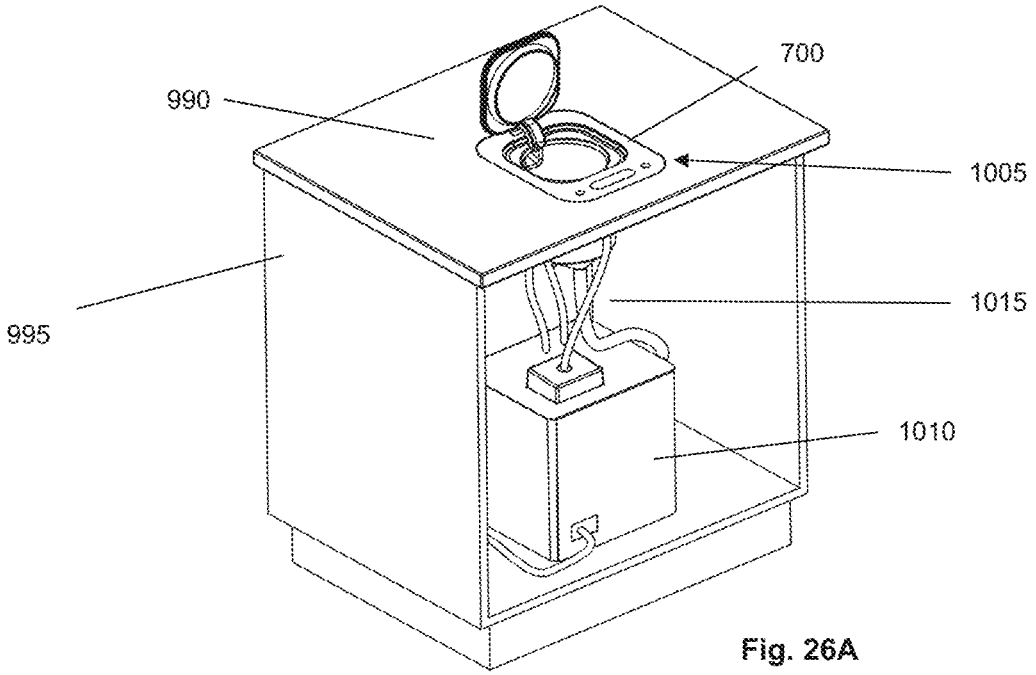
FIGS. 26A-26B—which present illustrations of the device arranged across a separate head unit and auxiliary unit.
Figure 26B:
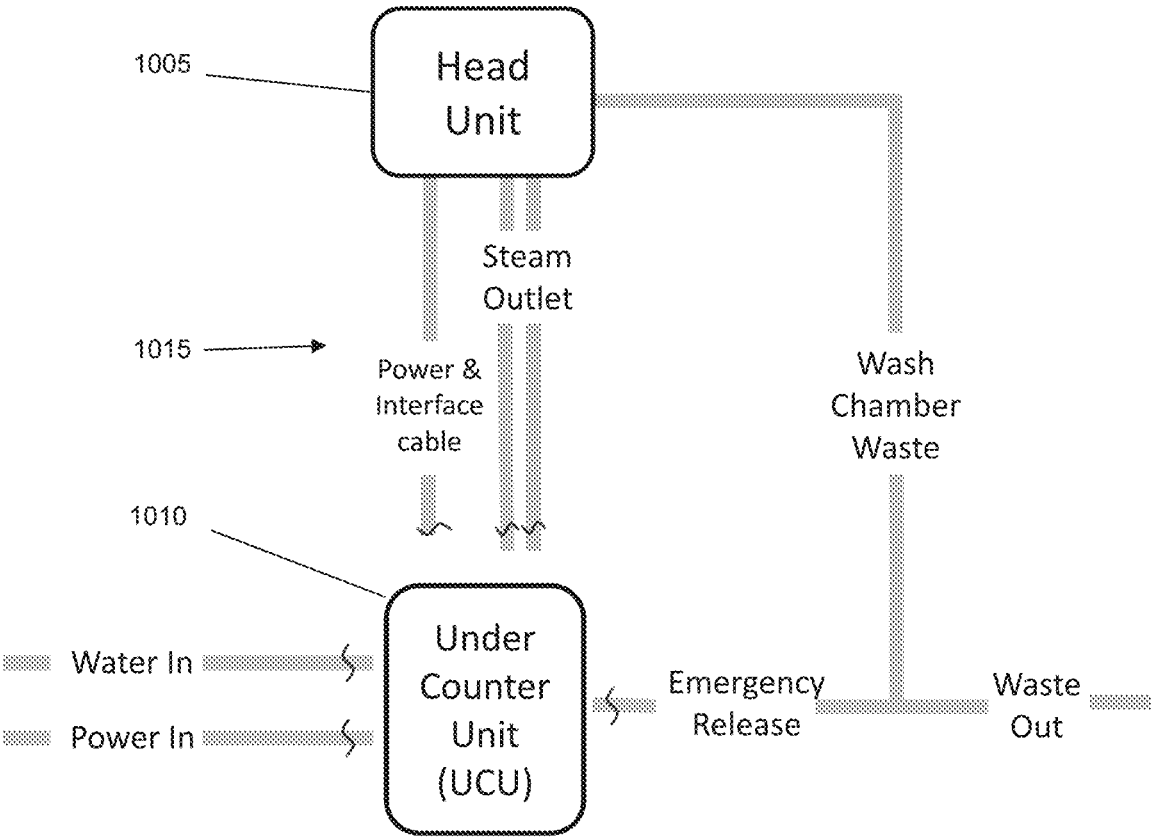

Features (a)-(e) are illustrated in more detail in FIGS. 21A-26B. While these features are described separately with respect to those figures, it should be appreciated that these features may be used in combination with each other. For example, the device arranged across a separate head unit and auxiliary unit as depicted in FIGS. 26A-26B may be mounted flush in or on a surface as described with respect to FIGS. 24A-24F and/or may have a removable/replaceable lid/top surface as described with respect to FIGS. 25A-25B. Further, these features may in some examples be implemented in a device which does not employ rotation of the receptacle. Instead, for example, these features may implemented in a device with a rotating nozzle in which the receptacle is kept stationary and/or in a device with a stationary nozzle and stationary receptacle.

FIGS. 21A-21D show an illustration of a device in which there is a gutter 900 arranged to channel fluid. In use, a receptacle washing cycle will be run with the lid 550 in a closed position so as to prevent the egress of the cleaning medium (e.g., steam or water) from the device. During the washing cycle therefore, fluid may build up on the bottom surface of the lid 550, for example in the form of the cleaning medium itself or condensation formed as a result of a steam cleaning medium being used. Unless directed elsewhere, when the lid 550 is later opened at the end of the receptacle washing cycle, the fluid may drain off the lid 550 and onto a top surface 700 of the device or a surrounding surface. This escaped fluid may then pool or flow across neighbouring surfaces.

In some examples, the lid comprises a glass cover 840 to enable a user to visually monitor the progress of the washing cycle. However, the use of such a glass cover 840 may encourage condensation of steam present within a chamber 950 of the device on the glass cover 840 and therefore exacerbate the above-described problem of fluid accumulating outside of the device.

Figure 21B:
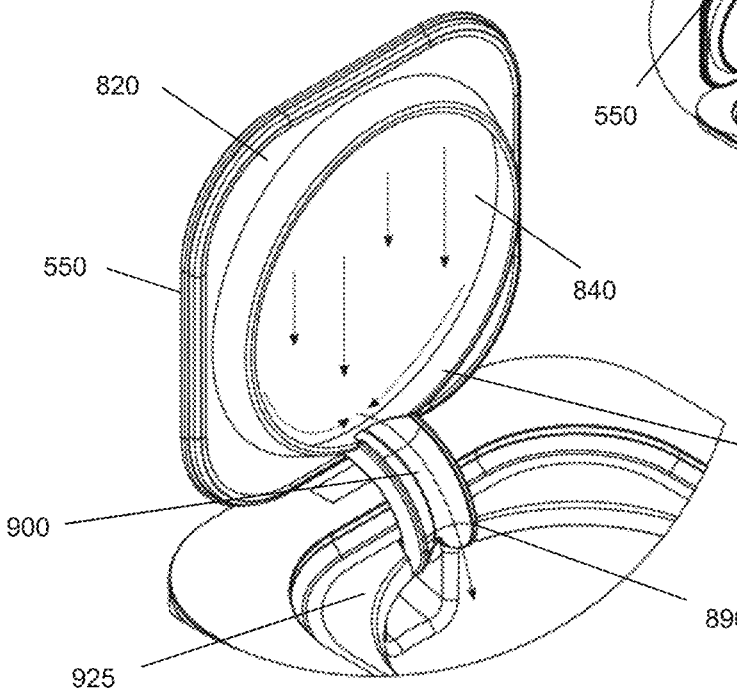
FIGS. 21A-21D—which present illustrations of the device with a gutter to channel fluid.
Figure 21A:
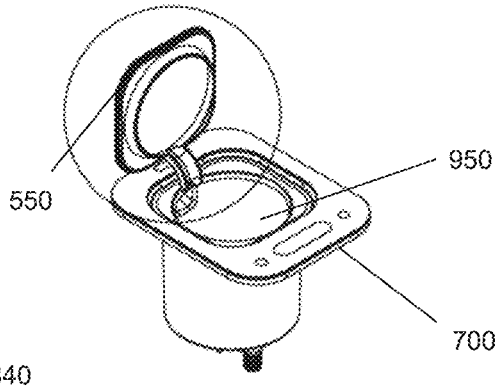

FIG. 21A shows an example of a device in which a gutter 900 is provided to channel fluid from the lid 550 back into the chamber 950. This gutter 900 is shown in more detail in FIG. 21B. As illustrated, the lid 500 is connected to the rest of the device (e.g., a receiving component of the device) by a hinge 890 which allows the lid 550 to move between an open position (as illustrated in FIG. 21B) in which access to the chamber 950 is provided and a closed position (as illustrated in FIG. 24B) in which a receptacle can be enclosed in the chamber 950. Formed in the hinge 890 is a gutter 900. The gutter 900 is formed as a channel or groove within the hinge and is arranged such that water accumulating on the lid 550 is directed into the chamber 950 rather than allowing the fluid to drip off the lid 550 and onto a top surface 700 of the device.

The device shown in FIG. 21B has a glass cover 840 formed within a surround 820 of the lid 550 to allow a user to visually inspect the contents of the chamber 950. The surround 820 is shaped so as to provide a lip 850 which directs fluid from the glass cover 840 to a mouth of the gutter 900.

Figure 21D:
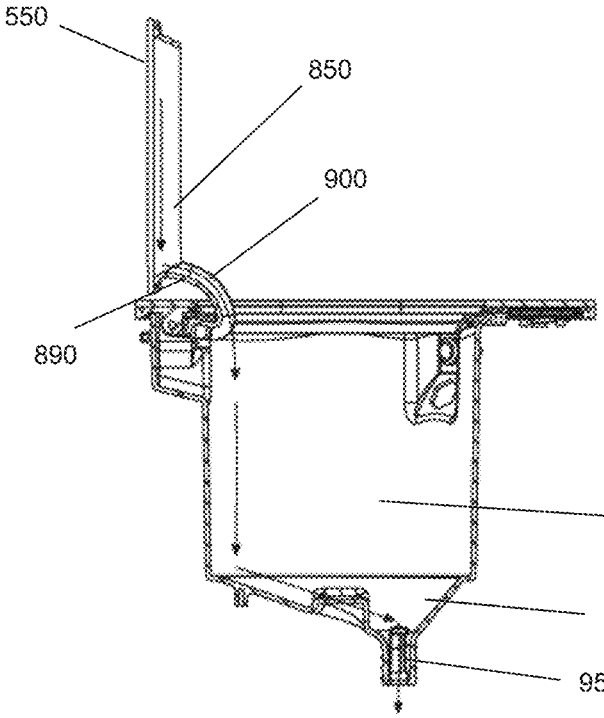
Figure 21C:
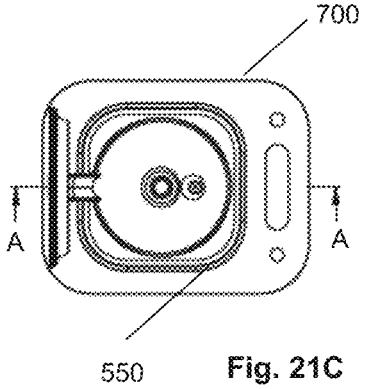

FIG. 21D shows a cross-section of the device, taken along the line A-A shown in FIG. 21C. FIG. 21D illustrates with arrows a fluid path provided by the device for channelling fluid from the lid 550 into the gutter 900 and from the gutter 900 into the chamber 950 of the device. By directing the fluid into the chamber 950 as shown, the device is able to reduce the amount of fluid accumulating outside of the device.

From the chamber 950, the fluid may be expelled via a drain 97, through a drain outlet 95 and expelled as waste.

Figure 22:
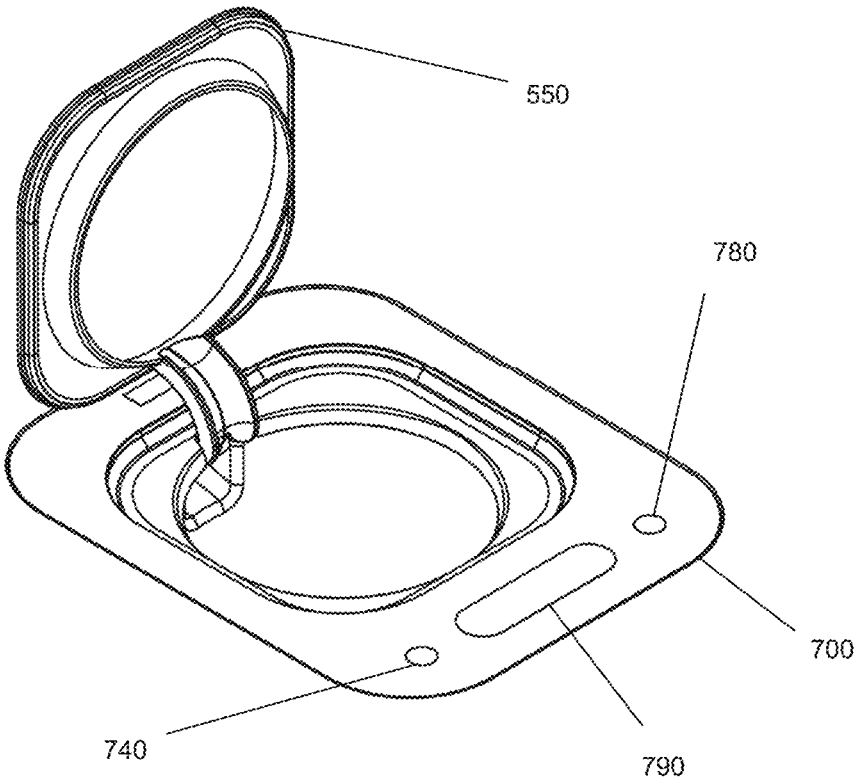
FIG. 22—which presents an illustration of a user interface of the device.

FIG. 22 presents an illustration of a user interface of the device according to an example. As shown in FIG. 22, a top surface 700 of the device is provided with a user interface button (A) 740, a user interface button (C) 780, and a screen 790. It will be appreciated that other forms of user interface with more or fewer interface elements may also be used. However, in this example, only two user interface buttons, 740, 780 are provided, where user interface button (A) 740 corresponds to a selection button and user interface button (C) 780 corresponds to an action button. The screen 790 is provided to enable communication of a device state to the user and/or to present a currently selected receptacle washing cycle to the user. In this way, the user interface provides a simple and intuitive means to operate the device.

Figure 23:
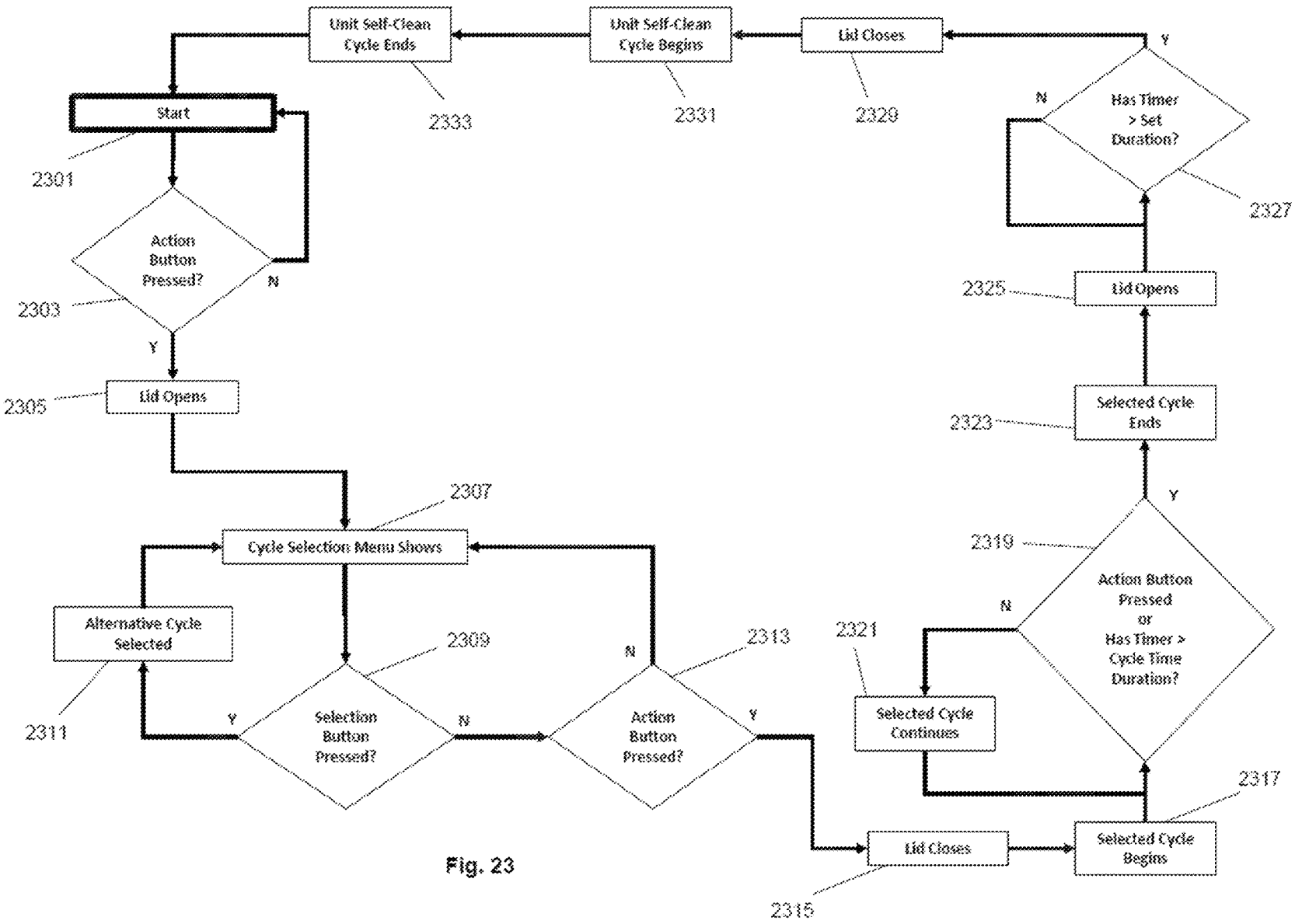
FIG. 23—which presents a flowchart showing control flow of the device.

FIG. 23 is flowchart illustrating control flow of the device as implemented by a control unit of the device. As illustrated, the flow starts at step 2301 at which point the lid is in an initial closed position. When the action button is pressed at step 2303, flow proceeds to 2305 where the lid is opened. In some examples, the lid opens automatically (e.g., as a result of the device releasing a latch holding the lid closed and allowing a spring mechanism to open the lid). In some examples however, the control unit is responsive to the action button being pressed to unlock the lid to allow the user to open the lid. In this case, opening of the lid is performed by the user themselves.

With the lid in the open position, access is provided to the chamber 950 of the device to enable the user to place a receptacle to be cleaned inside the device.

A cycle selection menu is shown at step 2307 using the screen 790. The user is able to select a desired cycle using the selection button to iterate through available cycles and the action button to select a desired cycle as illustrated in blocks 2309, 2311, and 2313.

Once the action button has been pressed at step 2313 to select a cycle, the lid closes at step 2315. The lid may be closed by the user (e.g., in response to a prompt displayed via the screen 790) or in some examples, the device is provided with a lid closing mechanism and the lid is closed automatically on selection of a receptacle washing cycle. In either case, however, the selected cycle 2317 does not begin until the lid has closed in order to prevent cleaning fluid being expelled from the device.

In some examples, the lid may be closed in advance of either the cycle selection menu being shown at step 2307 or the selection of the cycle being made. In yet further examples, step 2313 in which the action button is pressed to confirm the user's selection and begin the cycle may be omitted and closing of the lid by the user at step 2315 may instead be taken as an indication to begin a washing cycle. In this case, closing of the lid by the user may represent a user input in response to which the cycle is initiated.

The selected cycle continues at step 2321 until either a cycle time duration has elapsed or until the user presses the action button to halt the cycle, as shown in step 2319. Once the cycle ends at step 2323, the lid opens at step 2325 to provide the user access to the cleaned receptacle. At this point, the user can retrieve their cleaned receptacle from the chamber 950 of the device.

At this point, the user's interaction with the device may conclude. The control unit may then initiate a self-clean cycle In some examples, the self-clean cycle is performed after each washing cycle; however, the self-clean cycle may be triggered after a predetermined number of cleaning cycles have been performed, in response to user input initiating the self-clean cycle, or in response to detecting that the device has not been used for a certain period of time.

Once the control unit has determined to perform the self-clean cycle at step 2327, the lid is closed at step 2329. Again, closing the lid may be performed automatically using a lid closing mechanism or the control unit may be configured to request that a user closes the lid (e.g., by displaying a message on the screen 790). The self-clean cycle then begins at 2331 and ends at step 2333. At this point, the device is again in its initial state.

With this approach therefore, the device requires only a single instance of user input to allow the lid to open from its closed position and only a single instance of user input to initiate the receptacle washing cycle. Thus, starting from the initial state the user can initiate the receptacle washing cycle using only two instances of user input. This approach therefore provides a simple interface allowing a user to quickly and intuitively control the device.

FIGS. 24A-24F present illustrations of a device mounted within a surface 990. The surface 990 may for example be a counter-top, table-top or bar-top. As shown in FIG. 24A, the device is mounted such that the top surface 700 of the device is flush with the top of the surface 990. By arranging the device in this way, the device can be cleaned easily. This is illustrated in FIGS. 24A and 24B in which a cup 980 that has spilled is depicted whereby the liquid has spilled across the device. With the device having a flat top surface that is flush with the surface in which the device is mounted, the entire top portion of the device (as shown in grey in FIG. 24B) can be wiped clean.

In some examples, to further aid cleaning of the device, a fluid path is provided that allows fluid to flow from the surface 990 into the chamber 950 of the device, even when the lid 550 is in a closed position. FIG. 24F shows an enlarged cross-section of the portion of the device indicated in FIG. 24E, the cross-section taken along the line B-B shown in FIG. 24D. The arrows in FIG. 24F show a fluid path from the surface 990 in which the device is mounted such that any fluid approaching the edge of the device where the lid 550 meets the lid receiving structure 700 may pass over a lip formed at this edge and into the chamber 950 of the device. Hence, any fluid on the top surface of the device or on the surface of 980 may be directed to the device and allowed to flow into the chamber 950 via the inner recess 925 allowing the surfaces to be cleaned more easily.

FIG. 25A shows an example implementation of the device in which the device (or a part thereof) is mounted in the top surface 990 of a cabinet 995. The cabinet 995 may be situated within a coffee shop environment, work environment, home environment or conference environment for example. As shown in in more detail in FIG. 25B, the device comprises a mounting assembly 710 which is mounted within the surface 990 (e.g., using screws, nails, or clips). To this mounting assembly 710 may be attached a top surface 700 which acts as a lid receiving structure in which the lid 550 fits when in the closed position to enclose the chamber 950. The top surface 700 and/or the lid 550 are attached removably to the mounting assembly 710. For example, the top surface 700 and/or the lid 550 may be connected to the mounting assembly 710 using one or more clips or screws, for example. Regardless of the particular form of removable mounting used, the top surface 700 and/or the lid 550 are arranged such that they can be easily removed from the mounting assembly 710 and replaced. The lid 550 and the top surface 700 are both exposed when in use and thus are more susceptible to damage. Additionally, any defects in those components are more noticeable are these components are visible to the user. It may therefore be desired to replace these components separately from the rest of the device in order to fix any such defects or as part of a regular maintenance schedule, such replacement being made more convenient by the use of the above-described removable attachment.

FIGS. 26A-26B show a device for cleaning a receptacle in which the device is arranged as a split system with a head unit 1005 including the components that the user interacts with and an auxiliary unit 1010 (which may be an under counter unit) containing at least a cleaning medium provision apparatus (e.g., a steam generation apparatus). By arranging the device as a split system in this way, the head unit 1005 can be situated separately from the auxiliary unit 1010 providing flexibility as to the arrangement of the device, especially where space for the device is constrained. As shown in FIG. 26A, the head unit 1005 may be arranged within a surface 990 of a cabinet 995 with the auxiliary unit 1010 positioned within the cabinet 995 such that the auxiliary unit 1010 is hidden from view when a front panel or door (not shown) of the cabinet 995 in in place. As shown, the head unit 1005 and the auxiliary unit 1010 are connected via conduits. These conduits may comprise a power and interface cable, one or more steam outlets for the provision of steam (or other cleaning medium) to the head unit 1005 and the return of excess steam to the auxiliary unit 1010. Additionally a waste path may be provided form the head unit 1005 which may be directed via the auxiliary unit 1010 or may be expelled directly to waste. The auxiliary unit 1010 may be provided with a water supply and power supply and may also have a connection to expel (e.g., as an emergency release).

Figure 28A:
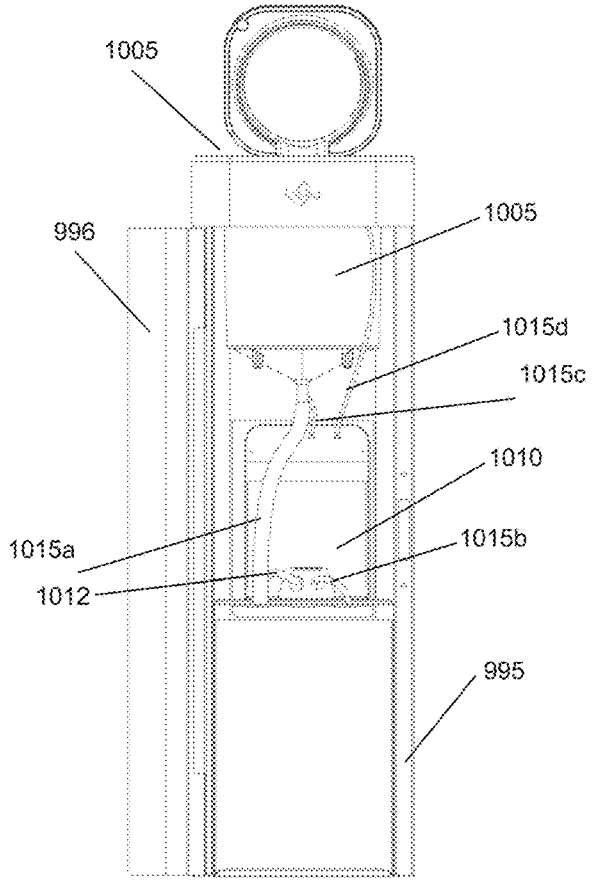
FIGS. 28A-28B—which present illustrations of the device installed in the cabinet with the cabinet door open.
Figure 28B:
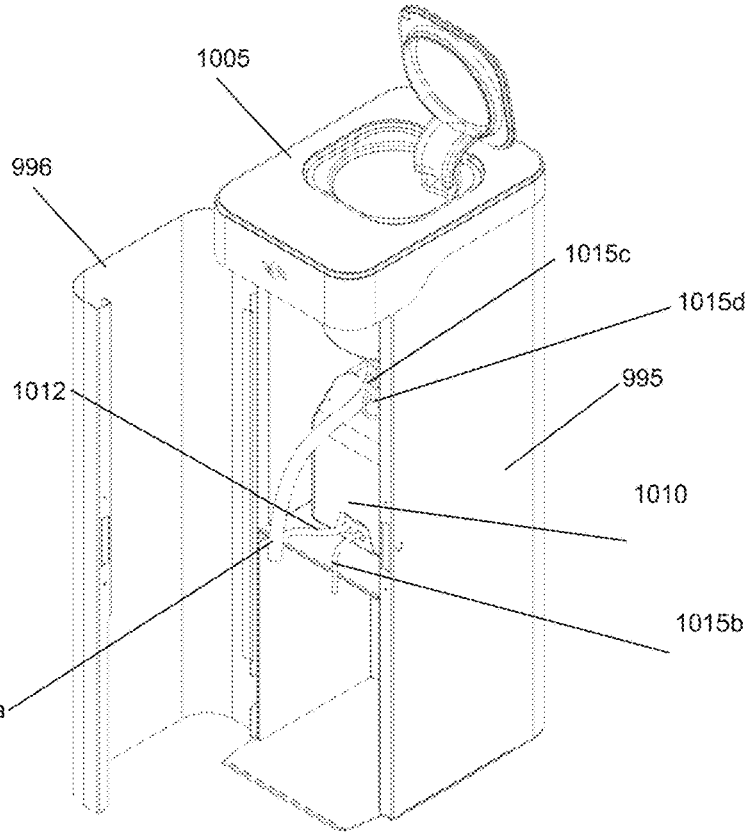
Figure 29:
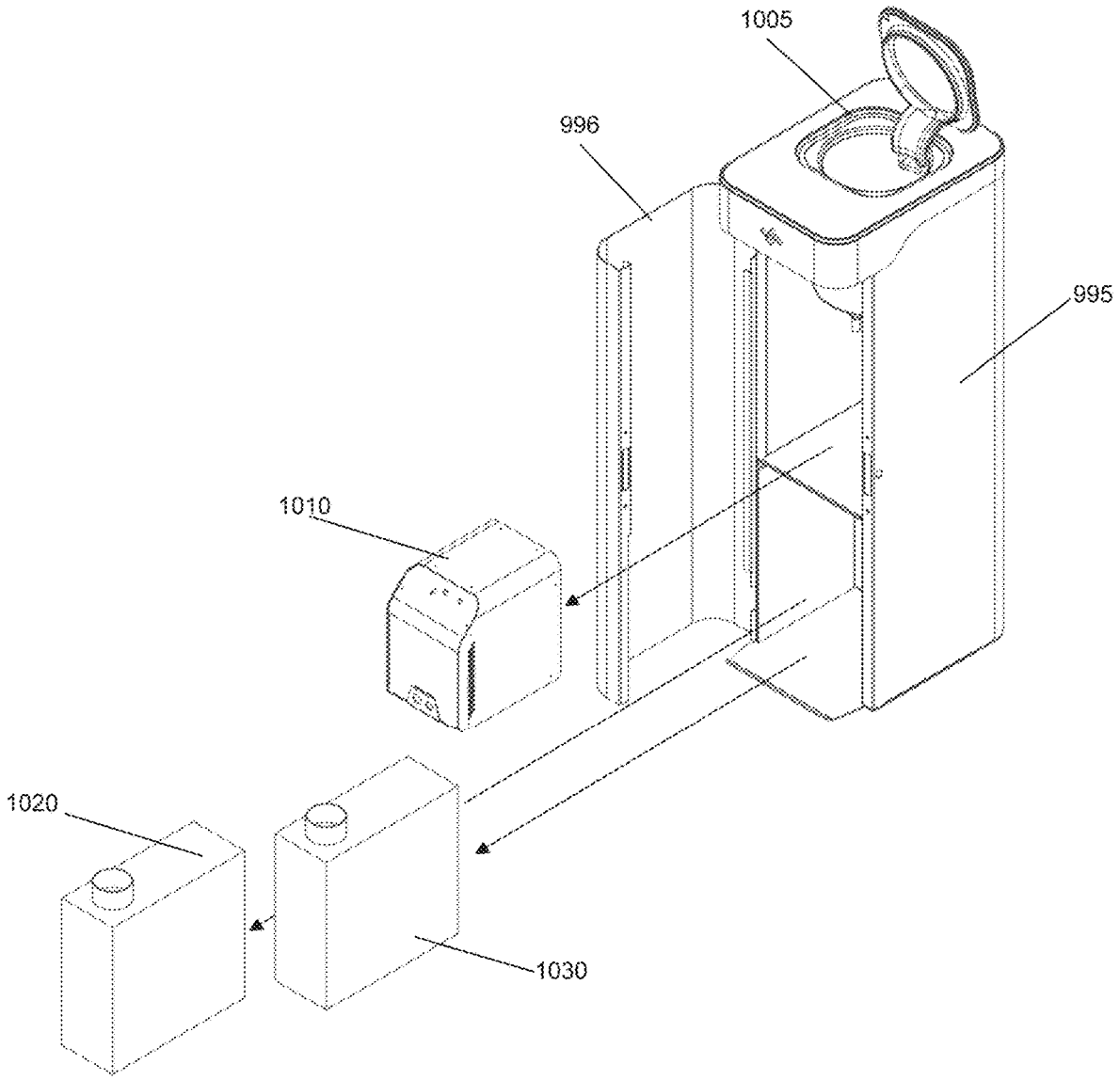
FIG. 29—which presents an illustration of an exploded view of the device installed in the cabinet with the cabinet door open.

FIGS. 27 to 29 show an alternative embodiment of the invention. Features with corresponding reference numbers correspond to those discussed previously. It should be appreciated that the features discussed with respect to these figures may be used in combination with the features discussed previously. For example, unless otherwise indicated, the features of the device discussed with respect to FIGS. 1 to 26 correspond to the features of the device shown in FIGS. 27 to 29.

Figure 27A:
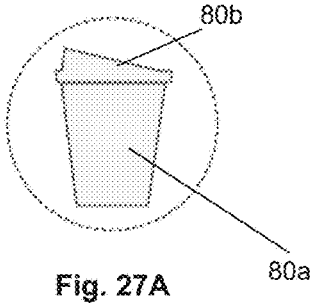
FIGS. 27A-27C—which present illustrations of an alternative configuration of the device.
Figure 27B:
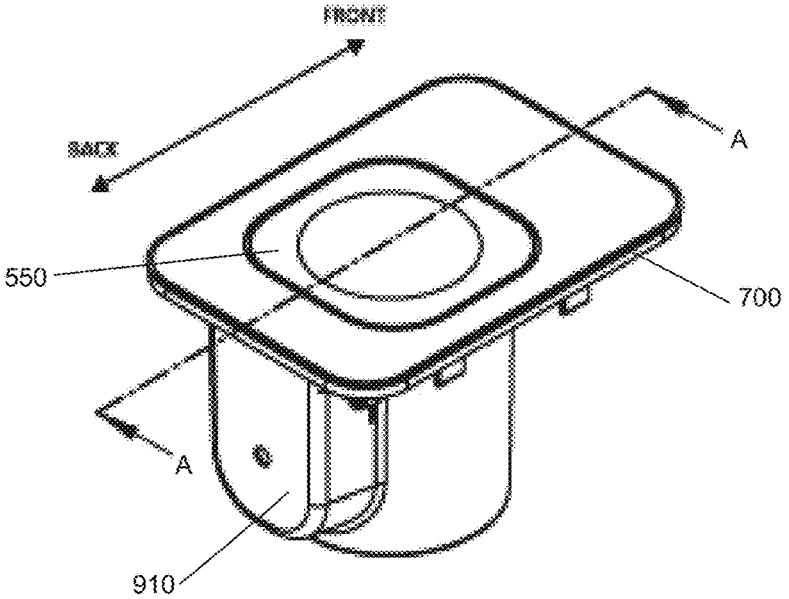
Figure 27C:
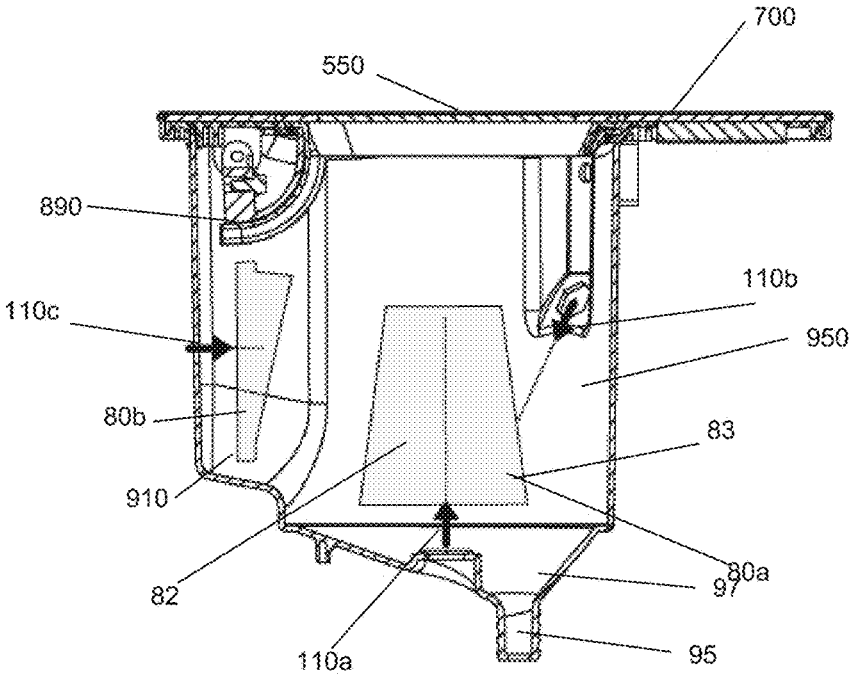

As shown in FIG. 27A, the receptacle 80 in this embodiment comprises a base portion 80*a* and lid portion 80*b*. FIG. 27B shows a perspective view of the device installed in the lid receiving structure 700. FIG. 27C shows a cross-section of the device, taken along the line A-A shown in FIG. 27B.

As is shown in FIG. 27C, when the lid 550 is in the closed position, the hinge 890 is received inside in the device. As can be seen from both FIGS. 27B and 27C, the device comprises a receptacle lid receiving portion 910 located below the hinge 890. The lid portion 80*b* of the receptacle is configured to be placed inside the receptacle lid receiving portion 910 as shown in this figure. In this way, the receiving component comprises a first portion for receiving and holding the base portion 80*a* of the receptacle and a second portion, the receptacle lid receiving portion 910, for receiving and holding the lid portion 80*b*. The lid portion 80*b* is held in place in the receptacle lid receiving portion 910 by a retaining feature (not shown). The retaining feature may be a clip or protrusion or another type of retaining feature. The lid portion 80*b* is shown located in the receptacle lid receiving portion 910 with the bottom or inside of the lid portion 80*b* facing outwards however the retaining feature may also be able to hold the lid with the bottom of the lid portion facing inwards. The device of the present embodiment comprises three nozzles: a first nozzle 110*a*, a second nozzle 110*b* and a third nozzle 110*c*. Although not shown in FIG. 27C, these are positioned in the locations indicated by the arrows. The pathway of fluid from each of the nozzles is shown in FIG. 27C.

The first nozzle 110*a* corresponds to the cleaning element 110 discussed previously. The first nozzle 110*a* is located in the interior space 82 of the receptacle base portion 80*a*. The first nozzle 110*a* is configured to face all of the surface of at least a part of the interior wall 83 of the receptacle 80 on rotation of the receptacle 80 about its central axis by turntable 90 (shown in FIG. 6)—thereby allowing the cleaning thereof by the cleaning medium such as steam (not shown) that exits the end of the first nozzle 110*a*.

The second nozzle 110*b* is configured to clean the exterior of the base portion 80*a* of the receptacle 80. This is done by injecting the cleaning medium such as steam at the side of the base portion 80*a*. As the receptacle 80 is rotated about its central axis by turntable 90, the entirety of the exterior of the base portion 80*a* is cleaned.

The third nozzle 110*c* is located inside the receptacle lid receiving portion 910. When the lid portion 80*b* is located in receptacle lid receiving portion 910 as shown in FIG. 27C, the third nozzle may be used to clean the lid portion 80*b* of the receptacle 80. This is done by injecting the cleaning medium such as steam into the lid portion 80*b*.

Each of first, second and third nozzles 110*a*, 110*b* and 110*c* are connected to respective conduits (not shown in this figure). Each conduit may be connected to a valve in the cleaning medium provision apparatus 1010 (not shown in this figure). In this way, the provision of cleaning medium such as steam to each of the nozzles can be controlled. For example, the user may be able to select whether to clean the inside/outside of the base portion 80*a* of the receptacle and the lid portion 80*b*. If the user has not put a lid into the device, the user may chose not to activate the third nozzle 110*c*. Alternatively, a sensor may be located in the receptacle lid receiving portion 910. When the lid portion 80*b* is detected, the third nozzle may be activated upon activation of the device. When the lid portion 80*b* is not detected (for example because the receptacle being cleaned does not have a lid or the lid does not require cleaning), the third nozzle 110*c* may not be activated. Alternatively, a single inlet conduit may be connected to the cleaning medium provision apparatus 1010 which is then split with a divider for feeding into the respective nozzles. When this configuration is used, separate valves may be positioned on each split conduit to control flow to the respective nozzles.

Although this figure shows three nozzles, only one or two may be used. For example, any combination of the first, second and third nozzles 110*a*, 110*b* and 110*c* may be installed in the device. Specifically the device may comprise the first and third nozzle 110*a*, 110*c* but not the second nozzle 110*b*.

FIGS. 28A and 28B show the device installed inside a cabinet 995 arranged across a separate head unit 1005 and auxiliary unit 1010. The device arranged across a separate head unit and auxiliary unit as depicted in FIGS. 28A-28B may be mounted flush in or on a surface as described with respect to FIGS. 24A-24F and/or may have a removable/replaceable lid/top surface as described with respect to FIGS. 25A-25B. Further, these features may in some examples be implemented in a device which does not employ rotation of the receptacle. Instead, for example, these features may implemented in a device with a rotating nozzle in which the receptacle is kept stationary and/or in a device with a stationary nozzle and stationary receptacle.

As discussed with respect to FIGS. 26A-26B, the head unit 1005 includes the components that the user interacts with and the auxiliary unit 1010 contains at least the cleaning medium provision apparatus (e.g., a steam generation apparatus). By arranging the device as a split system in this way, the head unit 1005 can be situated separately from the auxiliary unit 1010 providing flexibility as to the arrangement of the device, especially where space for the device is constrained. As shown, the head unit 1005 may be arranged within the surface 990 of cabinet 995 with the auxiliary unit 1010 positioned within the cabinet 995 such that the auxiliary unit 1010 is hidden from view when a front panel or door 996 of the cabinet 995 in in place. As shown, the head unit 1005 and the auxiliary unit 1010 are connected via conduits 1015. A drain hose 1015*a* extends from the bottom of the auxiliary unit 1005 and connects to a waste tank (not shown in this figure). Furthermore, a water supply line 1015*b* carries fluid from a supply tank (not shown in this figure) to the steam generator unit 1010. Further conduits 1015*c*, 1015*d* then carry steam from the steam generator unit 1010 to one or more of the first, second and third nozzles 110*a*, 110*b* and 110*c*. In other examples, further conduits not shown in this figure may be used such that each nozzle is fed by a separate conduit. A drain line 1012 extends between the steam generator unit 1010. Further conduits may be included which may comprise a power and interface cable.

FIG. 29 shows an exploded view of the device installed in the cabinet 995 with the door 996. Also shown in this figure is the waste tank 1020 for receiving the waste from the device and the supply tank 2030 for supplying the cleaning fluid. As can be seen from this figure, the steam generator unit 1010, waste tank 1020 and supply tank 1030 have been removed from the cabinet 995. These may be lifted out of the cabinet 995 or may be slidable on rails. In this way, an operator can easily access the steam generator unit 1010 for maintenance and cleaning and fill or empty the supply and waste tanks respectively.

Additional aspects of the invention will now be described by way of numbered clauses.

1. A device (200) for cleaning a receptacle (80) that is at least partly open-ended at one end (81) and having an interior space (82) defined by an interior wall (83);
   wherein the device is capable of cleaning at least a part of the interior wall of the receptacle (80);
   wherein the device comprises
   (a) a receiving component for receiving and holding the receptacle (80) to allow for the cleaning of at least the part of the interior wall of the receptacle (80), wherein the receiving component comprises a first rotating element (90) that is capable of rotating the receptacle (80);
   (b) a cleaning component that is capable of cleaning at least part of the interior wall of the receptacle interior wherein the cleaning component comprises a cleaning element (110) that is locatable within the interior space of the receptacle (80) when the receptacle (80) is held by the receiving component; and
   (c) a rotation driving component (400) that is capable of driving rotation of the first rotating element (90), wherein the rotation driving component comprises a second rotating element (130);
   wherein the cleaning element is capable of delivering a cleaning medium to the interior wall of the receptacle (80) to clean at least a part of the interior wall of the receptacle (80);
   further wherein the first rotating element (90) is magnetically coupled to the second rotating element (130), wherein the second rotating element (130) is configured to cause rotation of the first rotating element (90) on rotation of the second rotating element (130); and
   wherein the device has one or more of the following features:
   (a) the device comprises a gutter for removal of condensation that may occur through use of the device; and/or
   (b) the device comprises a control unit that is responsive to user input to operate the device; and/or
   (c) the device comprises a surface that is substantially flush with a surface on or in which the device is mounted and/or wherein the device comprises a fluid path for removal of fluid during use of after use of the device; and/or
   (d) the device comprises a lid wherein at least a part of the lid is removable and/or replaceable; and/or
   (e) at least all or part of the device is contained within at least one housing.
2. The device according to clause 1, wherein the first rotating element (90) comprises one or more magnets (315) and/or the second rotating element (130) comprises one or more magnets (460); wherein the one or more magnets (315), (460) is configured to cause rotation of the first rotating element (90) on rotation of the second rotating element (130).
3. The device according to clause 2, wherein the first rotating element (90) comprises one or more magnets (315) and the second rotating element (130) comprises one or more corresponding, reversed polarity magnets (460); wherein the one or more corresponding, reversed polarity magnets (315), (460) are configured to cause rotation of the first rotating element (90) on rotation of the second rotating element (130).
4. The device according to any one of clauses 1 to 3, wherein the first rotating element (90) is capable of disengaging and/or slipping from the second rotating element (130).
5 The device according to any one of clauses 1 to 4, wherein the first rotating element (90) disengages and/or slips from the second rotating element (130) when there is a force opposing the rotation of the first rotating element (90) that exceeds the force of the magnetic coupling between the first rotating element (90) and the second rotating element (130).
6. The device according to any one of clauses 1 to 5, wherein the first rotating element (90) disengages and/or slips from the second rotating element (130) when a force of less than about 300 Newton-centimetres or more is applied at the pivot point of the first rotating element (90).
7. The device according to any one of clauses 1 to 6, wherein the first rotating element (90) disengages and/or slips from the second rotating element (130) when a force of about 50 Newton-centimetres to about 300 Newton-centimetres is applied at the pivot point of the first rotating element (90).
8. The device according to any one of clauses 1 to 7, wherein the device does not comprise a mechanical connection between the first rotating element (90) and the second rotating element (130).
9. The device according to any one of clauses 1 to 8, wherein the device does not comprise a mechanical connection between the first rotating element (90) and any other part of the device (200).
10. The device according to any one of clauses 1 to 9, wherein the device comprises a watertight barrier between the first rotating element (90) and the second rotating element (130).
11. The device according to any one of clauses 1 to 10, wherein the receiving component of the device comprises a basin element (320) that is capable of capturing spent cleaning medium.
12. The device according to clause 11, wherein the second rotating element (130) is locatable outside of the basin element (320).
13. The device according to any one of clauses 1 to 11, wherein the cleaning element (110) faces a part of the interior wall (83) of the receptacle (80).
14. The device according to any one of clauses 1 to 13, wherein the first rotating element (90) comprises a turntable element that is capable of rotating the receptacle (80) and wherein the cleaning element (110) extends beyond the turntable element.
15. The device according to any one of clauses 1 to 14, wherein the rotation driving component (400) further comprises a means for driving the rotation of the second rotation element (130).
16. The device according to clause 15, wherein the means for driving the rotation of the second rotating element (130) comprises a motor (150).
17. The device according to any one of clauses 1 to 16 wherein the basin element (320) comprises a drain outlet for removal of spent cleaning medium (95).
18. The device according to any one of clauses 1 to 16 wherein the cleaning component comprises a cleaning medium preparation element (1) that is operably connected to the cleaning element (110).

19. The device according to any one of clauses 1 to 17 wherein the cleaning medium comprises steam.

20. The device according to any one of clauses 1 to 18 wherein the device further comprises a user interface module (200) to allow a user to use the device.

21. The device according to clause 20, wherein the user interface module (200) allows for the rotational speed of the first rotating device (90) to be altered.

22. The device according to any one of clauses 1 to 21 wherein the receptacle (80) is cleaned by the device in a period of about 30 seconds or less than about 30 seconds.

23. A method of cleaning a receptacle (80) that is at least partly open-ended at one end (81) and having an interior space (82) defined by an interior wall (83) comprising use of the device according to any one of clauses 1 to 22; wherein a receptacle (80) is placed on the receiving component of the device and the cleaning component cleans at least part of the interior wall (83) of the receptacle interior (82).

24. A method according to clause 23 wherein the receptacle (80) is a receptacle for a beverage.

25. A method according to clause 23 or clause 24 wherein the receptacle (80) is cleaned by the device in a period of about 30 seconds or less than about 30 seconds.

Although the invention has been described above with respect to a preferred embodiment and various modifications thereof, it is apparent that the foregoing and other changes in form and detail may be made therein by one skilled in the art while still remaining within the spirit and scope of the invention.

The invention claimed is:

1. A device for cleaning a receptacle, wherein the device comprises:

a receiving component for receiving and holding the receptacle;

a first nozzle arranged to be directed at an interior of the receptacle when the receptacle is held by the receiving component;

a lid for enclosing the receptacle in the receiving component; and a gutter arranged to channel fluid from the lid directly into the receiving component.

2. The device according to claim 1, wherein the first nozzle is capable of delivering a cleaning medium to an interior wall of the receptacle to clean at least a part of the interior wall of the receptacle.

3. The device according to claim 1, wherein the fluid comprises condensation occurring on the lid through use of the device.

4. The device according to claim 1, wherein:

the device comprises a hinge connecting the lid to one or more other components of the device, the hinge enabling the lid to open to provide access to the receiving component; and the gutter comprises a channel formed in the hinge.

5. The device according to claim 1, wherein the lid comprises a lip arranged to direct fluid from the lid into the gutter.

6. The device according to claim 1, wherein:

the device comprises a drain formed in the receiving component; and the gutter is arranged to channel the fluid towards drain.

7. The device according to claim 1, wherein the device comprises:

a control unit that is responsive to user input to operate the device;

wherein the control unit is responsive to a first form of user input when the lid is in a closed position to allow the lid to open; and wherein the control unit is responsive a second form of user input to initiate a receptacle washing cycle.

8. The device according to claim 7, wherein:

the control unit is responsive to the second form of user input when the lid is in an open position to prevent initiation of the receptacle washing cycle, or wherein the control unit is responsive to the second form of user input when the lid is in an open position to automatically close the lid and to initiate the receptacle washing cycle.

9. The device according to claim 1, wherein at least a portion of the device is arranged to be mounted on or in a mounting surface such that a surface of the device is substantially flush with the mounting surface on or in which the device is mounted.

10. The device according to claim 9, wherein the device provides a fluid path for fluid to flow from the surface and/or the mounting surface into the receiving component.

11. The device according to claim 1, wherein the lid is removable and/or replaceable.

12. The device according to claim 11, wherein a top surface of the device is removable and/or replaceable.

13. The device according to claim 1, wherein the device comprises:

a cleaning medium provision apparatus to supply a cleaning medium to the first nozzle;

wherein the device is arranged as a split system comprising:

a head unit that comprises at least the receiving component and the first nozzle; and an auxiliary unit comprising at least the cleaning medium provision apparatus.

14. The device according to claim 13, wherein the head unit and the auxiliary unit are connected by one or more conduits.

15. The device according to claim 13, wherein the head unit is arranged to be mounted on or in a mounting surface.

16. The device according to claim 1, wherein:

the receiving component comprises a first rotating element that is capable of rotating the receptacle;

the device comprises a rotation driving component comprising a second rotating element, wherein the rotation driving component is arranged to drive rotation of the second rotating element; and the second rotating element is magnetically coupled to the first rotating element such that rotation of the second rotating element by the rotation driving component drives rotation of the first rotating element.

17. The device according to claim 1, additionally comprising a second nozzle for cleaning at least a part of the exterior of the receptacle.

18. The device according to claim 1, wherein the receptacle comprises a base portion and a lid portion, wherein the receiving component comprises a first portion for receiving and holding the base portion and a second portion for receiving and holding the lid portion.

19. The device according to claim 1, wherein:

the device comprises a hinge connecting the lid to one or more other components of the device, the hinge enabling the lid to open to provide access to the receiving component; and the gutter comprises a channel formed in the hinge; and wherein the hinge is moveable between a first, open position and a second, closed position, wherein the receptacle comprises a base portion and a lid portion, wherein the receiving component comprises a first portion for receiving and holding the base portion and a second portion for receiving and holding the lid portion, wherein the second portion of the receiving component is, in use, located below the hinge in the second position.

20. The device according to claim 13, wherein the cleaning medium provision apparatus comprises a steam generator and one or more tanks.

21. A method of cleaning a receptacle comprising use of the device according to claim 1, the method comprising:

receiving the receptacle at the receiving component of the device; and delivering, via the first nozzle a cleaning medium to an interior wall of the receptacle to clean at least a part of the interior wall of the receptacle.

22. The method of cleaning a receptacle according to claim 21, wherein the receptacle is at least partly open-ended at one end and has an interior space defined by an interior wall.

23. The method of cleaning a receptacle according to claim 21, additionally comprising delivering, via a second nozzle, the cleaning medium to an exterior of the receptacle.

24. The method of cleaning a receptacle according to claim 21, wherein receiving the receptacle comprises receiving a base portion and a lid portion, wherein the receiving component comprises a first portion for receiving and holding the base portion and a second portion for receiving and holding the lid portion.

25. The method of cleaning a receptacle according to claim 24, additionally comprising delivering, via a third nozzle, the cleaning medium to the lid portion of the receptacle.

26. The method of cleaning a receptacle according to claim 23, additionally comprising selecting, by a user, one or more nozzles to be activated.

27. The method of cleaning a receptacle according to claim 23, additionally comprising activating, based on an output from a sensor, one or more nozzles.

* * * * *